US006308021B1

(12) United States Patent
Isogai et al.

(10) Patent No.: US 6,308,021 B1
(45) Date of Patent: Oct. 23, 2001

(54) FIXING DEVICE CAPABLE OF CORRECTING FIXING CONDITIONS IN ACCORDANCE WITH AN INTEGRATED ENERGIZING TIME

(75) Inventors: Mitsuru Isogai, Aichi-Ken; Tetsuro Ito, Anjo; Tetsuya Yamada, Aichi-Ken; Taizou Oonishi, Toyokawa, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/492,286

(22) Filed: Jan. 27, 2000

(30) Foreign Application Priority Data

Jan. 28, 1999 (JP) ..... 11-019746
Jan. 28, 1999 (JP) ..... 11-019761
Jan. 28, 1999 (JP) ..... 11-019779

(51) Int. Cl.[7] ..... G03G 15/20
(52) U.S. Cl. ..... 399/67; 399/68; 399/69
(58) Field of Search ..... 399/328, 67, 68, 399/70, 330

(56) References Cited

FOREIGN PATENT DOCUMENTS 63-309985 * 12/1988 (JP) .
1-201689 * 8/1989 (JP) .
7-28364 1/1995 (JP) .
7-5736 1/1995 (JP) .
10-91034 4/1998 (JP) .

* cited by examiner

*Primary Examiner*—Quana M. Grainger
(74) *Attorney, Agent, or Firm*—McDermott, Will & Emery

(57) ABSTRACT

A fixing device is provided with first and second fixing members each having an elastic member, a heater for heating at least one of the first and second fixing members and a controller. The first and second fixing members are abutted against each other so that the elastic members contact with each other. A sheet carrying an image of a developer is passed between the first and second fixing members, whereby the developer is fixed onto the sheet. The controller corrects fixing conditions including a fixing speed and a fixing temperature in accordance with an integrated energizing time that is an integrated value of an energizing time of the heater.

36 Claims, 44 Drawing Sheets

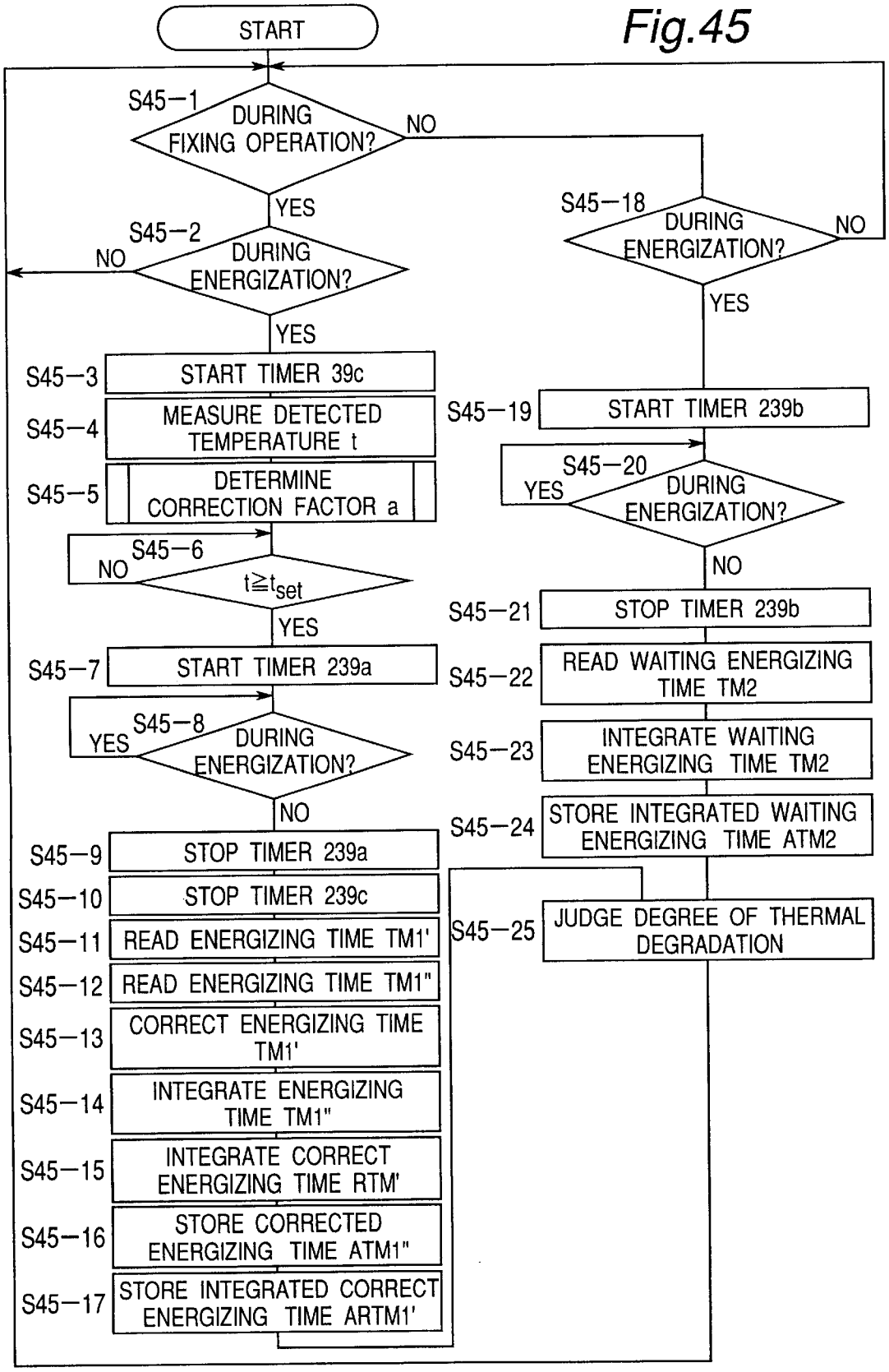
Fig.45
START
S45-1
DURING FIXING OPERATION?
NO
YES
S45-2
DURING ENERGIZATION?
NO
YES
S45-3
START TIMER 39c
S45-4
MEASURE DETECTED TEMPERATURE t
S45-5
DETERMINE CORRECTION FACTOR a
S45-6
NO
t≧tset
YES
S45-7
START TIMER 239a
S45-8
YES
DURING ENERGIZATION?
NO
S45-9
STOP TIMER 239a
S45-10
STOP TIMER 239c
S45-11
READ ENERGIZING TIME TM1'
S45-12
READ ENERGIZING TIME TM1"
S45-13
CORRECT ENERGIZING TIME TM1'
S45-14
INTEGRATE ENERGIZING TIME TM1"
S45-15
INTEGRATE CORRECT ENERGIZING TIME RTM'
S45-16
STORE CORRECTED ENERGIZING TIME ATM1"
S45-17
STORE INTEGRATED CORRECT ENERGIZING TIME ARTM1'
S45-18
DURING ENERGIZATION?
NO
YES
S45-19
START TIMER 239b
S45-20
YES
DURING ENERGIZATION?
NO
S45-21
STOP TIMER 239b
S45-22
READ WAITING ENERGIZING TIME TM2
S45-23
INTEGRATE WAITING ENERGIZING TIME TM2
S45-24
STORE INTEGRATED WAITING ENERGIZING TIME ATM2
S45-25
JUDGE DEGREE OF THERMAL DEGRADATION

FIXING DEVICE CAPABLE OF CORRECTING FIXING CONDITIONS IN ACCORDANCE WITH AN INTEGRATED ENERGIZING TIME

This application is based on applications Nos. 11-19746 11-19761 and 11-19779 filed in Japan, the contents in which are hereby incorporated by reference.

BACKGROUND OF THE INVENTION

The present invention relates to a fixing device which is used in an image forming apparatus according to the electrophotographic system such as a copying machine, a printer, or a facsimile apparatus to heat and fuse a developer image that has been transferred from an image bearing body to a transfer sheet such as normal paper or a transparency resin sheet for an overhead projector (OHP sheet), thereby fixing the image to the sheet.

Conventionally, as shown in FIG. 46, a known fixing device of this kind comprises fixing members 3 and 4 configured by a pair of rollers in each of which an elastic member 2 is disposed on the outer periphery of a metal cylinder 1, heating means 5 for heating the fixing members 3 and 4, driving means 6 for rotatingly driving at least one fixing member 3, and a spring 7 which causes the fixing members 3 and 4 to contact with each other at a constant abutting force. A transfer sheet 9 is transported to a contact portion (nip portion 8) between the elastic members 2 of the pair of fixing members 3 and 4. A developer on the transfer sheet 9 is fused by heat supplied from the fixing members 3 and 4 and then fixed to the transfer sheet 9.

In order to improve the productivity in a copying machine, a printer or the like, the rotational speeds of the fixing members 3 and 4 should be increased so as to increase a speed at which the transfer sheet 9 is passed through the nip portion 8 (fixing speed).

In the conventional fixing device, silicone rubber constituting the elastic members 2 has a heat conductivity of about 0.6 to $0.8\times10^{-3}$ cal/cm·sec·° C. Therefore, the efficiency of absorbing heat from the surfaces of the elastic members 2 into the transfer sheet 9 passed through the nip portion 8 is higher than that of supplying heat from the heating means 5 to the surfaces of the elastic members 2. As a result, a phenomenon takes place in which, when the fixing speed is set to be higher, the surface temperatures of the elastic members 2 are temporarily decreased during a period when an operation of continuously supplying sheets is started. The decrease of surface temperature causes a failure in image gloss or a fixing failure.

In order to increase the efficiency of the heat supply from the heating means 5 to the surfaces of the elastic members 2, a countermeasure may be taken in which a reinforcing inorganic filler such as silica or iron oxide added to the silicone rubber is replaced with a high thermal conductive filler such as alumina or magnesium oxide, and the addition amount of the filler is increased. However, a high thermal conductive filler has no effect of improving the heat resistance. Furthermore, as the addition amount of the filler is increased, the polymer component having excellent heat resistance is inevitably reduced. Therefore, the elastic members are decreased in strength in high temperature and hence susceptible to be thermally degraded. In the case where the contact abutting force between the fixing members 3 and 4 is constant as in the fixing device shown in FIG. 46, when the hardness is reduced as a result of thermal degradation, the width of the nip portion 8 (nip width) is increased. When the nip width is increased, the quantity of heat supplied from the nip portion 8 to the transfer sheet 9 is varied and hence the image quality is changed.

Further, when the addition amount of the filler is increased, the hardness of the silicone rubber is increased and the elastic members 2 are decreased in elasticity. When the elasticity of the elastic members 2 is decreased, it is necessary to perform the abutting of the fixing members 3 and 4 at a very high pressure or to thicken the elastic members 2 in order to ensure the width of the nip portion 8, thereby causing an image to be obscured or a sheet to become crinkled, or reducing the heat supply quantity to cause a fixing failure or the like.

Furthermore, when the density of cross-link of the silicone rubber is increased higher by changing the polymer component, it is possible to suppress the reduction of the hardness due to the thermal degradation. However, the increased density of cross-link causes the elasticity of the elastic members 2 to be decreased.

SUMMARY OF THE INVENTION

As described above, it is difficult to enhance all the heat conductivity, the heat resistance, and the elasticity of silicone rubber constituting the elastic members 2. When the heat conductivity is set to be high in order to improve the productivity, it is impossible to eliminate an effect of reduction of the hardness due to the thermal degradation. In other words, in order to maintain the image quality, fixing conditions such as the surface temperatures of the elastic members 2 (fixing temperature), and the transporting speed of a transfer sheet (fixing speed) must be changed in accordance with the degree of advancement of thermal degradation.

It is an object of the invention to provide a fixing device in which an effect of reduction of the hardness of an elastic member due to thermal degradation is corrected, thereby attaining a high productivity.

A first aspect of the invention provides a fixing device comprising: first and second fixing members each of which has an elastic member and which are abutted against each other so that said elastic members contact with each other; a heater which heats at least one of said first and second fixing members; and a controller which corrects fixing conditions in accordance with an integrated energizing time that is an integrated value of an energizing time of said heater, wherein a sheet carrying an image of a developer is passed between said first and second fixing members, whereby the developer is heated and fused under a pressure exerted by said first and second fixing members, to be fixed onto the sheet.

In a fixing device of the first aspect of the invention, fixing conditions are corrected in accordance with the integrated energizing time that is the integrated value of the energizing time of the heater. Therefore, even when the efficiency of the heat supply to a transfer sheet is decreased because of reduction of the hardness of an elastic member of a heating member due to thermal degradation, a sufficient quantity of heat is supplied to the transfer sheet. As a result, reduction of the fixing property and that of the reproducibility of a transparent color which are respectively caused by reduction of the hardness of the elastic member in the cases where the transfer sheet is normal paper and where the transfer sheet is an OHP sheet can be prevented from occurring.

A second aspect of the invention provides a fixing device comprising: first and second fixing members each of which has an elastic member and which are abutted against each other so that said elastic members contact with each other;

a heater which heats at least one of said first and second fixing members; and a controller which corrects fixing conditions in accordance with an integrated energizing time that is an integrated value of an energizing time of said heater, and information of an image to be fixed, wherein a sheet carrying an image of a developer is passed between said first and second fixing members, whereby the developer is heated and fused under a pressure exerted by said first and second fixing members, to be fixed onto the sheet.

In a fixing device of a second aspect of the invention, fixing conditions are corrected in consideration of not only the integrated energizing time but also of the image information. Therefore, reduction of the fixing property in the case where the transfer sheet is normal paper, and that of the reproducibility of a transparent color in the case where the transfer sheet is an OHP sheet can be compensated more surely. Further, as a result of the correction of the fixing conditions, an excessive heat load is prevented from being applied to the elastic members to promote advancement of the thermal degradation.

Third aspect of the invention provides a fixing device comprising: first and second fixing members each of which has an elastic member and which are abutted against each other so that said elastic members contact with each other; a heater which heats at least one of said first and second fixing members; and estimating means for estimating a degree of thermal degradation of said elastic members on the basis of an integrated energizing time that is an integrated value of an energizing time of said heater, wherein a sheet carrying an image of a developer is passed between said first and second fixing members, whereby the developer is heated and fused under a pressure exerted by said first and second fixing members, to be fixed onto the sheet.

In a fixing device of a third invention, estimating means estimates the degree of thermal degradation of the elastic member on the basis of the integrated energizing time of the heater. Therefore, thermal degradation of the elastic member can be estimated by a simple configuration.

BRIEF DESCRIPTION OF THE DRAWINGS

Further objects and advantages of the present invention will become clear from the following description taken in conjunction with the preferred embodiments thereof with reference to the accompanying drawings, in which:

FIG. 45 is a flowchart illustrating the operation of the thermal degradation estimating means 231 of the twelfth embodiment.

DETAILED DESCRIPTION OF THE PREFERRED EMBODIMENTS

First Embodiment

Figure 1:
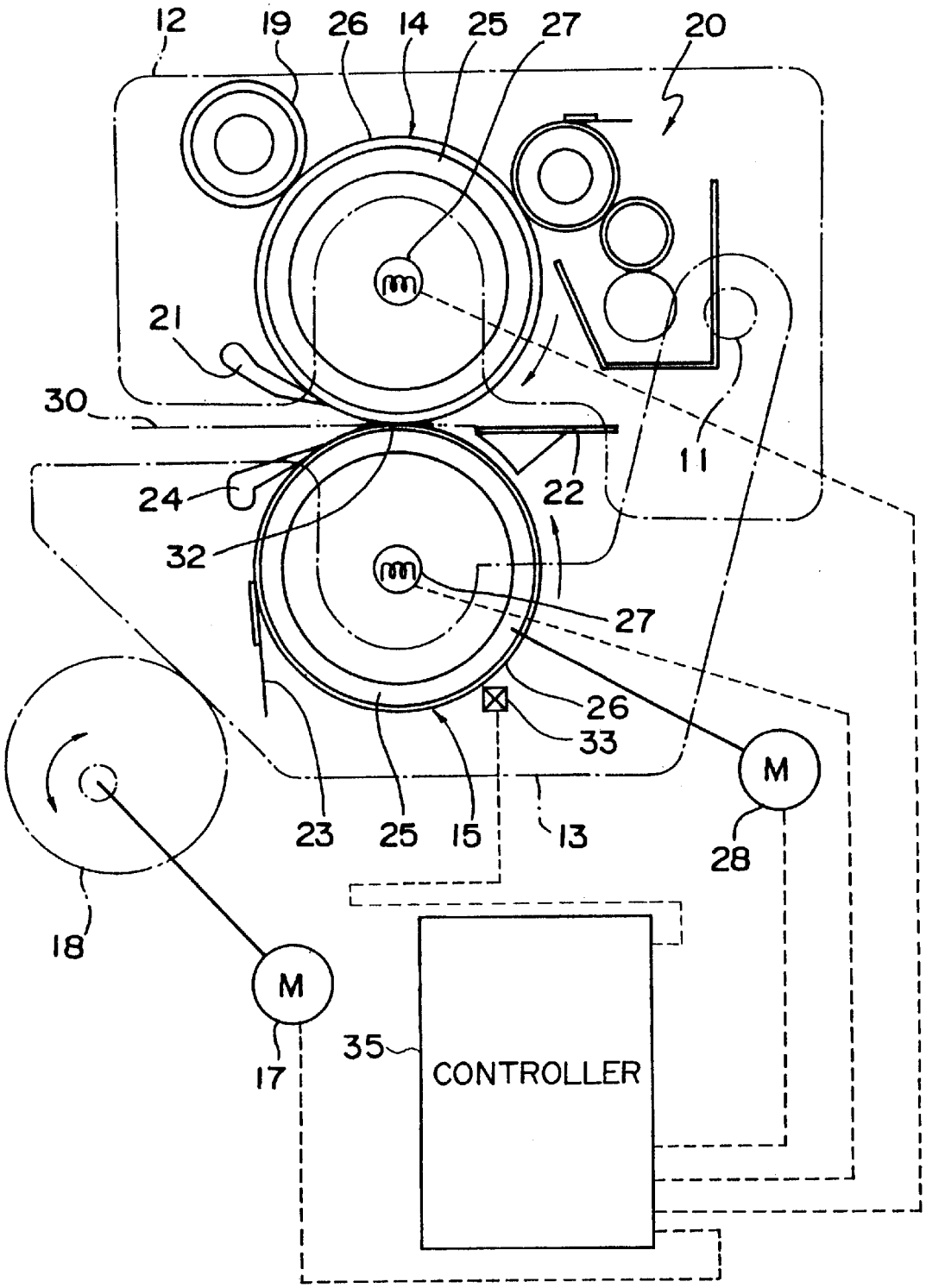
FIG. 1 is a diagram schematically showing a fixing device of a first embodiment of the invention.

A fixing device of an embodiment of the invention shown in FIGS. 1 and 2 comprises an upper frame 12 and a lower frame 13 which are coupled to each other by an axial support pin 11. A fixing roller 14 and a pressure roller 15 which serve as fixing members are respectively supported by the upper and lower frames 12 and 13 in a rotatable manner.

Figure 2A:
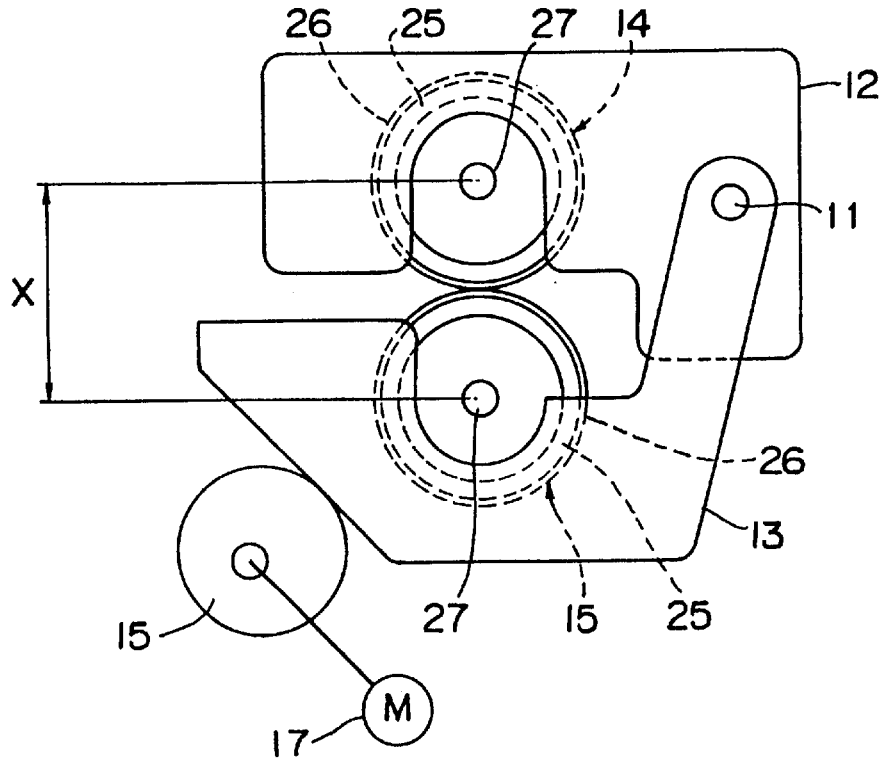
FIG. 2A is a diagram showing the fixing device in an abutting state.
Figure 2B:
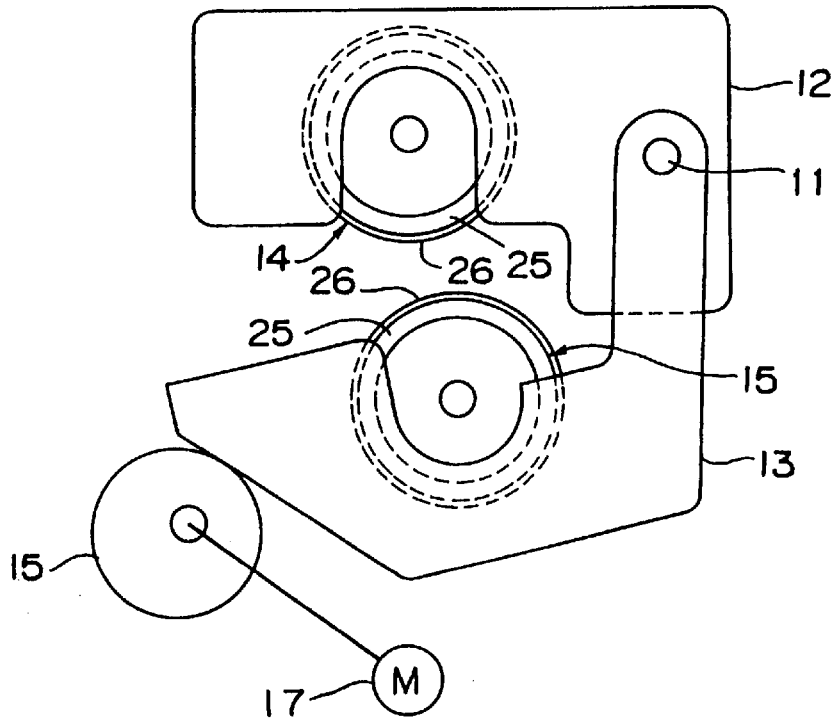
FIG. 2B is a diagram showing the fixing device in a separating state.

An eccentric cam 18 that is driven by a motor 17 is abutted against the lower frame 13. By changing angles of rotation of the eccentric cam 18, it is enabled to switch between an abutted condition in which the fixing roller 14 and pressure roller 15 are abutted against each other as shown in FIG. 2A, and a separate condition in which the fixing roller 14 and the pressure roller 15 are separated from each other as shown in FIG. 2B. Further, by adjusting the angle of rotation of the cam 18, a distance X between axes of the fixing roller 14 and pressure roller 15 (as shown in FIG. 2A) can be maintained constant and thus to maintain a width of a later-mentioned nip portion 32 constant.

As shown in FIG. 1, in addition to the fixing roller 14, a cleaning roller 19, an oil applying mechanism 20, a separator 21, and the like are disposed in the upper frame 12. In the lower frame 13, a temperature sensor 33 which detects the surface temperature of a silicone rubber layer 26 of the pressure roller 15, a pre-fixing guide 22, an oil-scraping blade 23, a separator 24, and the like are disposed.

In each of the fixing roller 14 and the pressure roller 15, the silicone rubber layer 26 serving as an elastic member is disposed on the outer periphery of a metal cylinder 25. The silicone rubber layer 26 is set to have a heat conductivity which is not smaller than $1.2\times10^{-3}$ (cal/cm·sec·° C. ) and not larger than $2.4\times10^{-3}$ (cal/cm·sec·° C.). When evaluated in accordance with JIS C 2123, the silicone rubber layer 26 has a hardness of 70 or less.

A heater 27 serving as heating means is accommodated in each of the metal cylinders 25. A motor 28 is coupled to the pressure roller 15. When the motor 28 is operated under the pressing state shown in FIG. 2A, the pressure roller 15 is rotated in a counterclockwise direction in the figures and the fixing roller 14 is rotated in a following manner.

A transfer sheet 30 such as normal paper or an OHP sheet in which a developer image is formed on the upper face in the figure is supplied to the nip portion 32, and then transported to the left side in the figure by the rotation of the fixing roller 14 and the pressure roller 15. During this process, the developer on the transfer sheet 30 is heated and fused by the heat supplied from the silicone rubber layers 26, and then fixed onto the transfer sheet 30 by the abutting force exerted between the fixing roller 14 and the pressure roller 15.

Referring to FIG. 1, 35 denotes a controller constituting the estimating means in the invention. The motors 17 and 28, the heaters 27, and the temperature sensor 33 are connected to the controller 35.

Figure 3:
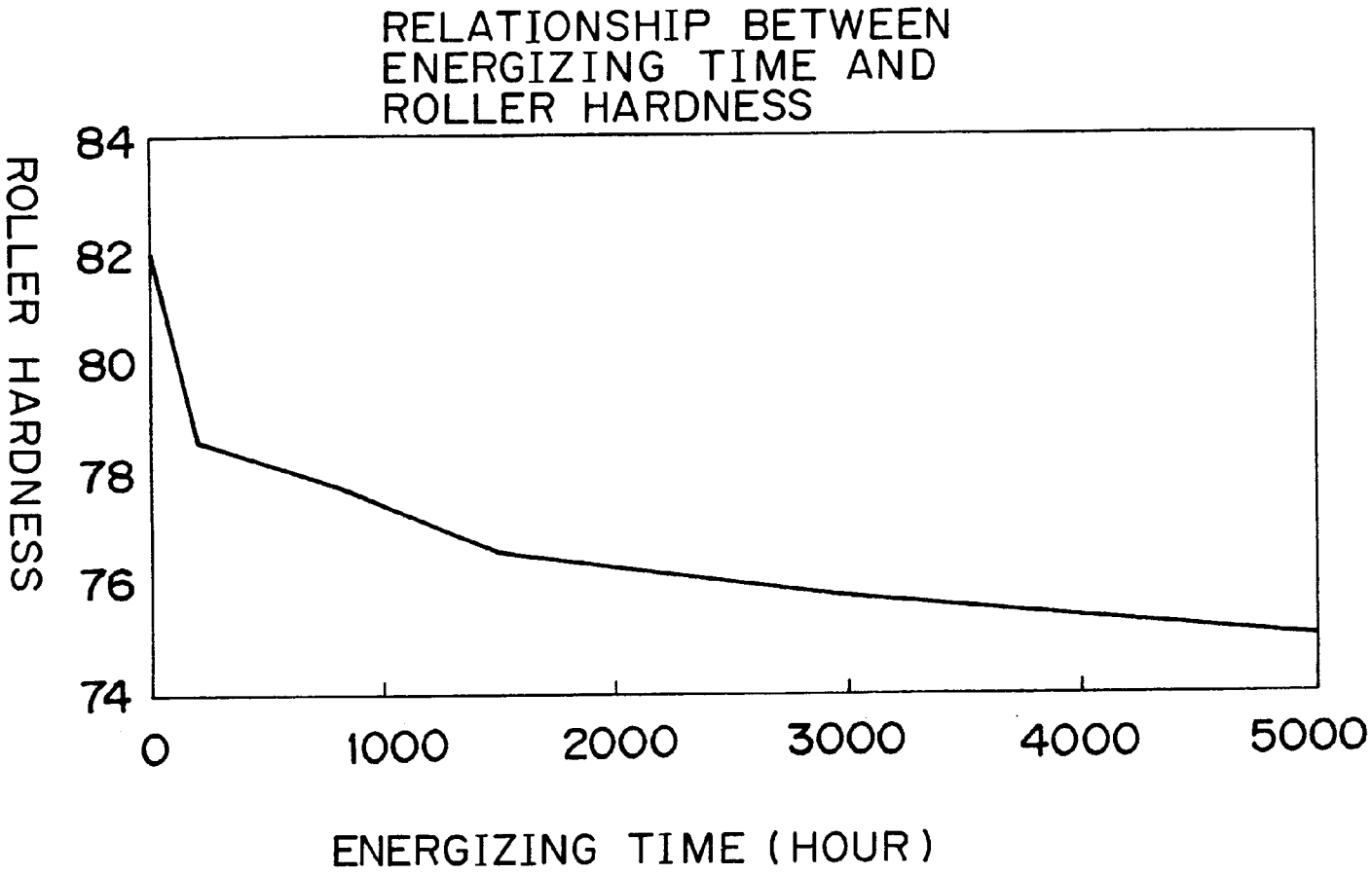
FIG. 3 is a graph showing relationships between the hardness of a silicone rubber layer 26 and an integrated energizing time.

In the fixing device of the first embodiment, the content of a high thermal conductive filler in the silicone rubber layers 26 of the fixing roller 14 and the pressure roller 15 is increased so that the heat conductivity is set to a large value or not smaller than $1.2\times10^{-3}$ (cal/cm·sec·° C.) and not larger than $2.4\times10^{-3}$ (cal/cm·sec·° C.) as described above. Therefore, as shown in FIG. 3, the hardness of each roller is reduced as the integrated value of the energizing time (integrated energizing time) of the heaters 27 is increased. As described above, the axis-to-axis distance X between the fixing roller 14 and the pressure roller 15 is set to be constant. Thus, even when the roller hardness is reduced, the width of the nip portion 32 is constant. However, as shown in Table 1 below, the abutting force which is produced by the elasticity of the fixing roller 14 and the pressure roller 15 and acts on the nip portion 32 is decreased as a result of temporal reduction of the hardness.

[Table 1]

Relationships between the integrated energizing time and the abutting force between the fixing roller and the pressure roller

| Integrated energizing time (Hr) | Abutting force: total pressure (Kg) |
|---|---|
| 0~200 | 130 |
| 200~800 | 95 |
| 800~1500 | 85 |
| 1500~3000 | 77 |
| 3000~5000 | 72 |
| 5000~ | 66 |

The decreased abutting force causes the fixing property to be reduced in the cases where the transfer sheet 30 is normal paper, and the reproducibility of a transparent color to be reduced in the case where the transfer sheet 30 is an OHP sheet. In the first embodiment, in order to eliminate an effect of such reduction of the hardness due to thermal degradation, the controller 35 implements the operations shown in the flowcharts of FIGS. 4 to 7.

Figure 4:
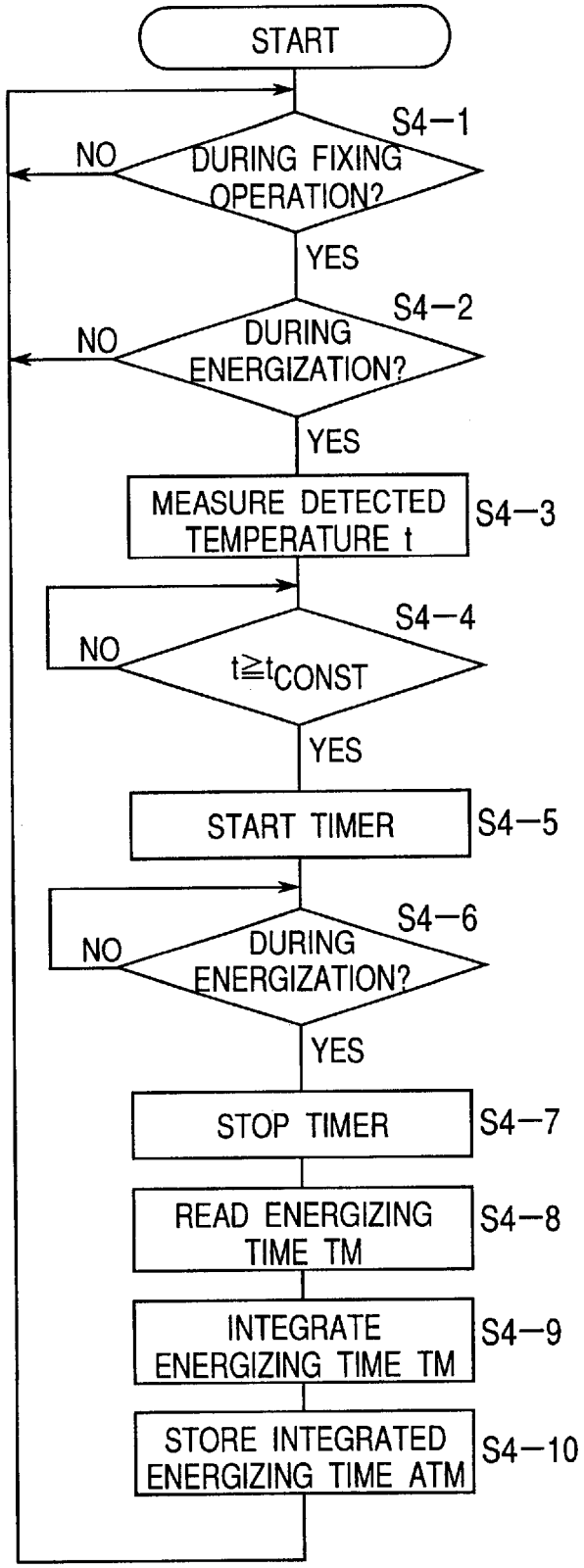
FIG. 4 is a flowchart illustrating an operation of measuring the integrated energizing time in a controller.

First, the controller 35 performs the measurement of the energizing time as shown in FIG. 4.

If it is judged in step S4-1 that the fixing operation is being performed, and in step S4-2 that the heater 27 is being energized, then in step S4-3 the temperature sensor 33 detects the temperature of the silicone rubber layer 26 of the pressure roller 15.

If it is judged in step S4-4 that the detected temperature t is not lower than a predetermined temperature $t_{const}$, then in step S4-5 a timer is started. The time measurement is continued until no energization is detected in step S4-6. If no energization is detected in step S4-6, then the timer is stopped in step S4-7, and the energizing time TM in this measurement is read out in step S4-8. Further, in step S4-9, the integrated value of the energizing time TM (integrated energizing time ATM) is calculated, and the integrated energizing time ATM is stored in step S4-10.

The fixing operation shown in FIG. 5 will be described. First, it is judged in step S5-1 whether the copy mode is a normal paper mode or an OHP sheet mode.

If it is judged in step S5-1 that the copy mode is the normal paper mode, then the control is advanced to step S5-2 to perform a correction of fixing speed for the normal paper mode. In step S5-2, on the basis of Table 2 listed below, the fixing speed is corrected in accordance with the integrated energizing time ATM.

TABLE 2

Correction of fixing speed (normal paper mode)

| Integrated energizing time ATM (Hr) | Correction of fixing speed |
|---|---|
| 0~200 | Not corrected |
| 200~800 | Fixing speed is decreased by 2% |
| 800~2000 | Fixing speed is decreased by 4% |
| 2000~5000 | Fixing speed is decreased by 6% |
| 5000~ | Fixing speed is decreased by 8% |

Figure 6:
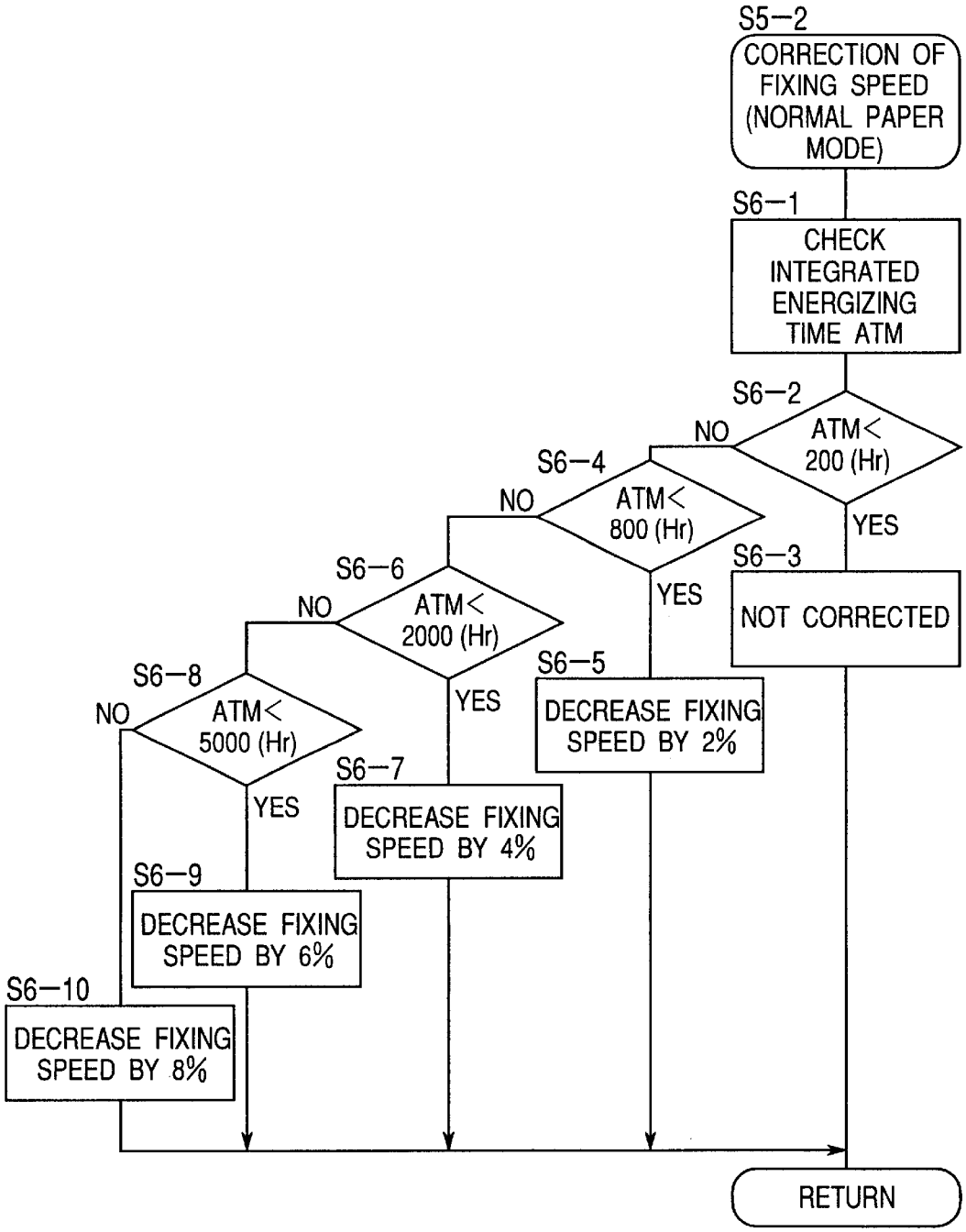
FIG. 6 is a flowchart showing a subroutine of step S5-2 of FIG. 5.

First, the integrated energizing time ATM is checked in step S6-1 of FIG. 6. If it is judged in step S6-2 that the integrated energizing time ATM is shorter than 200 hours, then it is determined in step S6-3 that the fixing speed is not corrected. If it is judged in step S6-2 that the integrated energizing time ATM is not shorter than 200 hours, then the control is advanced to step S6-4. If it is judged in step S6-4 that the integrated energizing time ATM is shorter than 800 hours, then the fixing speed is decreased by 2% in step S6-5. If it is judged in step S6-4 that the integrated energizing time ATM is not shorter than 800 hours, then the control is advanced to step S6-6. If it is judged in step S6-6 that the integrated energizing time ATM is shorter than 2,000 hours, then the fixing speed is decreased by 4% in step S6-7. If it is judged in step S6-6 that the integrated energizing time ATM is not shorter than 2,000 hours, then the control is advanced to step S6-8. If it is judged in step S6-8 that the integrated energizing time ATM is shorter than 5,000 hours, then the fixing speed is decreased by 6% in step S6-9. If the integrated energizing time is not shorter than 5,000 hours, then the fixing speed is decreased by 8% in step S6-10.

Figure 5:
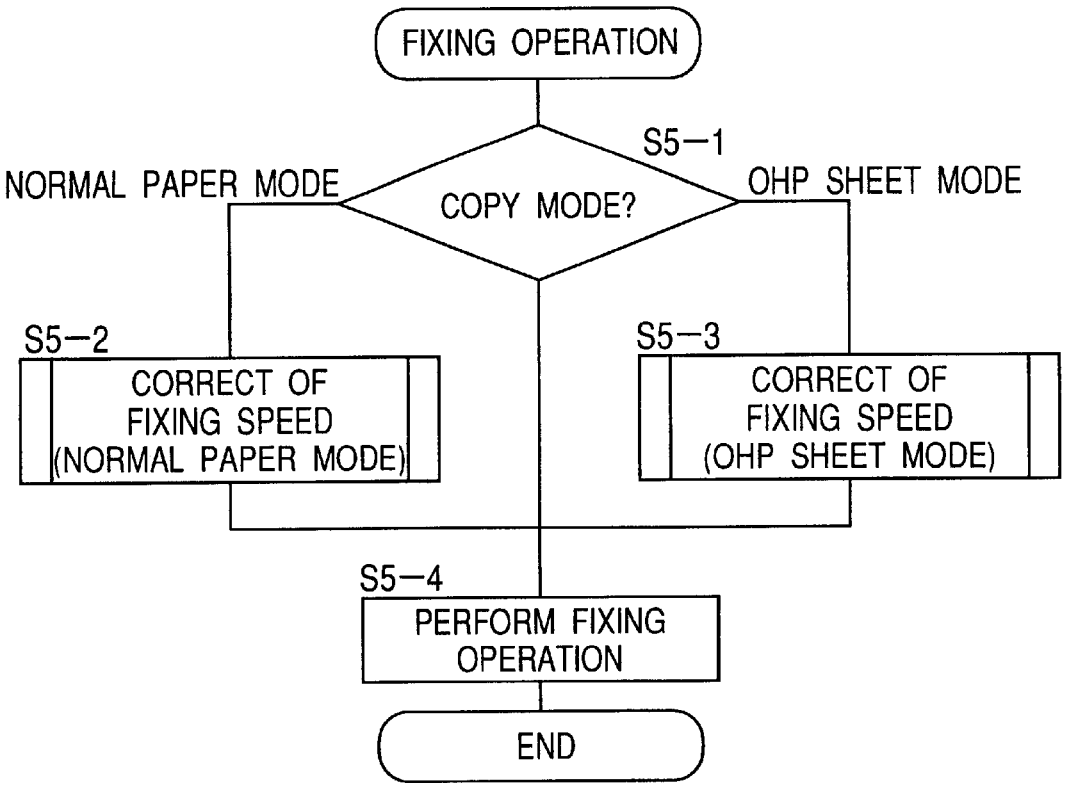
FIG. 5 is a flowchart illustrating a fixing operation in the first embodiment of the invention.

By contrast, if it is judged in step S5-1 of FIG. 5 that the copy mode is the OHP sheet mode, then the control is advanced to step S5-3 to perform a correction of fixing speed for the OHP sheet mode. In step S5-3, on the basis of Table 3 listed below, the fixing speed is corrected in accordance with the integrated energizing time ATM.

TABLE 3

Correction of fixing speed (OHP sheet mode)

| Integrated energizing time ATM (Hr) | Correction of fixing speed |
|---|---|
| 0~200 | Not corrected |
| 200~800 | Fixing speed is decreased by 3% |
| 800~2000 | Fixing speed is decreased by 6% |
| 2000~5000 | Fixing speed is decreased by 9% |
| 5000~ | Fixing speed is decreased by 12% |

Figure 7:
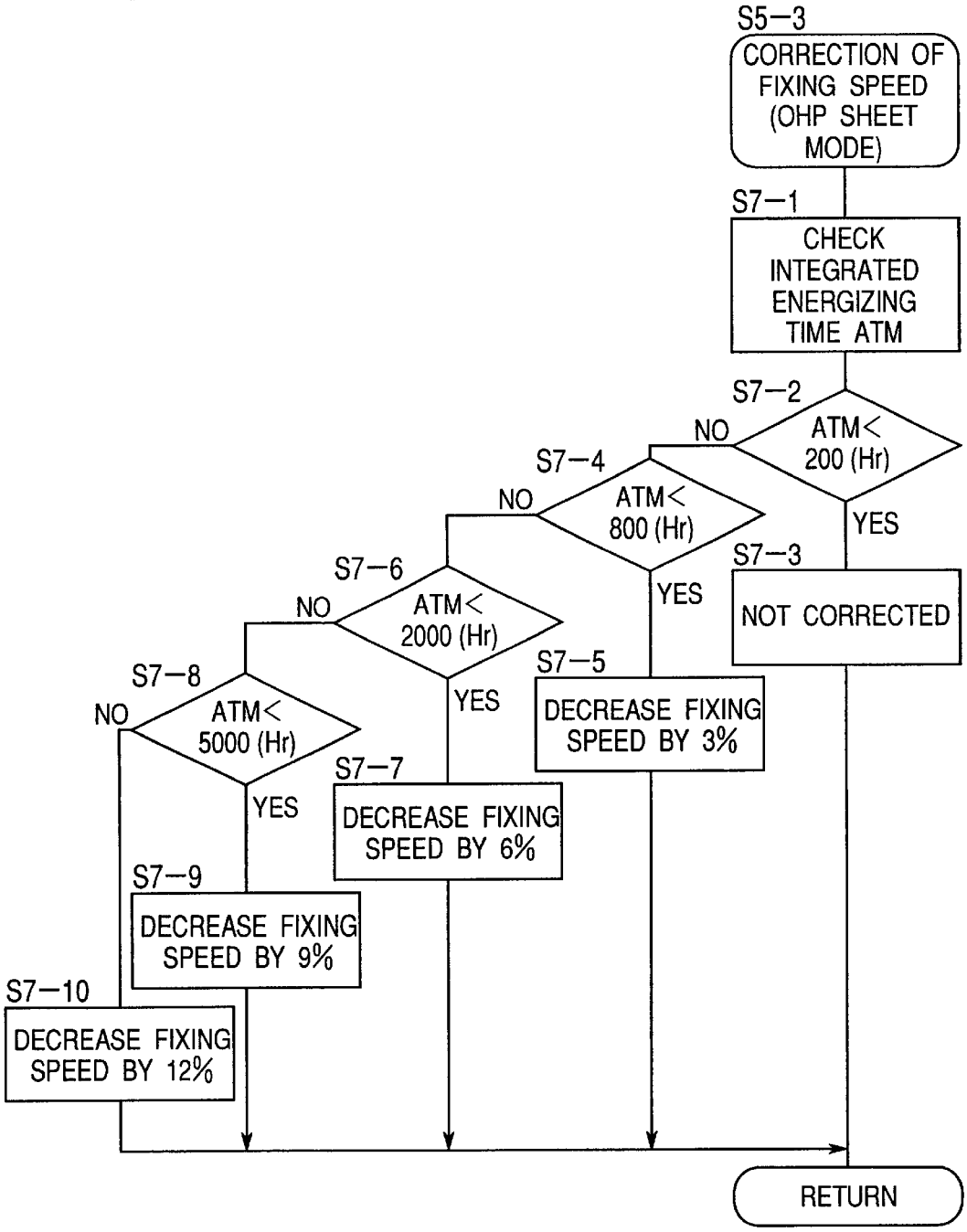
FIG. 7 is a flowchart showing a subroutine of step S5-3 of FIG. 5.

First, the integrated energizing time ATM is checked in step S7-1 of FIG. 7. If it is judged in step S7-2 that the integrated energizing time ATM is shorter than 200 hours, then it is determined in step S7-3 that the fixing speed is not corrected. If it is judged in step S7-2 that the integrated energizing time ATM is not shorter than 200 hours, then the control is advanced to step S7-4. If it is judged in step S7-4 that the integrated energizing time ATM is shorter than 800 hours, then the fixing speed is decreased by 3% in step S7-5. If it is judged in step S7-4 that the integrated energizing time ATM is not shorter than 800 hours, then the control is advanced to step S7-6. If it is judged in step S7-6 that the integrated energizing time ATM is shorter than 2,000 hours, the fixing speed is decreased by 6% in step S7-7. If it is judged in step S7-6 that the integrated energizing time ATM is not shorter than 2,000 hours, then the control is advanced to step S7-8. If it is judged in step S7-8 that the integrated energizing time ATM is shorter than 5,000 hours, then the fixing speed is decreased by 9% in step S7-9. If the integrated energizing time is not shorter than 5,000 hours, then the fixing speed is decreased by 12% in step S7-10.

As described above, the fixing speed is corrected in accordance with the integrated energizing time ATM, and the conditions of correction are changed in different manners according to the kind of the transfer sheet. Thereafter, the fixing operation is performed in step S5-4 of FIG. 5.

In the first embodiment, since the heat conductivity of each of the silicone rubber layers 26 of the fixing roller 14 and the pressure roller 15 is set to a large value or not smaller than $1.2\times10^{-3}$ (cal/cm·sec·° C.) and not larger than $2.4\times10^{-3}$ (cal/cm·sec·° C.) as described above, heat is efficiently transferred from the heaters 27 to the surfaces of the silicone rubber layers 26. Therefore, the surface temperatures of the silicone rubber layers 26 are prevented from being temporarily decreased during a period when an operation of continuously supplying sheets is started, and the fixing speed can be set to be high.

In the first embodiment, as the integrated energizing time ATM is longer, i.e., as the reduction of the hardness of the silicone rubber layers 26 due to the thermal degradation is further advanced, the fixing speed is further decreased as described above. When the fixing speed is decreased, the time when the transfer sheet 30 stays in the nip portion 32 between the fixing roller 14 and the pressure roller 15 is prolonged, so that the quantity of heat supplied from the fixing roller 14 and the pressure roller 15 to the transfer sheet 30 is increased. Therefore, it is possible to compensate for insufficiency of the heat supplied to the transfer sheet 30 which is caused by the reduction of the hardness of the silicone rubber layers 26 due to the thermal degradation, and which inevitably occurs in the case where the silicone rubber layers 26 of the fixing roller 14 and the pressure roller 15 are set to have a high heat conductivity as described above. Consequently, the fixing device of the first embodiment can attain an excellent fixing property in the case of normal paper, and an excellent reproducibility of a transparent color in the case of an OHP sheet.

Second Embodiment

Next, a second embodiment of the invention will be described.

In the second embodiment, an effect of decrease of the quantity of heat supplied to the transfer sheet 30 which is caused by the reduction of the hardness of the silicone rubber layers 26 due to the thermal degradation is compensated by adjusting the surface temperature of each of the silicone rubber layers 26 of the fixing roller 14 and the pressure roller 15 (fixing temperature).

The mechanical structure of the fixing device of the second embodiment is substantially identical with that of the first embodiment shown in FIG. 1, and the silicone rubber layers 26 of the fixing roller 14 and the pressure roller 15 have a high heat conductivity which is not smaller than $1.2\times10^{-3}$ (cal/cm·sec·° C.) and not larger than $2.4\times10^{-3}$ (cal/cm·sec·° C.) as same as the first embodiment. The fixing temperature before correction is 160° C. in both the cases where the transfer sheet is normal paper and where the transfer sheet is an OHP sheet.

The fixing operation shown in FIG. 8 will be described. If it is judged in step S8-1 that the copy mode is the normal paper mode, then the control is advanced to step S8-2 to perform a correction of fixing temperature for the normal paper mode. In step S8-2, on the basis of FIG. 9 and Table 4 listed below, the fixing temperature is corrected in accordance with the integrated energizing time ATM.

TABLE 4

Correction of fixing temperature (OHP sheet mode)

| Integrated energizing time ATM (Hr) | Correction of fixing temperature |
|---|---|
| 0~200 | Not corrected |
| 200~800 | Fixing temperature is increased by 1.5° C. |
| 800~2000 | Fixing temperature is increased by 3° C. |
| 2000~5000 | Fixing temperature is increased by 4.5° C. |
| 5000~ | Fixing temperature is increased by 6° C. |

Figure 10:
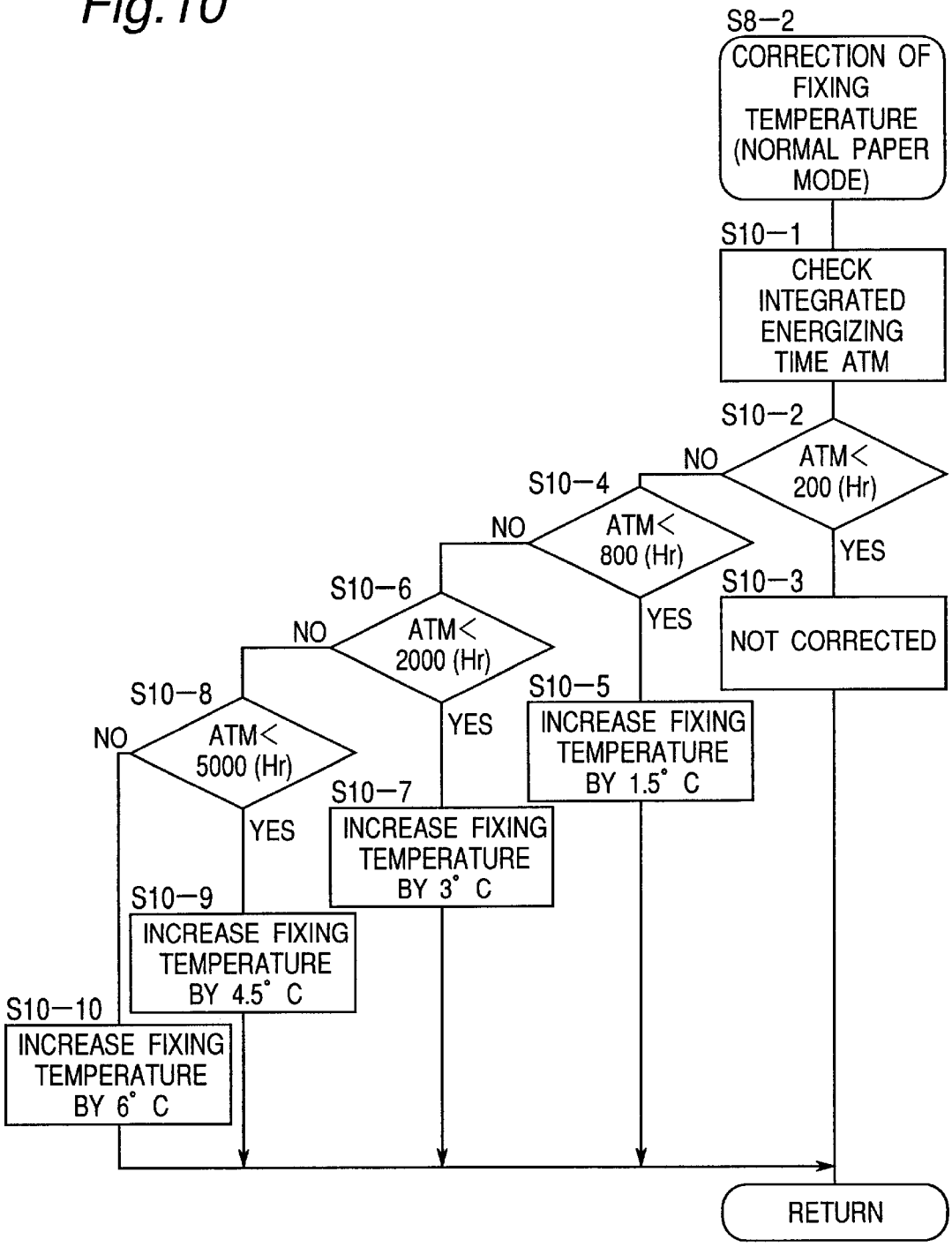
FIG. 10 is a flowchart showing a subroutine of step S8-2 of FIG. 8.

First, the integrated energizing time ATM is checked in step S10-1 of FIG. 10. If it is judged in step S10-2 that the integrated energizing time ATM is shorter than 200 hours, then it is determined in step S10-3 that the fixing temperature is not corrected. If it is judged in step S10-2 that the integrated energizing time ATM is not shorter than 200 hours, then the control is advanced to step S10-4. If it is judged in step S10-4 that the integrated energizing time ATM is shorter than 800 hours, then the fixing temperature is increased by 1.5° C. in step S10-5. If it is judged in step S10-4 that the integrated energizing time ATM is not shorter than 800 hours, then the control is advanced to step S10-6. If it is judged in step S10-6 that the integrated energizing time ATM is shorter than 2,000 hours, then the fixing temperature is increased by 3° C. in step S10-7. If it is judged in step S10-6 that the integrated energizing time ATM is not shorter than 2,000 hours, then the control is advanced to step S10-8. If it is judged in step S10–8 that the integrated energizing time ATM is shorter than 5,000 hours, then the fixing temperature is increased by 4.5° C. in step S10-9. If the integrated energizing time is not shorter than 5,000 hours, then the fixing temperature is increased by 6° C. in step S10-10.

Figure 8:
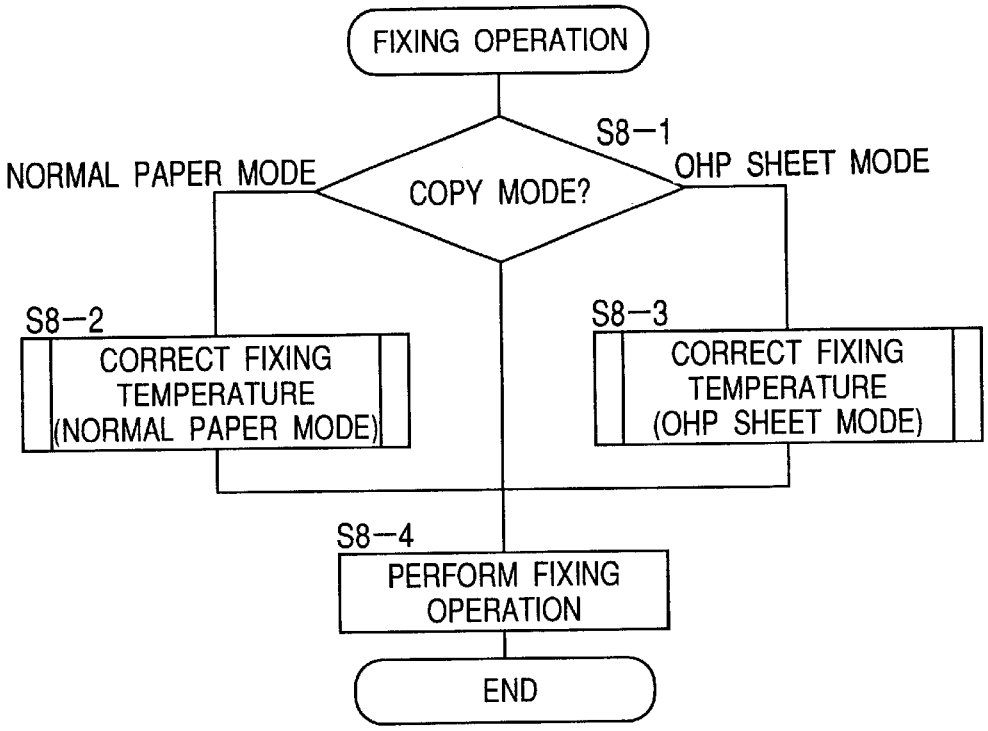
FIG. 8 is a flowchart illustrating a fixing operation in a second embodiment of the invention.

By contrast, if it is judged in step S8-1 of FIG. 8 that the copy mode is the OHP sheet mode, then the control is advanced to step S8-3 to perform a correction of fixing temperature for the OHP sheet mode. In step S8-3, on the basis of FIG. 9 and Table 5 listed below, the fixing temperature is corrected in accordance with the integrated energizing time ATM.

TABLE 5

Correction of fixing temperature (OHP sheet mode)

| Integrated energizing time ATM (Hr) | Correction of fixing temperature |
|---|---|
| 0~200 | Not corrected |
| 200~800 | Fixing temperature is increased by 2.5° C. |
| 800~2000 | Fixing temperature is increased by 5.0° C. |

TABLE 5-continued

Correction of fixing temperature (OHP sheet mode)

| Integrated energizing time ATM (Hr) | Correction of fixing temperature |
|---|---|
| 2000~5000 | Fixing temperature is increased by 7.5° C. |
| 5000~ | Fixing temperature is increased by 10° C. |

Figure 11:
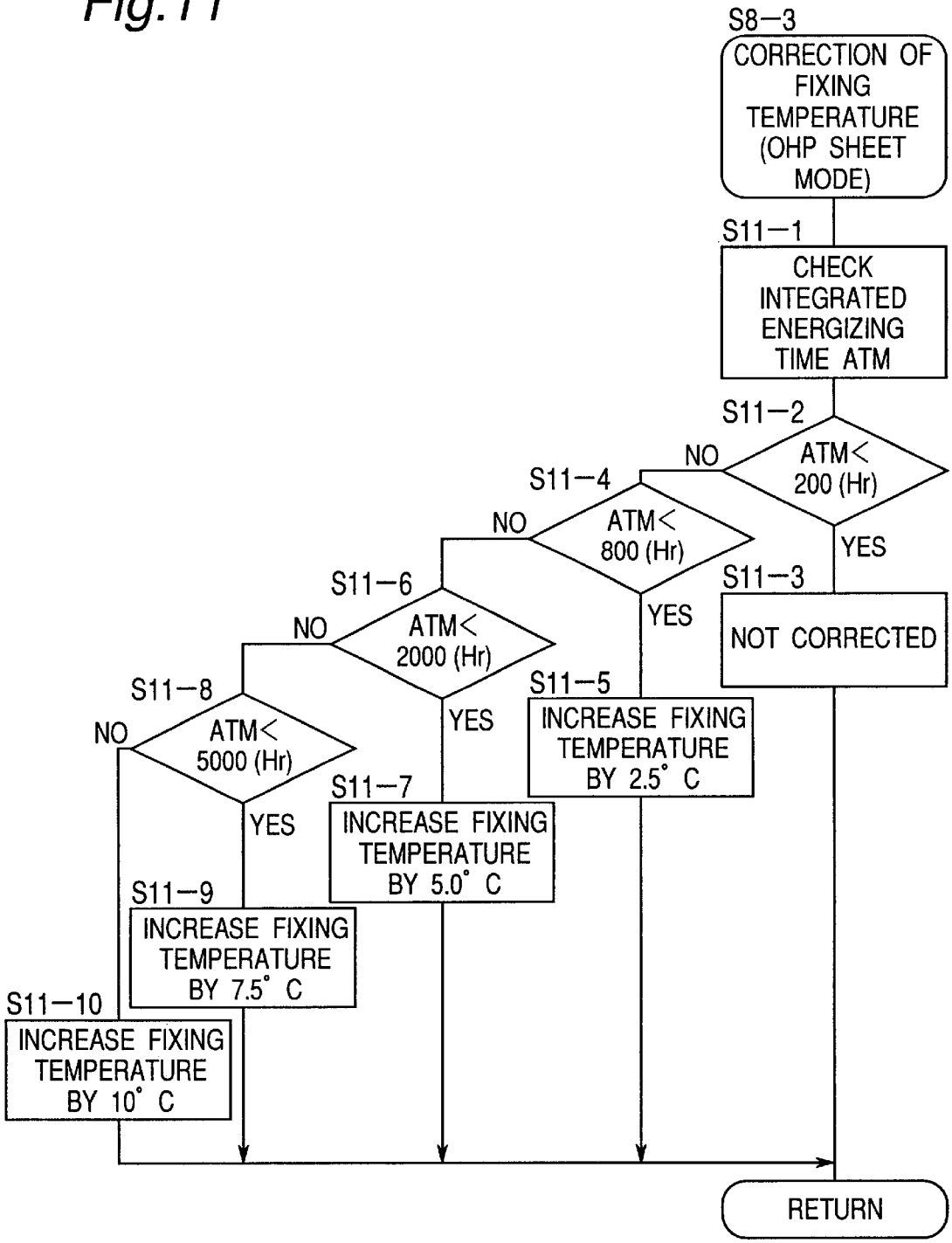
FIG. 11 is a flowchart showing a subroutine of step S8-3 of FIG. 8.

First, the integrated energizing time ATM is checked in step S11-1 of FIG. 11. If it is judged in step S11-2 that the integrated energizing time ATM is shorter than 200 hours, then it is determined in step S11-3 that the fixing temperature is not corrected. If it is judged in step S11-2 that the integrated energizing time ATM is not shorter than 200 hours, then the control is advanced to step S11-4. If it is judged in step S11-4 that the integrated energizing time ATM is shorter than 800 hours, then the fixing temperature is increased by 2.5° C. in step S11-5. If it is judged in step S11-4 that the integrated energizing time ATM is not shorter than 800 hours, then the control is advanced to step S11-6. If it is judged in step S11-6 that the integrated energizing time ATM is shorter than 2,000 hours, then the fixing temperature is increased by 5.0° C. in step S11-7. If it is judged in step S11-6 that the integrated energizing time ATM is not shorter than 2,000 hours, then the control is advanced to step S11-8. If it is judged in step S11-8 that the integrated energizing time ATM is shorter than 5,000 hours, then the fixing temperature is increased by 7.5° C. in step S11-9. If the integrated energizing time ATM is not shorter than 5,000 hours, then the fixing temperature is increased by 10° C. in step S11-10.

As described above, the fixing temperature is corrected in accordance with the integrated energizing time ATM, and the conditions of the correction are changed in different manners according to the kind of the transfer sheet. Thereafter, the fixing operation is performed in step S8-4 of FIG. 8. In the second embodiment, since the heat conductivity of each of the silicone rubber layers 26 is set to a large value or not smaller than $1.2\times10^{-3}$ (cal/cm·sec·° C.) and not larger than $2.4\times10^{-3}$ (cal/cm·sec·° C.) in the same manner as the first embodiment, the efficiency of heat transfer to the surfaces of the silicone rubber layers 26 is excellent. Therefore, the surface temperatures of the silicone rubber layers 26 are prevented from being temporarily decreased during a period when an operation of continuously supplying sheets is started, and the fixing speed can be set to be high.

In the second embodiment, as the integrated energizing time ATM is longer, i.e., as the reduction of the hardness of the silicone rubber layers 26 due to the thermal degradation is further advanced, the fixing temperature is further increased as described above. When the fixing temperature is increased, the quantity of heat supplied from the fixing roller 14 and the pressure roller 15 to the transfer sheet 30 is increased. Therefore, it is possible to compensate for insufficiency of the heat supplied to the transfer sheet 30 which is caused by the reduction of the hardness of the silicone rubber layers 26 due to the thermal degradation, and which inevitably occurs in the case where the silicone rubber layers 26 of the fixing roller 14 and the pressure roller 15 are set to have a high heat conductivity as described above. Consequently, the fixing device of the second embodiment can attain an excellent fixing property in the case of normal paper, and an excellent reproducibility of a transparent color in the case of an OHP sheet.

Figure 9:
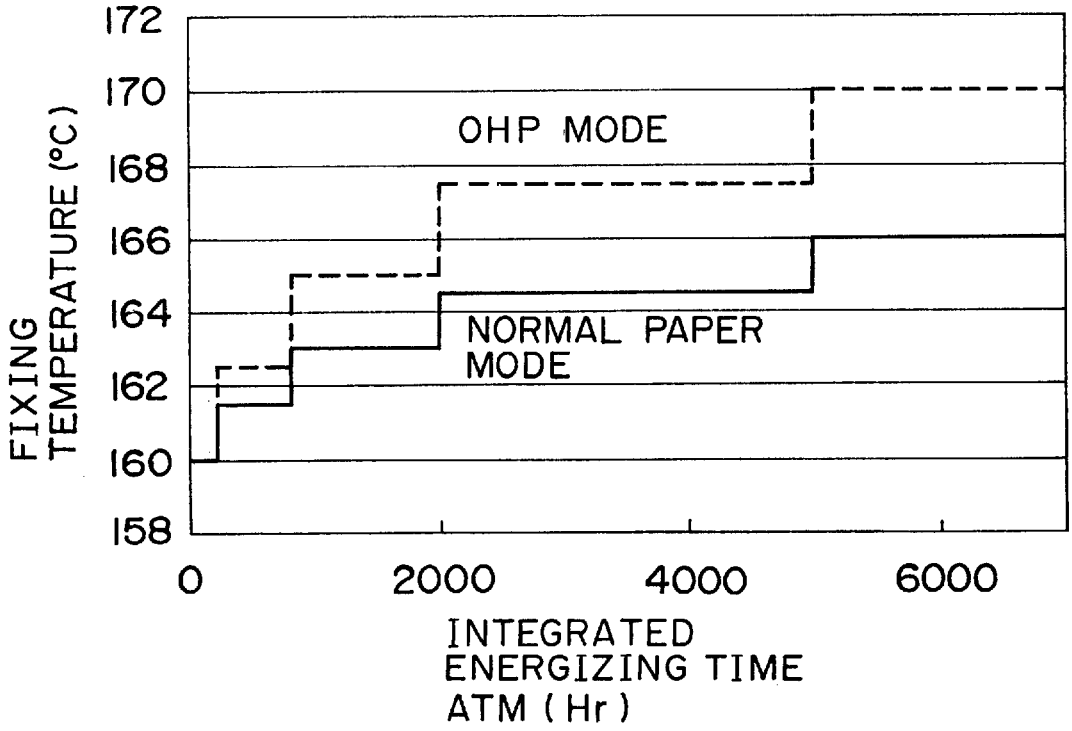
FIG. 9 is a graph showing relationships between the integrated energizing time and a fixing temperature.
Figure 12:
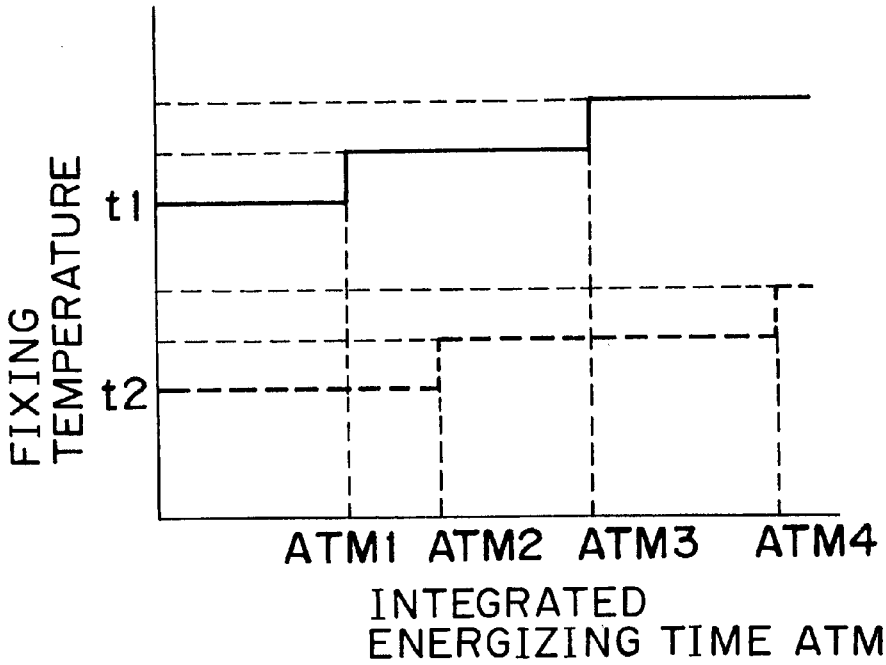
FIG. 12 is a graph showing another example of a fixing temperature correction in the second embodiment.

In the second embodiment, as shown in FIG. 9, the fixing temperature is set to a single value in both the normal paper mode and the OHP sheet mode, and the fixing temperature is increased at constant time intervals. Alternatively, means for switching over the fixing temperature to plural set values may be disposed, and, as shown in FIG. 12, the time interval of the operation of raising the temperature in the case of a higher set value t1 (for example, the time interval from the integrated energizing time ATM1 to the integrated energizing time ATM3 shown in FIG. 12) may be set to be shorter than that of the operation of raising the temperature in the case of a lower set value t2 (for example, the time interval from the integrated energizing time ATM2 to the integrated energizing time ATM4 shown in FIG. 12). As the fixing temperature is higher, the reduction of the hardness of the silicone rubber layers 26 due to the thermal degradation is advanced more rapidly. Therefore, when the fixing temperature is corrected as shown in FIG. 12, the reduction of the fixing property in normal paper and that of reproducibility of a transparent color in an OHP sheet which are caused by thermal degradation can be prevented more surely from occurring.

Figure 13:
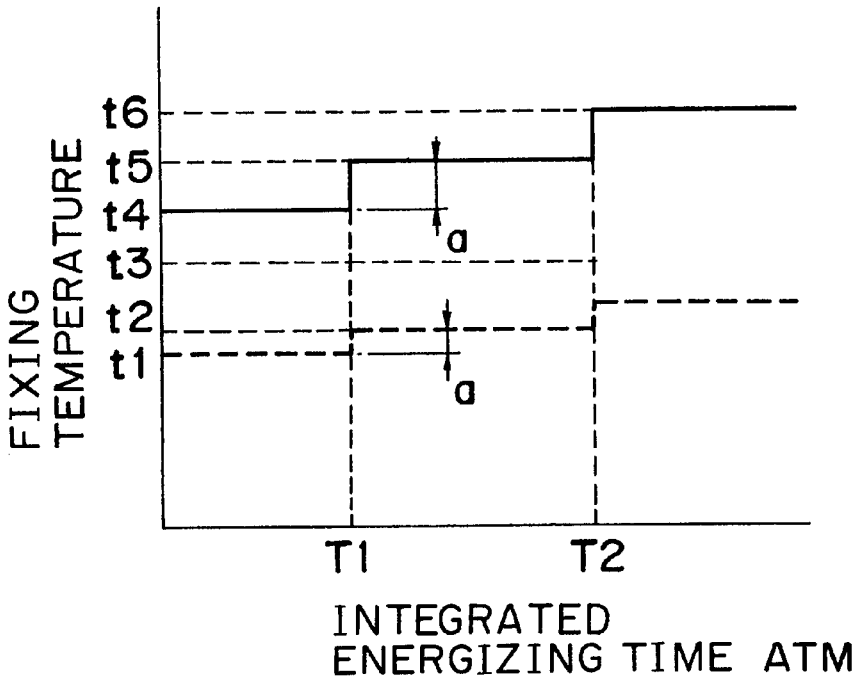
FIG. 13 is a graph showing a further example of the fixing temperature correction in the second embodiment.

Alternatively, as shown in FIG. 13, the step width "a" of the fixing temperature in one operation of correcting the fixing temperature may be set to be larger as the set value of the fixing temperature is higher. As the fixing temperature is higher, the reduction of the hardness of the silicone rubber layers 26 due to the thermal degradation is advanced more rapidly. Therefore, when the fixing temperature is corrected as shown in FIG. 13, insufficiency of heat supplied to the elastic member due to the thermal degradation can be compensated, so that the reduction of the fixing property in normal paper and that of reproducibility of a transparent color in an OHP sheet can be prevented more surely from occurring.

Third Embodiment

A third embodiment of the invention is configured in the same manner as the first embodiment except that the correction of the fixing speed in the normal paper mode in step S5-2 of FIG. 5 and that of the fixing speed in the OHP sheet mode in step S5-3 are performed differently from the first embodiment.

Figure 14:
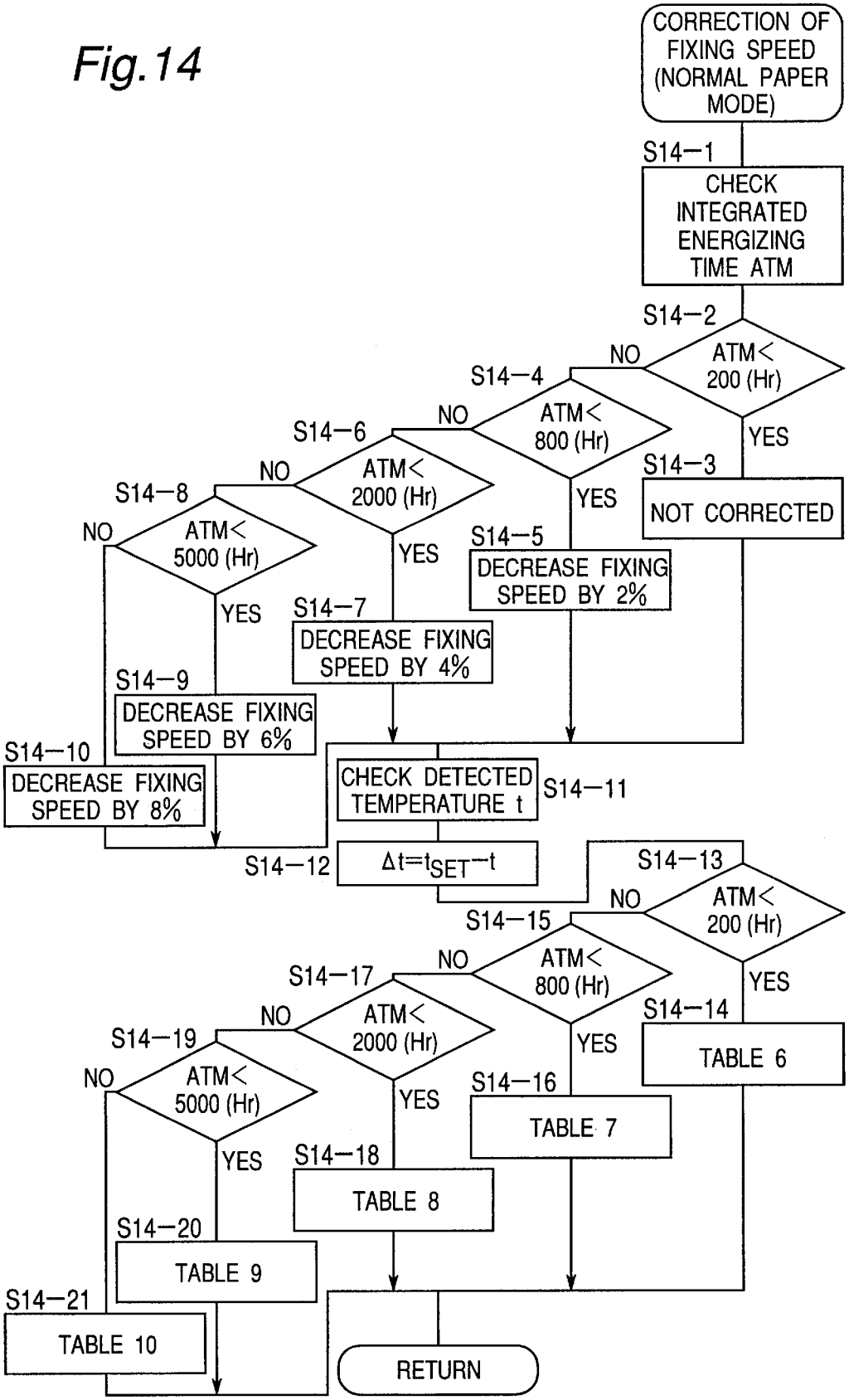
FIG. 14 is a flowchart showing a fixing speed correction in a normal paper mode in a third embodiment.

FIG. 14 shows the correction of fixing speed in the normal paper mode in the third embodiment. Referring to FIG. 14, steps S14-1 to S14-10 are identical with steps S6-1 to S6-10 of the first embodiment shown in FIG. 6. First, the correction amount of the fixing speed is determined on the basis of only the integrated energizing time ATM.

Next, in step S14-11, the controller 35 reads out the detected temperature of the temperature sensor 33. In step S14-12, a difference Δt between the detected temperature t and a set value $t_{SET}$ of the fixing temperature (160° C. in this embodiment) is calculated.

Next, in steps S14-13 to S14-21, the correction amount of the fixing speed is corrected in accordance with the temperature difference Δt.

If it is judged in step S14-13 that the integrated energizing time ATM is shorter than 200 hours, then the fixing speed is further corrected in step S14-14 in accordance with the temperature difference Δt and on the basis of Table 6 listed below.

TABLE 6

| In the case where the integrated energizing time ATM is 0 to 200 hours | | | |
|---|---|---|---|
| Temperature difference Δt(° C.) | 0~−2.5 | −2.5~−5 | Equal to or larger than −5 |
| Correction amount of fixing speed | Not corrected | Fixing speed is decreased by 3.5% | Fixing speed is decreased by 7% |

In step S14-14, if the temperature difference Δt is within the range of 0 to −2.5° C., then the fixing speed is not corrected, and the fixing operation is performed at the fixing speed which has been corrected in steps S14-1 to S14-10. If the temperature difference Δt is within the range of −2.5 to −5° C., then the fixing speed is further decreased by 3.5%, and, if the temperature difference Δt is equal to or higher than −5° C., then the fixing speed is further decreased by 7%.

If it is judged in step S14-13 that the integrated energizing time ATM is not shorter than 200 hours, then the control is advanced to step S14-15. If it is judged in step S14-15 that the integrated energizing time ATM is shorter than 800 hours, then the fixing speed is corrected in step S14-16 in accordance with the temperature difference Δt and on the basis of Table 7 listed below.

TABLE 7

| In the case where the integrated energizing time ATM is 200 to 800 hours | | | |
|---|---|---|---|
| Temperature difference Δt(° C.) | 0~−2.5 | −2.5~−5 | Equal to or larger than −5 |
| Correction amount of fixing speed | Fixing speed is decreased by 2% | Fixing speed is decreased by 5.5% | Fixing speed is decreased by 9% |

In step S14-16, if the temperature difference Δt is within the range of 0 to −2.5° C., then the fixing speed is further decreased by 2%, and, if the temperature difference Δt is within the range of −2.5 to −5° C., then the fixing speed is further decreased by 5.5%, and, if the temperature difference Δt is equal to or larger than −5° C., then the fixing speed is further decreased by 9%.

If it is judged in step S14-15 that the integrated energizing time ATM is not shorter than 800 hours, the control is advanced to step S14-17. If it is judged in step S14-17 that the integrated energizing time ATM is shorter than 2,000 hours, the fixing speed is corrected in step S14-18 in accordance with the temperature difference At and on the basis of Table 8 below.

TABLE 8

| (In the case where the integrated energizing time ATM is 800 to 2000 hours) | | | |
|---|---|---|---|
| Temperature ditference Δt(° C.) | 0~−2.5 | −2.5~−5 | Equal to or larger than −5 |
| Correction amount of fixing speed | Fixing speed is decreased by 4% | Fixing speed is decreased by 7.5% | Fixing speed is decreased by 11% |

In step S14-18, if the temperature difference Δt is within the range of 0 to −2.5° C., then the fixing speed is further decreased by 4%, and, if the temperature difference At is within the range of −2.5 to −5° C., then the fixing speed is further decreased by 7.5%, and, if the temperature difference Δt is equal to or larger than −5° C., the fixing speed is further decreased by 11%.

If it is judged in step S14-17 that the integrated energizing time ATM is not shorter than 2,000 hours, then the control is advanced to step S14-19. If it is judged in step S14-19 that the integrated energizing time ATM is shorter than 5,000 hours, then the fixing speed is corrected in step S14-20 in accordance with the temperature difference Δt and on the basis of Table 9 listed below. By contrast, if it is judged in step S14-19 that the integrated energizing time ATM is not shorter than 5,000 hours, then the fixing speed is corrected in step S14-21 in accordance with the temperature difference Δt and on the basis of Table 10 listed below.

TABLE 9

| In the case where the integrated energizing time ATM is 2000 to 5000 hours | | | |
|---|---|---|---|
| Temperature ditference Δt(° C.) | 0~−2.5 | −2.5~−5 | Equal to or larger than −5 |
| Correction amount of fixing speed | Fixing speed is decreased by 6% | Fixing speed is decreased by 9.5% | Fixing speed is decreased by 13% |

TABLE 10

| In the case where the integrated energizing time ATM is equal to or longer than 5,000 hours | | | |
|---|---|---|---|
| Temperature difference Δt(° C.) | 0~−2.5 | −2.5~−5 | Equal to or larger than −5 |
| Correction amount of fixing speed | Fixing speed is decreased by 8% | Fixing speed is decreased by 11.5% | Fixing speed is decreased by 15% |

In step S14-20, if the temperature difference Δt is within the range of 0 to −2.5° C., then the fixing speed is further decreased by 6%, and, if the temperature difference Δt is within the range of −2.5 to −5° C., then the fixing speed is further decreased by 9.5%, and, if the temperature difference Δt is equal to or larger than −5° C., then the fixing speed is further decreased by 13%.

In step S14-21, if the temperature difference Δt is within the range of 0 to −2.5° C., then the fixing speed is further decreased by 8%, and, if the temperature difference Δt is within the range of −2.5 to −5° C., the fixing speed is further decreased by 11.5%, and, if the temperature difference Δt is equal to or larger than −5° C., the fixing speed is further decreased by 15%.

In the Tables 6 to 10 listed above, the fixing speed is decreased more largely as the temperature difference Δt is larger. As seen from comparison of Tables 6 to 10, the reduction amounts of the fixing speed respectively corresponding to the ranges of the temperature difference Δt of 0 to −2.5° C., −2.5 to −5° C., and not lower than −5° C. are larger as the integrated energizing time ATM is longer. As the temperature difference Δt between the set value of the fixing temperature and the detected temperature t of the temperature sensor 33 is larger, the actual surface temperatures of the silicone rubber layers 26 are higher and the reduction of elasticity due to the thermal degradation is further advanced. Therefore, when the fixing speed is decreased in accordance with the degree of the temperature difference Δt as described above, the reduction of the fixing property caused by the thermal degradation of the silicone rubber layers 26 can be prevented more surely from occurring. In the third embodiment, since the reduction amounts of the fixing speed respectively corresponding to the ranges of the temperature difference Δt are made different in accordance with the integrated energizing time ATM, the reduction of the fixing property can be prevented more surely from occurring.

Figure 15:
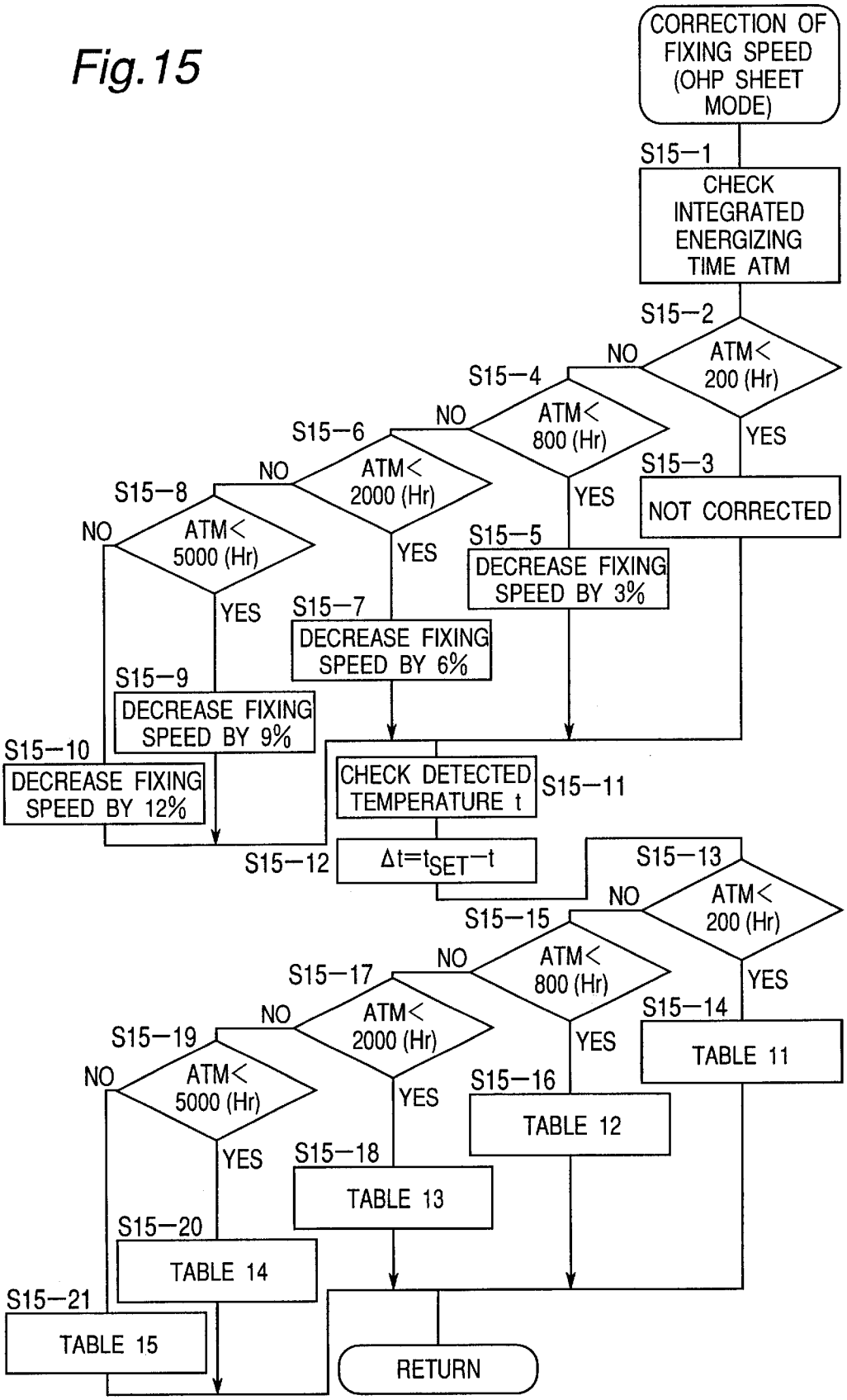
FIG. 15 is a flowchart showing a fixing speed correction in an OHP sheet mode in the third embodiment.

FIG. 15 shows the correction of fixing speed in the OHP sheet mode in the third embodiment. Referring to FIG. 15, steps S15-1 to S15-10 are identical with steps S7-1 to S7-10 of the first embodiment shown in FIG. 7. First, the correction amount of the fixing speed is determined on the basis of only the integrated energizing time ATM.

Next, in step S15-11, the controller 35 reads out the detected temperature t of the temperature sensor 33. In step S15-12, the temperature difference Δt is calculated.

Next, in steps S15-13 to S15-21, the correction amounts of the fixing speed and the fixing temperature are corrected in accordance with the temperature difference Δt.

If it is judged in step S15-13 that the integrated energizing time ATM is shorter than 200 hours, then the fixing speed is corrected in step S15-14 in accordance with the temperature difference Δt and on the basis of Table 11 listed below.

TABLE 11

| In the case where the integrated energizing time ATM is 0 to 200 hours | | | |
|---|---|---|---|
| Temperature difference Δt(° C.) | 0~−2.5 | −2.5~−5 | Equal to or larger than −5 |
| Correction amount of fixing speed | Not Corrected | Fixing speed is decreased by 5% | Fixing speed is decreased by 10% |

In step S15-14, if the temperature difference Δt is within the range of 0 to −2.5° C., then the fixing speed is not corrected, and the fixing operation is performed at the fixing speed which has been corrected in steps S15-1 to S15-10. If the temperature difference Δt is within the range of −2.5 to −5° C., the fixing speed is further decreased by 5%, and, if the temperature difference Δt is equal to or larger than −5° C., then the fixing speed is further decreased by 10%.

If it is judged in step S15-13 that the integrated energizing time ATM is not shorter than 200 hours, then the control is advanced to step S15-15. If it is judged in step S15-15 that the integrated energizing time ATM is shorter than 800 hours, then the fixing speed and the fixing temperature are corrected in step S15-16 in accordance with the temperature difference Δt and on the basis of Table 12 listed below.

TABLE 12

| In the case where the integrated energizing time ATM is 200 to 800 hours | | | |
|---|---|---|---|
| Temperature difference Δt(° C.) | 0~−2.5 | −2.5~−5 | Equal to or larger than −5 |
| Correction amount of fixing temperature | Fixing temperature is increased by 2.5° C. | Fixing temperature is increased by 2.5° C. | Fixing temperature is increased by 2.5° C. |
| Correction amount of fixing speed | | Fixing speed is decreased by 5.5% | Fixing speed is decreased by 10% |

In step S15-16, if the temperature difference Δt is within the range of 0 to −2.5° C., then the fixing temperature is increased by 2.5° C., and, if the temperature difference Δt is within the range of −2.5 to −5° C., then the fixing temperature is increased by 2.5° C. and the fixing speed is decreased by 5.5%, and, if the temperature difference Δt is equal to or larger than −5° C., the fixing temperature is increased by 2.5° C. and the fixing speed is decreased by 10%.

If it is judged in step S15-15 that the integrated energizing time ATM is not shorter than 800 hours, then the control is advanced to step S15-17. If it is judged in step S15-17 that the integrated energizing time ATM is shorter than 2,000 hours, then the fixing speed and the fixing temperature are corrected in step S15-18 in accordance with the temperature difference Δt and on the basis of Table 13 listed below.

TABLE 13

| In the case where the integrated energizing time ATM is 800 to 2000 hours | | | |
|---|---|---|---|
| Temperature difference Δt(° C.) | 0~−2.5 | −2.5~−5 | Equal to or larger than −5 |
| Correction amount of fixing temperature | Fixing temperature is increased by 5.0° C. | Fixing temperature is increased by 5.0° C. | Fixing temperature is increased by 5.0° C. |
| Correction amount of fixing speed | | Fixing speed is decreased by 5% | Fixing speed is decreased by 10% |

In step S15-18, if the temperature difference Δt is within the range of 0 to −2.5° C., the fixing temperature is increased by 5.0° C., and, if the temperature difference Δt is within the range of −2.5 to −5° C., then the fixing temperature is increased by 5.0° C. and the fixing speed is decreased by 5%, and, if the temperature difference Δt is equal to or larger than −5° C., then the fixing temperature is increased by 5.0° C. and the fixing speed is decreased by 10%.

If it is judged in step S15-17 that the integrated energizing time ATM is not shorter than 2,000 hours, then the control is advanced to step S15-19. If it is judged in step S15-19 that the integrated energizing time ATM is shorter than 5,000 hours, then the fixing speed and the fixing temperature are corrected in step S15-20 in accordance with the temperature difference Δt and on the basis of Table 14 listed below. By contrast, if it is judged in step S15-19 that the integrated energizing time ATM is not shorter than 5,000 hours, then the fixing speed and the fixing temperature are corrected in step S15-21 in accordance with the temperature difference Δt and on the basis of Table 15 listed below.

TABLE 14

| In the case where the integrated energizing time ATM is 2000 to 5000 hours | | | |
|---|---|---|---|
| Temperature difference Δt(° C.) | 0~−2.5 | −2.5~−5 | Equal to or larger than −5 |
| Correction amount of fixing temperature | Fixing temperature is increased by 7.5° C. | Fixing temperature is increased by 7.5° C. | Fixing temperature is increased by 7.5° C. |
| Correction amount of fixing speed | | Fixing speed is decreased by 5% | Fixing speed is decreased by 10% |

TABLE 15

| In the case where the integrated energizing time ATM is equal to or longer than 5,000 hours | | | |
|---|---|---|---|
| Temperature difference Δt(° C.) | 0~−2.5 | −2.5~−5 | Equal to or larger than −5 |
| Correction amount of fixing temperature | Fixing temperature is increased by 10.0° C. | Fixing temperature is increased by 10.0° C. | Fixing temperature is increased by 10.0° C. |
| Correction amount of fixing speed | | Fixing speed is decreased by 5% | Fixing speed is decreased by 10% |

In step S15-20, if the temperature difference Δt is within the range of 0 to −2.5° C., then the fixing temperature is increased by 7.5° C., and, if the temperature difference Δt is within the range of −2.5 to −5° C., then the fixing temperature is increased by 7.5° C. and the fixing speed is decreased by 5%, and, if the temperature difference Δt is equal to or larger than −5° C., then the fixing temperature is increased by 7.5° C. and the fixing speed is decreased by 10%.

In step S15-21, if the temperature difference Δt is within the range of 0 to −2.5° C., then the fixing temperature is increased by 10.0° C., and, if the temperature difference Δt is within the range of −2.5 to −5° C., then the fixing temperature is increased by 10.0° C. and the fixing speed is decreased by 5%, and, if the temperature difference Δt is equal to or larger than −5° C., then the fixing temperature is increased by 10.0° C. and the fixing speed is decreased by 10%.

In the Tables 11 to 15 above, the fixing speed is decreased more largely as the temperature difference Δt is larger. As seen from comparison of Tables 11 to 15, the reduction amounts of the fixing speed respectively corresponding to the ranges of the temperature difference Δt of 0 to −2.5° C., −2.5 to −5° C., and not lower than −5° C. are larger and the increased amounts of the fixing temperature are larger as the integrated energizing time ATM is longer. As the temperature difference Δt between the set value of the fixing temperature and the detected fixing temperature is larger, the temperatures of the silicone rubber layers 26 are higher and the reduction of elasticity due to the thermal degradation is further advanced. Therefore, when the fixing speed is decreased in accordance with the degree of the temperature difference Δt as described above, the reduction of the fixing property and that of the reproducibility of a transparent color which are caused by the thermal degradation of the silicone rubber layers 26 can be prevented more surely from occurring. Since the reduction amounts of the fixing speed and the increased amounts of the fixing temperature respectively corresponding to the ranges of the temperature difference Δt are made different in accordance with the integrated energizing time ATM, the reduction of the fixing property and that of the reproducibility of a transparent color can be prevented more surely from occurring.

Fourth Embodiment

A fourth embodiment of the invention is configured in the same manner as the second embodiment except that the correction of the fixing temperature in the normal paper mode in step S8-2 of FIG. 8 and that of the fixing temperature in the OHP sheet mode in step S8-3 are performed differently from the second embodiment.

Figure 16:
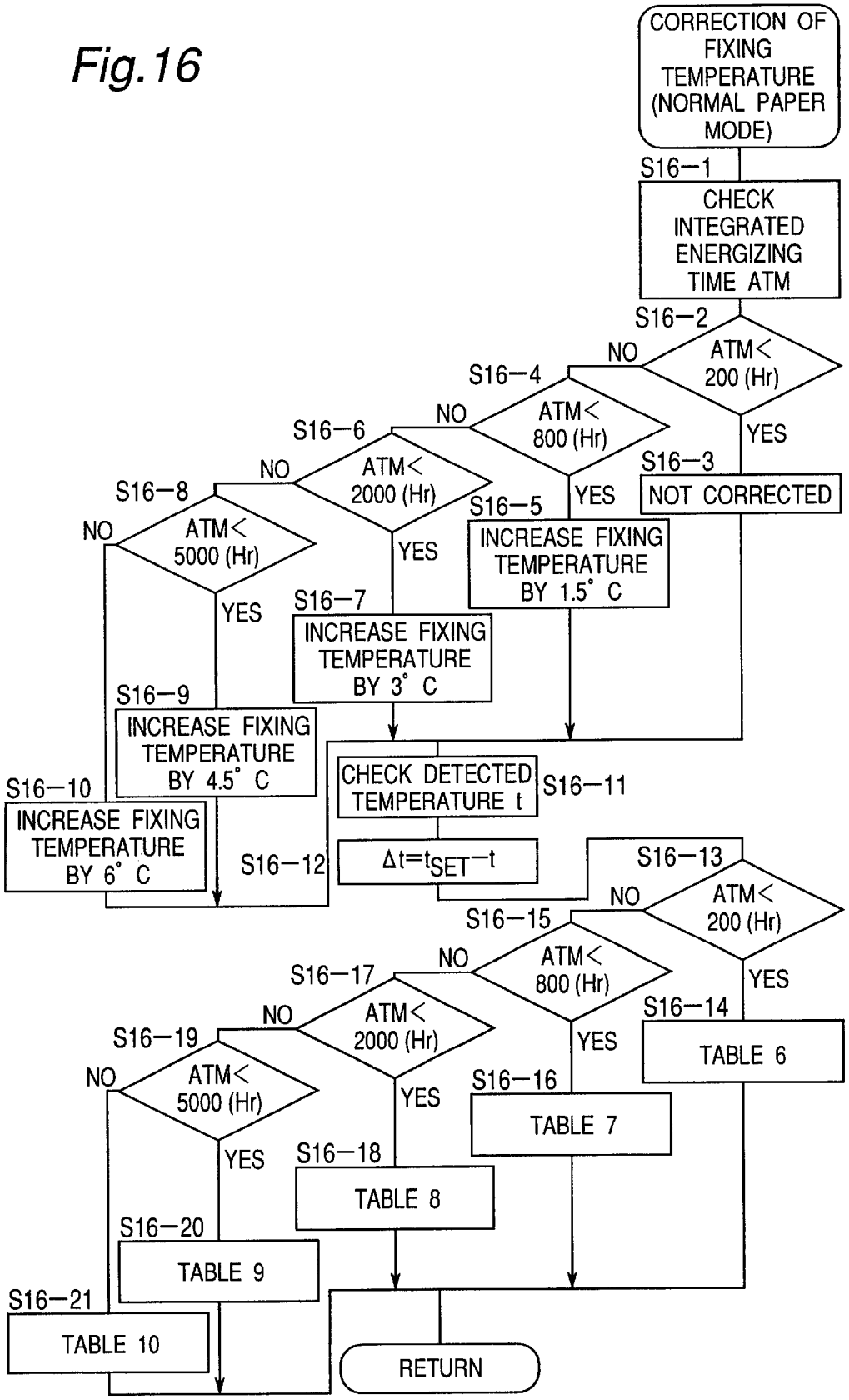
FIG. 16 is a flowchart showing a fixing temperature correction in a normal paper mode in a fourth embodiment.

FIG. 16 shows the fixing temperature correction in the normal paper mode in the fourth embodiment. Referring to FIG. 16, steps S16-1 to S16-10 are identical with steps S10-1 to S10-10 of the second embodiment shown in FIG. 10. First, the correction amount of the fixing temperature is determined on the basis of only the integrated energizing time ATM.

Next, in step S16-11, the controller 35 reads out the detected temperature t of the temperature sensor 33. In step S16-12, the difference Δt between the detected temperature t and a set value $t_{SET}$ of the fixing temperature is calculated.

Next, in steps S16-13 to S16-21, the correction amount of the fixing speed is corrected in accordance with the temperature difference Δt.

If it is judged in step S16-13 that the integrated energizing time ATM is shorter than 200 hours, then the fixing speed is corrected in step S16-14 in accordance with the temperature difference Δt and on the basis of Table 6 listed above.

If it is judged in step S16-13 that the integrated energizing time ATM is not shorter than 200 hours, then the control is advanced to step S16-15. If it is judged in step S16-15 that the integrated energizing time ATM is shorter than 800 hours, then the fixing speed is corrected in step S16-16 in accordance with the temperature difference Δt and on the basis of Table 7 listed above.

If it is judged in step S16-15 that the integrated energizing time ATM is not shorter than 800 hours, then the control is advanced to step S16-17. If it is judged in step S16-17 that the integrated energizing time ATM is shorter than 2,000 hours, then the fixing speed is corrected in step S16-18 in accordance with the temperature difference Δt and on the basis of Table 8 listed above.

If it is judged in step S16-17 that the integrated energizing time ATM is not shorter than 2,000 hours, then the control is advanced to step S16-19. If it is judged in step S16-19 that the integrated energizing time ATM is shorter than 5,000 hours, then the fixing speed is corrected in step S16-20 in accordance with the temperature difference Δt and on the basis of Table 9 listed above. If it is judged in step S16-19 that the integrated energizing time ATM is not shorter than 5,000 hours, then the fixing speed is corrected in step S16-21 in accordance with the temperature difference Δt and on the basis of Table 10 listed above.

When the fixing temperature is corrected in accordance with the integrated energizing time ATM and the fixing speed is corrected in accordance with the temperature difference Δt as described above, the effect of reduction of the hardness of the silicone rubber layers 26 due to the thermal degradation can be reduced more surely, and hence it is possible to obtain a more excellent fixing property.

Figure 17:
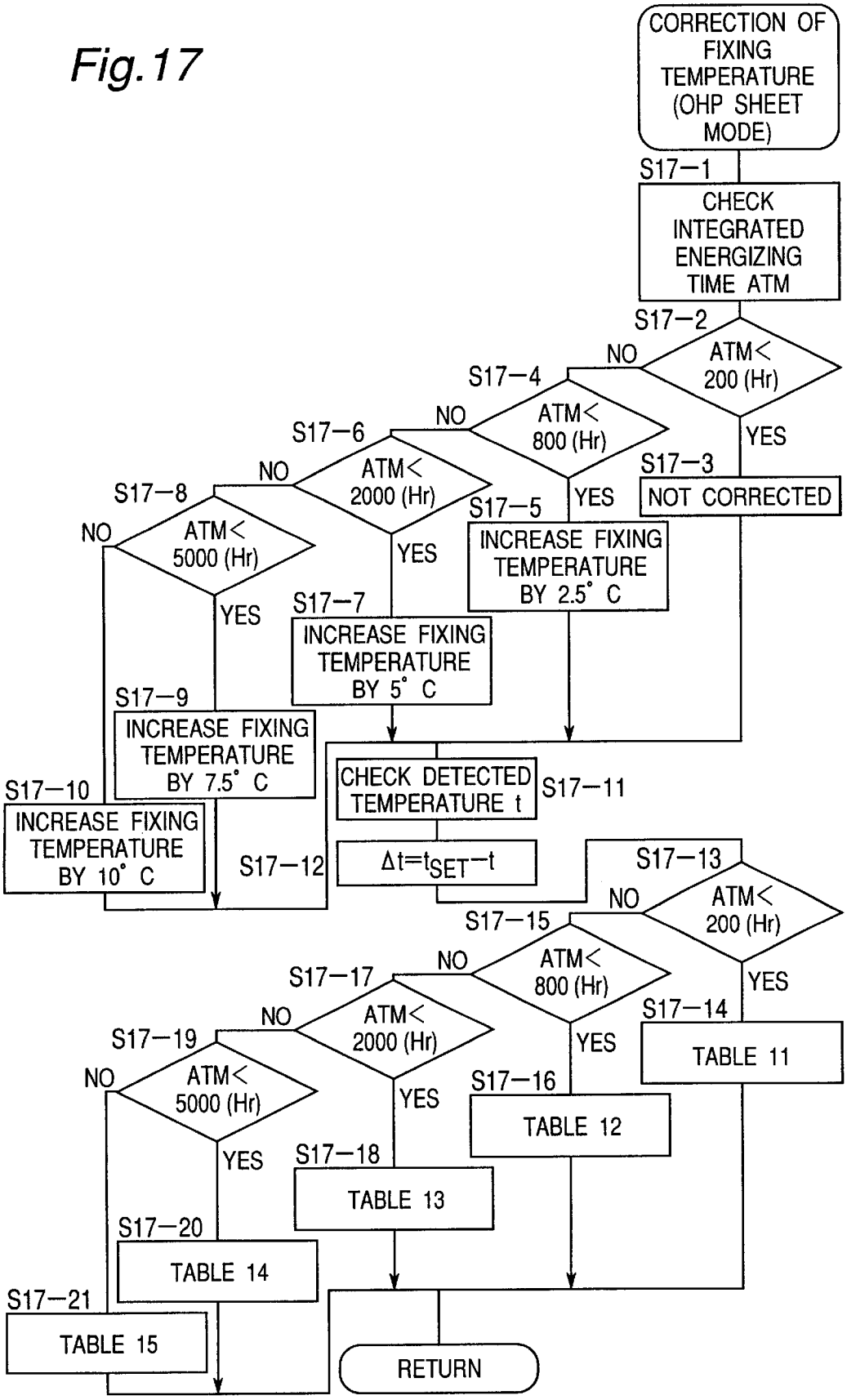
FIG. 17 is a flowchart showing a fixing temperature correction in an OHP sheet mode in the fourth embodiment.

FIG. 17 shows the correction of fixing temperature in the OHP sheet mode in the fourth embodiment. Referring to FIG. 17, steps S17-1 to S17-10 are identical with steps S11-1 to S11-10 of the second embodiment shown in FIG. 11. First, the correction amount of the fixing temperature is determined on the basis of only the integrated energizing time ATM.

Next, in step S17-11, the controller 35 reads out the detected temperature t of the temperature sensor 33. In step S17-12, the temperature difference Δt is calculated.

Next, in steps S17-13 to S17-21, the fixing speed and the fixing temperature are corrected in accordance with the temperature difference Δt.

If it is judged in step S17-13 that the integrated energizing time ATM is shorter than 200 hours, then the fixing speed is corrected in step S17-14 in accordance with the temperature difference Δt and on the basis of Table 11 listed above.

If it is judged in step S17-13 that the integrated energizing time ATM is not shorter than 200 hours, then the control is advanced to step S17-15. If it is judged in step S17-15 that the integrated energizing time ATM is shorter than 800 hours, then the fixing speed and the fixing temperature are corrected in step S17-16 in accordance with the temperature difference Δt and on the basis of Table 12 listed above.

If it is judged in step S17-15 that the integrated energizing time ATM is not shorter than 800 hours, then the control is advanced to step S17-17. If it is judged in step S17-17 that the integrated energizing time ATM is shorter than 2,000 hours, then the fixing speed and the fixing temperature are corrected in step S17-18 in accordance with the temperature difference Δt and on the basis of Table 13 listed above.

If it is judged in step S17-17 that the integrated energizing time ATM is not shorter than 2,000 hours, then the control is advanced to step S17-19. If it is judged in step S17-19 that the integrated energizing time ATM is shorter than 5,000 hours, then the fixing speed and the fixing temperature are corrected in step S17-20 in accordance with the temperature difference Δt and on the basis of Table 14 listed above. If it is judged in step S17-19 that the integrated energizing time ATM is not shorter than 5,000 hours, then the fixing speed and the fixing temperature are corrected in accordance with the temperature difference Δt and on the basis of Table 15 listed above.

When the fixing temperature is corrected in accordance with the integrated energizing time ATM, and the fixing speed and the fixing temperature are corrected in accordance with the temperature difference Δt as described above, the effect of reduction of the hardness of the silicone rubber layers 26 due to the thermal degradation can be reduced more surely, and hence it is possible to obtain a more excellent reproducibility of a transparent color.

Figure 18:
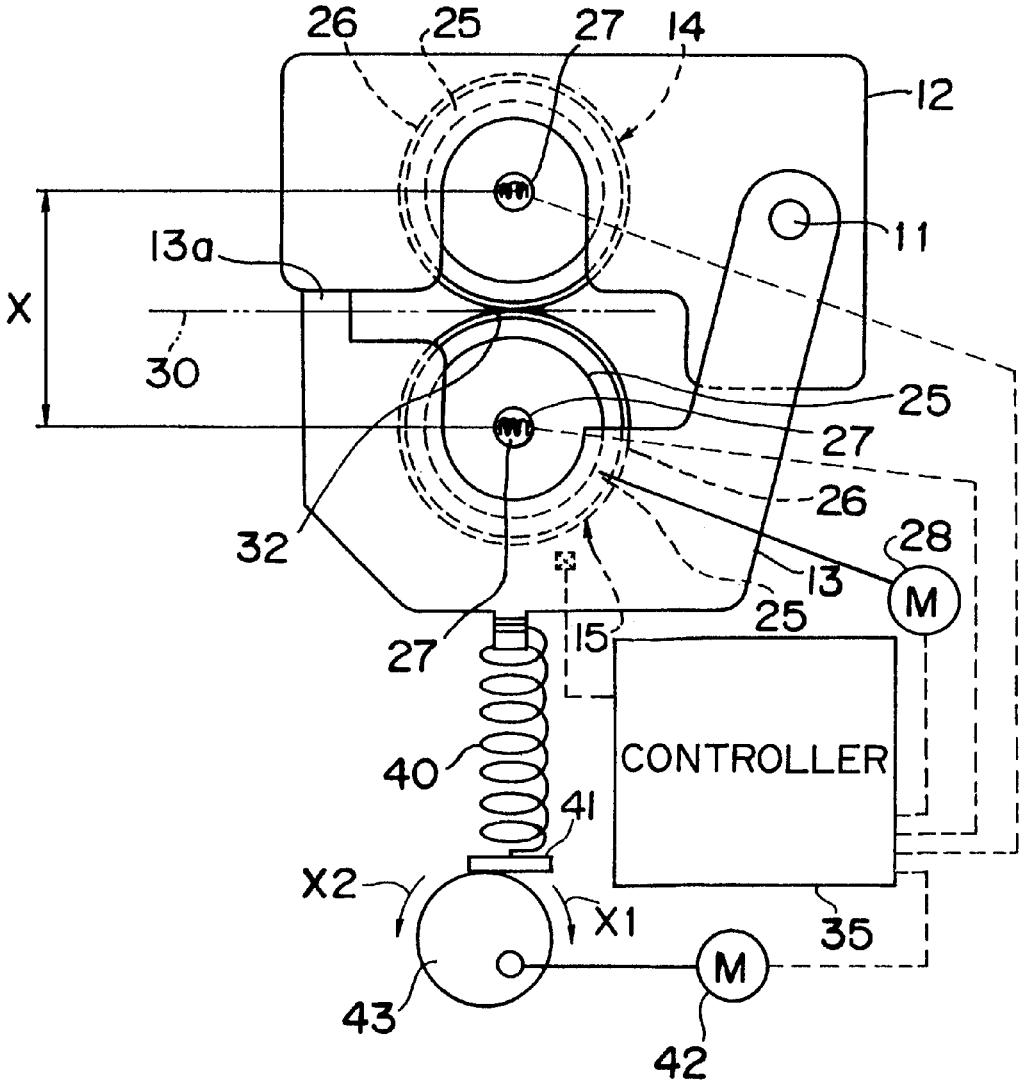
FIG. 18 is a diagram schematically showing an abutting state of a fixing device of a fifth embodiment.
Figure 19:
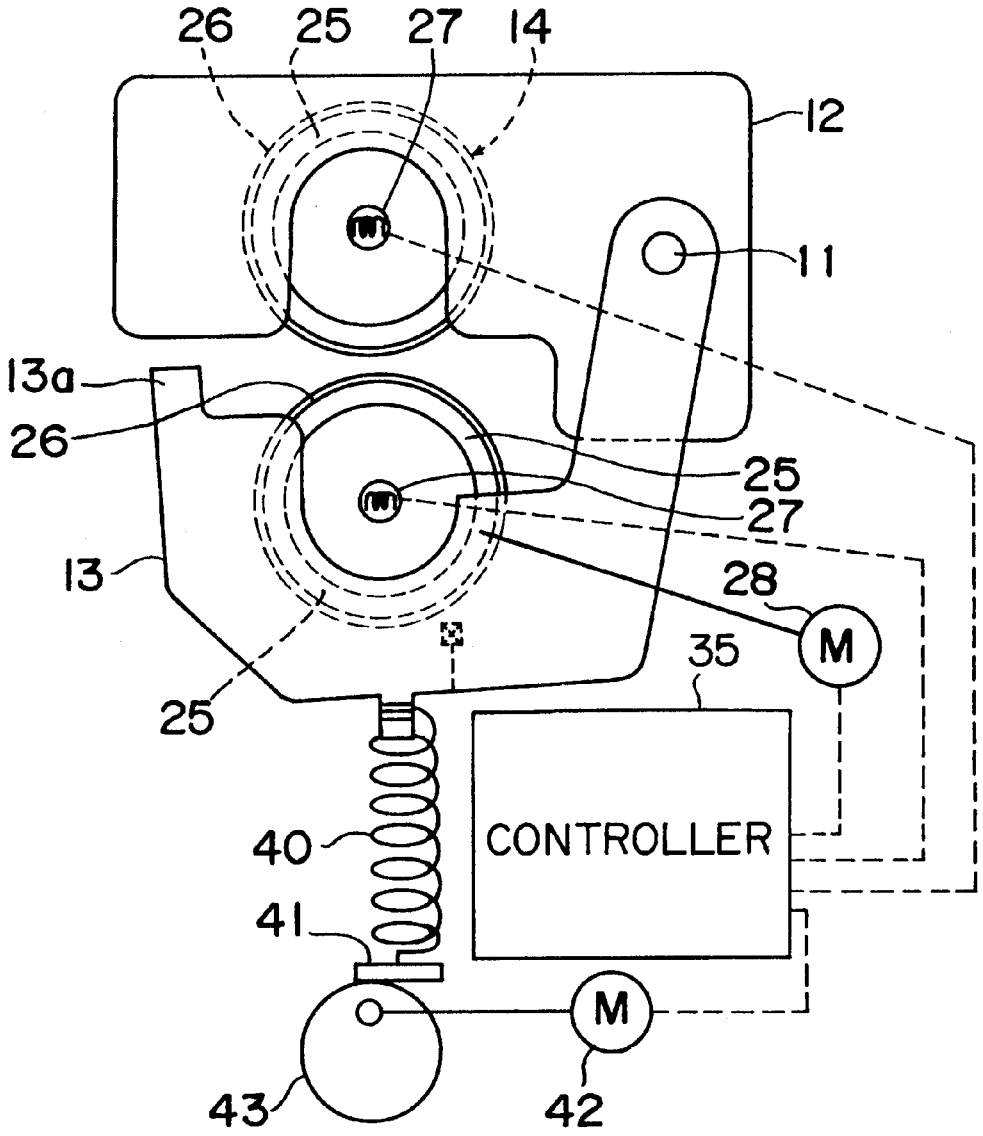
FIG. 19 is a diagram schematically showing a separating state of the fixing device of the fifth embodiment.

Fifth Embodiment FIGS. 18 and 19 show a fifth embodiment of the invention.

A spring 40 is coupled at the upper end in the figures to a lower portion of the lower frame 13. A cam plate 41 is fixed to the lower end of the spring 40 in the figures. The cam plate 41 abuts against an eccentric cam 43 which is rotated by a motor 42. An upward projection 13*a* is disposed on an upper end portion of the lower frame 13.

In FIGS. 18 and 19, the components disposed in the upper frame 12, such as the cleaning roller 19 and the oil applying mechanism 20, and those disposed in the lower frame 13, such as the pre-fixing guide 22, the oil scraping blade 23, and the separator 24 are not shown.

The spring 40 urges the lower frame 13 against the upper frame 12. In the pressing state shown in FIG. 18, the projection 13*a* abuts a lower portion of the upper frame 12, whereby the axis-to-axis distance X is maintained constant. As a result, also the width of the nip portion 32 is maintained constant.

In the case where, in the pressing state shown in FIG. 18, plural overlapping transfer sheets 30 are supplied to the nip portion 32, or the case where a foreign substance is supplied together with the transfer sheet 30 to the nip portion 32, the force which acts on the nip portion 32 so as to separate the fixing roller 14 and the pressure roller 15 from each other becomes greater than the abutting force exerted by the spring 40. Then, the lower frame 13 is rotated in a counter-clockwise direction in the figures, so that the fixing roller 14 and the pressure roller 15 are separated from each other.

When the rotation angle of the eccentric cam 43 is finely adjusted in the pressing state shown in FIG. 18, it is possible to control the force which is exerted by the spring 40 to press the lower frame 13 against the upper frame 12 so that the fixing roller 14 and the pressure roller 15 are abutted with each other. For example, when the eccentric cam 43 in the rotation angle position shown in FIG. 18 is rotated in the direction of the arrow X1, the force exerted by the spring 40 to abut the fixing roller 14 and the pressure roller 15 against each other is increased. When the eccentric cam 43 is rotated in the direction of the arrow X2, the force exerted by the spring 40 to abut the fixing roller 14 and the pressure roller 15 against each other is decreased.

On the other hand, when the rotation angle position of the eccentric cam 43 is set to the position shown in FIG. 19, a separating state in which the fixing roller 14 and the pressure roller 15 are separated from each other is attained.

Next, the operation of the fifth embodiment will be described. In the same manner as the first to fourth embodiments, the controller 35 implements the operations shown in the flowchart of FIG. 4 to calculate the integrated energizing time ATM.

Figure 20:
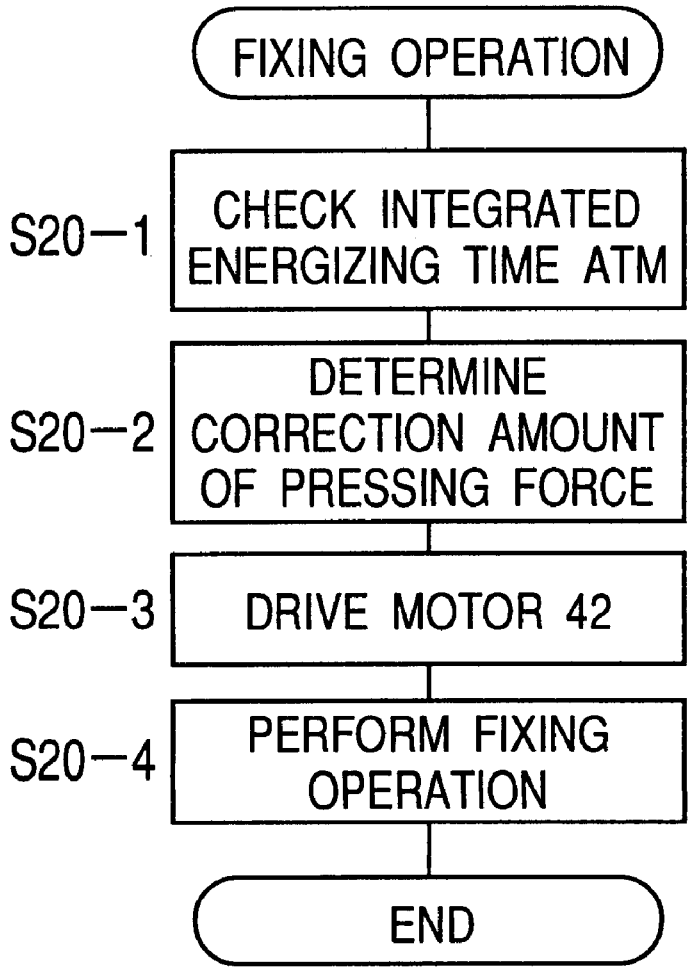
FIG. 20 is a flowchart illustrating the operation of the fifth embodiment.

In accordance with the integrated energizing time ATM, the controller 35 adjusts the force of urging the lower frame 13 against the upper frame 12. First, the controller 35 checks the integrated energizing time ATM in step S20-1 of FIG. 20.

In step S20-2, the correction amount of the pressing force is determined in accordance with the integrated energizing time ATM. As the integrated energizing time ATM is longer, the reduction of the hardness of the silicone rubber layers 26 due to the thermal degradation is further advanced. When the hardness of the silicone rubber layer 26 is reduced, the strength of the silicone rubber layers 26 against a stress produced in the nip portion 32 between the fixing roller 14 and the pressure roller 15 is decreased.

In the case where the pressing force of the spring 40 is greater as compared with the stress of the nip portion 32, when plural overlapping transfer sheets 30 are supplied to the nip portion 32 or a foreign substance is supplied together with the transfer sheet 30 to the nip portion 32, an excessive load is applied to the fixing roller 14 and the pressure roller 15 and between the upper frame 12 and the lower frame 13, thereby producing a fear that these components are broken. By contrast, in the case where the pressing force of the spring 40 is smaller as compared with the stress of the nip portion 32, there arises a fear that a failure occurs in the operation of supplying the transfer sheet 30.

In order to prevent the pressing force from being made greater as compared with the stress of the nip portion 32 which is reduced by the hardness reduction due to the thermal degradation, a correction amount is determined in step S20-2 so that the pressing force of the spring 40 is further reduced as the integrated energizing time ATM is longer as shown in Table 16 listed below. The correction amount is set so that the pressing force is not excessively smaller with respect to the stress of the nip portion 32.

TABLE 16

Correction of fixing pressure

| Integrated energizing time ATM (Hr) | Correction of fixing pressure |
|---|---|
| 0~200 | Not corrected |
| 200~800 | Fixing pressure is decreased by 6% |
| 800~2000 | Fixing pressure is decreased by 12% |
| 2000~5000 | Fixing pressure is decreased by 18% |
| 5000~ | Fixing pressure is decreased by 24% |

In step S20-3, the controller 35 drives the motor 42 to adjust the rotation angle position of the eccentric cam 43 so that the pressing force of the spring 40 is reduced by the above correction amount. Thereafter, the fixing operation is performed in step S20-4.

In the fixing device of the fifth embodiment, as described above, the pressing force exerted by the spring 40 is reduced in accordance with the reduction of the hardness of the silicone rubber layers 26 of the fixing roller 14 and the pressure roller 15 which is due to thermal degradation. Therefore, even when the hardness of the silicone rubber layers 26 is reduced as a result of thermal degradation, the balance between the stress of the nip portion 32 between the fixing roller 14 and the pressure roller 15, and the pressing force of the spring 40 is maintained. Consequently, in the case where a foreign substance or the like is supplied, the fixing roller 14 and the pressure roller 15 are surely separated from each other, thereby preventing the fixing roller 14 and the pressure roller 15 from being broken. Furthermore, a failure in the sheet supplying operation due to an insufficient pressing force of the spring 40 is prevented from occurring.

In the fixing device of the fifth embodiment, in the same manner as the first to fourth embodiments, the fixing temperature and the fixing speed may be corrected in accordance with the integrated energizing time ATM and the temperature difference Δt.

Figure 21:
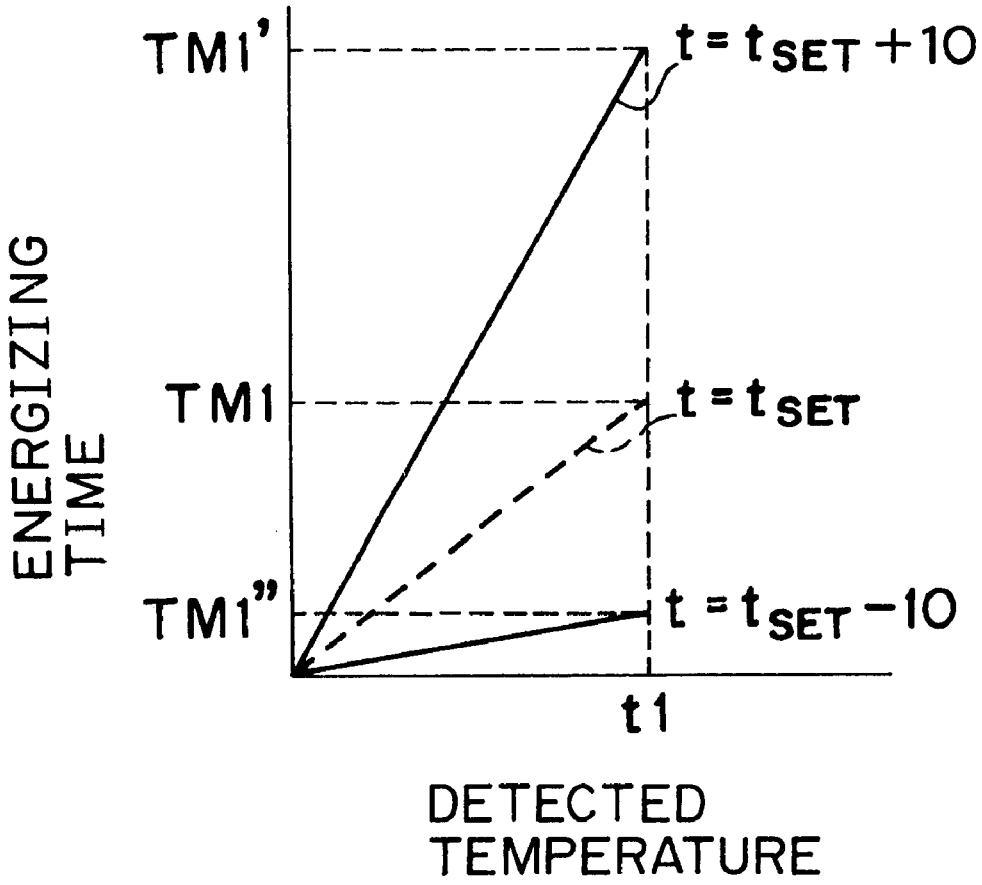
FIG. 21 is a graph illustrating correction of an integrated energizing time.

The first to fifth embodiments may be configured in the following manner. As shown in FIG. 21, when the detected value t of the fixing temperature is equal to the set temperature, the time measured by the timer (see steps S4-1 to S4-10 of FIG. 4) is integrated as it is as an energizing time TM1. When the detected value t of the fixing temperature is higher than the set temperature by 10° C. or more, a value which is obtained by multiplying the time measured by the timer with a factor that is larger than 1 is set as an energizing time TM1'. When the detected value t of the fixing temperature is lower than the set temperature, a value which is obtained by multiplying the time measured by the timer with a predetermined factor of 0 to less than 1 is set as an energizing time TM1".

As the actual fixing temperature is higher, the reduction of the hardness of the silicone rubber layers 26 due to the thermal degradation is further advanced. Therefore, when the time measured by the timer is corrected in accordance with the detected temperature t as described above, it is possible to estimate more accurately the reduction of the hardness of the silicone rubber layers 26 due to thermal degradation.

Sixth Embodiment

Figure 22:
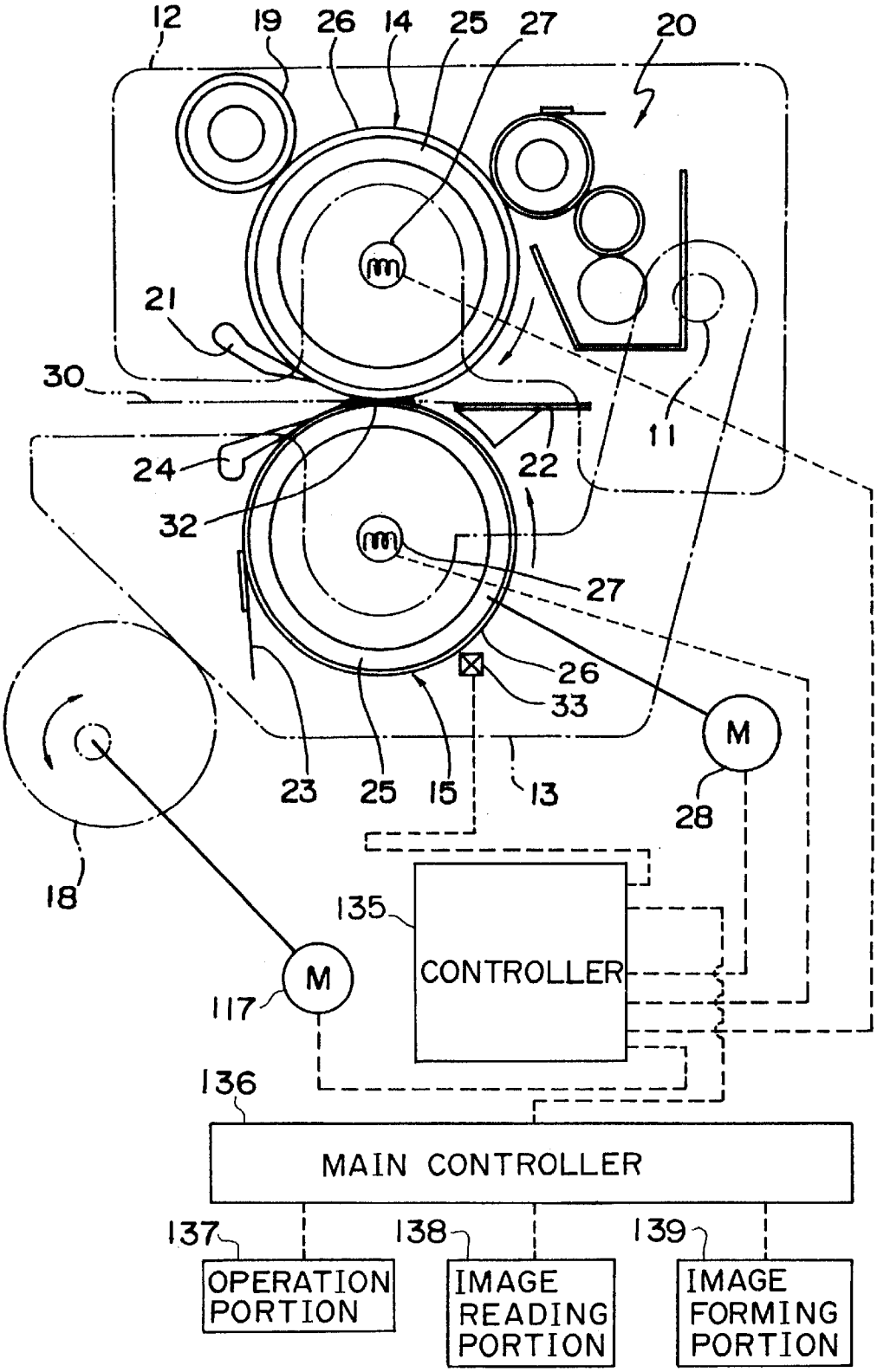
FIG. 22 is a diagram schematically showing a fixing device which is a sixth embodiment of the invention.

FIG. 22 shows a fixing device of a sixth embodiment of the invention. The fixing device of the sixth embodiment is identical with the first embodiment except a controller 135. Hence like components are denoted by the same reference numerals, and the description is omitted.

The motors 117 and 28, the heater 27, and the temperature sensor 33 are connected to the controller 135 of the fixing device. A main controller 136, an operation portion 137, an image reading portion 138, and an image forming portion 139 of the main unit of a copying machine are connected to the controller 135. The copy mode which will be described later can be manually set through the operation portion 137. Image information of an original which is read by the image reading portion 138 is sent to the image forming portion 139 via the main controller 136.

In the image forming portion 139, an electrostatic latent image is formed on an image bearing body (not shown) on the basis of the image information. The electrostatic latent image is developed by a developer, and then transferred onto the transfer sheet 30. Thereafter, the transfer sheet 30 onto which the developer image has been transferred is supplied to the fixing device.

In the same manner as the first embodiment, the content of a high thermal conductive filler in the silicone rubber layers 26 of the fixing roller 14 and the pressure roller 15 is increased so that the heat conductivity is set to a large value or not smaller than $1.2\times10^{-3}$ (cal/cm·sec·° C.) and not larger than $2.4\times10^{-3}$ (cal/cm·sec·° C.) as described above. As shown in FIG. 3. therefore, the hardness of each roller is reduced as the integrated value of the energizing time (integrated energizing time) of the heaters 27 is increased. In accordance with this reduction, as shown in Table 1 listed above, the abutting force acting on the nip portion 32 is decreased.

The reduced abutting force causes reduction of the fixing property in the case where the transfer sheet 30 is normal paper, and that of the reproducibility of a transparent color in the case where the transfer sheet 30 is an OHP sheet. The reduction of the fixing property and that of the reproducibility of a transparent color are caused by a phenomenon in which heat supplied from the fixing roller 14 and the pressure roller 15 to the transfer sheet 30 becomes insufficient because of reduction of the hardness of the silicone rubber layers 26 due to thermal degradation. Therefore, when the quantity of heat supplied from the fixing roller 14 and the pressure roller 15 to the transfer sheet 30 is increased in accordance with the increase of the integrated energizing time, the fixing property and the reproducibility of a transparent color can be prevented from being reduced.

Figure 23:
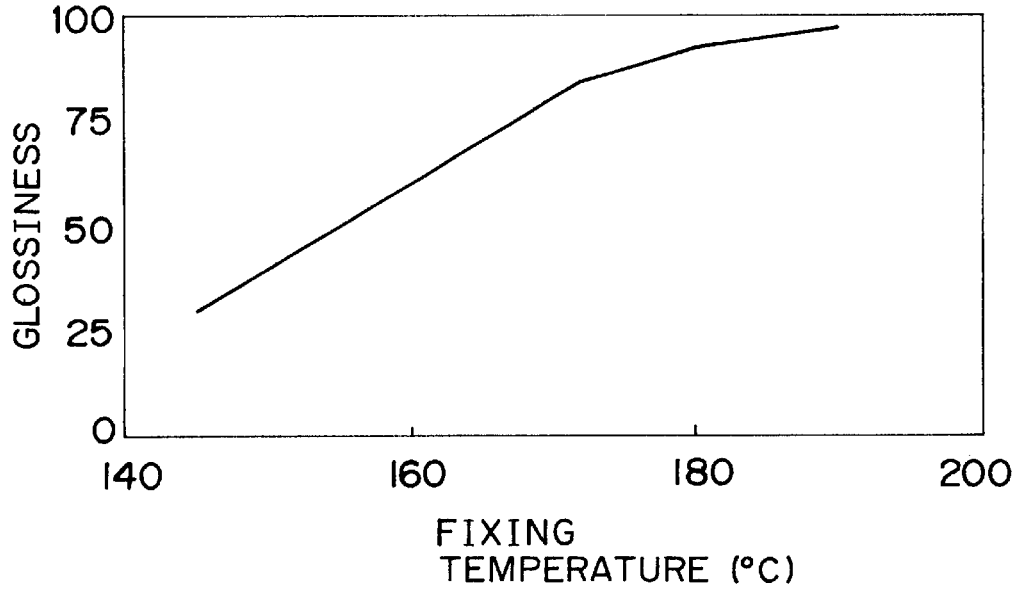
FIG. 23 is a graph showing relationships between a fixing temperature and glossiness.

In the case of normal paper, as shown in FIG. 23, the glossiness of an image on the transfer sheet 30 is increased when the surface temperature (fixing temperature) of each of the silicone rubber layers 26 of the fixing roller 14 and the pressure roller 15 is increased. As the area of a high-density area is larger, a change of the glossiness due to the raising of the fixing temperature is larger.

Figure 24:
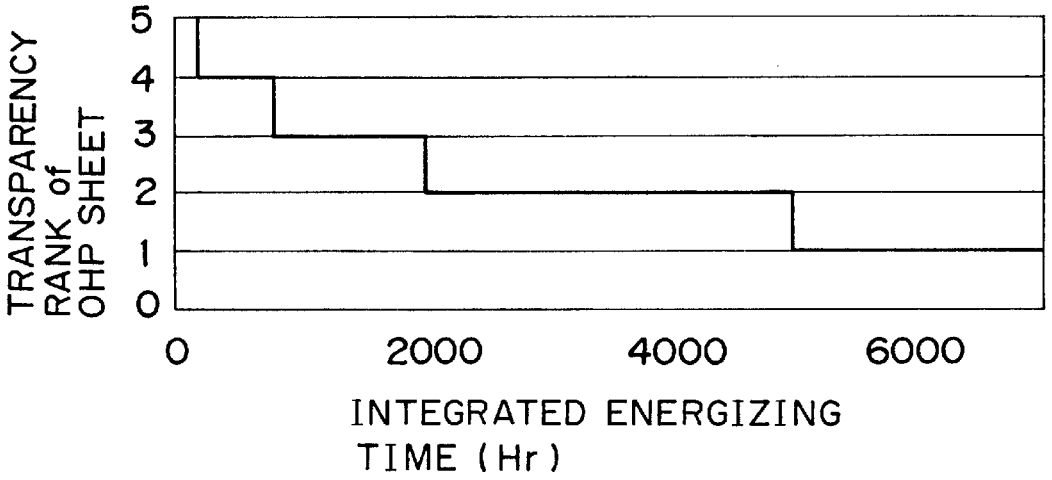
FIG. 24 is a graph showing relationships between an integrated energizing time and transparency of an OHP sheet.

By contrast, in the case of an OHP sheet, as shown in FIG. 24, the reproducibility of a transparent color is more reduced as the integrated energizing time is longer. In FIG. 24, the transparency rank of the ordinate shows that, as its value is larger, the reproducibility of a transparent color is higher. Namely, "1" indicates that the whole portion is obscured, "2" indicates that a highlight portion (a portion of a low image density) is obscured, "3" indicates that a highlight portion is slightly obscured, "4" indicates that transparency is attained, and "5" indicates that clear transparency is attained. As the area of a highlight portion of a half tone is larger, an effect to reduction of the reproducibility of a transparent color due to a prolonged integrated energizing time is larger.

When the quantity of supplied heat is simply increased in accordance with an increase of the integrated energizing time, an excessive heat load is applied to the fixing roller 14 and the pressure roller 15.

Figure 25:
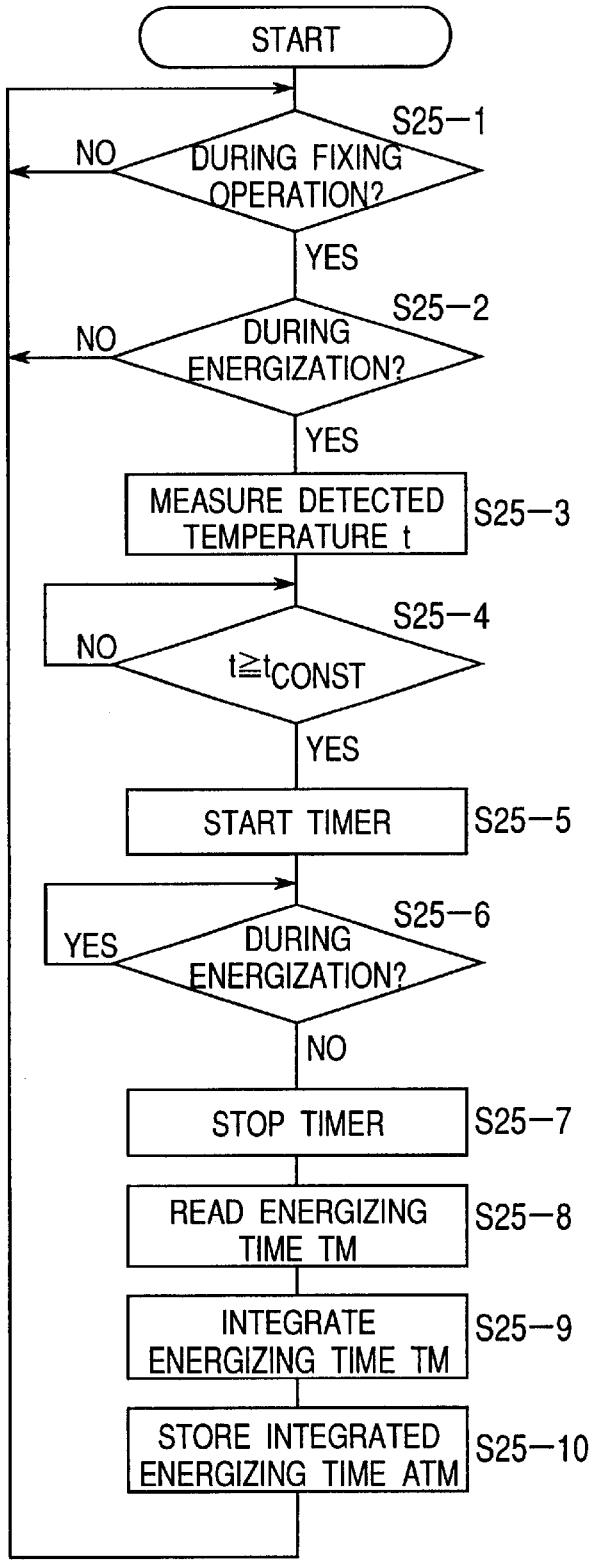
FIG. 25 is a flowchart illustrating an operation of measuring the integrated energizing time in a controller.

Thus, in the sixth embodiment, the controller 135 compensates an effect of reduction of the hardness of the silicone rubber layers 26 due to the thermal degradation, in consideration of the image density and the image area. The controller 135 performs the measurement of the energizing time shown in FIG. 25.

If it is judged in step S25-1 that the fixing operation is being performed, and in step S25-2 that the heater 27 is being energized, then the temperature sensor 33 detects in step S25-3 the temperature of the silicone rubber layer 26 of the pressure roller 15.

If it is judged in step S25-4 that the detected temperature t is not lower than the predetermined temperature $t_{const}$, then the timer is started in step S25-5. The time measurement is continued until no energization is detected in step S25-6. If no energization is detected in step S25-6, then the timer is stopped in step S25-7, and the energizing time TM in this measurement is read out in step S25-8. In step S25-9, the integrated value of the energizing time TM (integrated energizing time ATM) is calculated, and the calculated integrated energizing time ATM is stored in step S25-10.

The fixing operation shown in FIG. 26 will be described. First, in step S26-1, from the main controller 136, the controller 135 reads out information (transfer sheet information) indicative of a selected one of the normal paper mode in which the transfer sheet 30 is normal paper, the OHP sheet mode in which the transfer sheet 30 is an OHP sheet, and a mixed paper mode in which normal paper and an OHP sheet are alternately used for the same developer.

In step S26-2, information of an image (image information) which is sent from the image reading portion 138 to the image forming portion 139 via the main controller 136 is read into the controller 135. The image information contains the image density of each pixel. In the sixth embodiment, the pixel number is set to be 600 dpi×600 dpi=360,000 dots/inch$^2$, and the image density of each pixel has 256 levels.

In step S26-3, an image information data value "Y" is calculated on the basis of the image information which has been read in step S26-2.

Figure 27A:
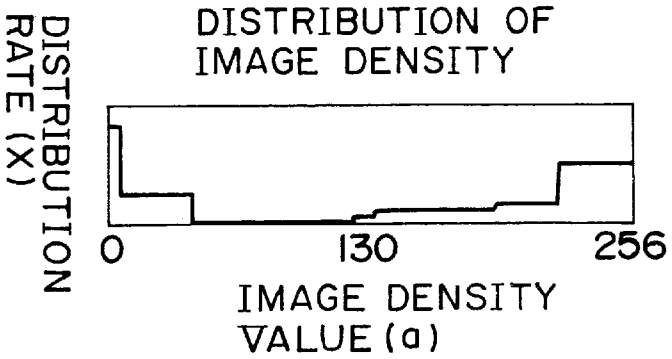
FIG. 27A is a graph showing relationships between an image density and a distribution ratio.
Figure 27B:
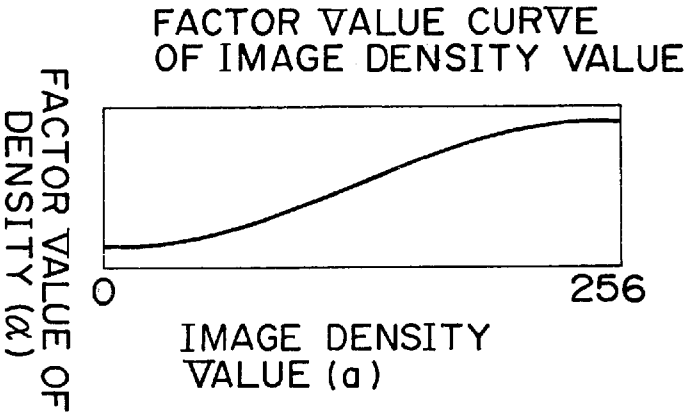
FIG. 27B is a graph showing a factor value curve of the image density.

For example, as shown in FIG. 27A, a distribution ratio "x" for each of the image density value "a" (a=1 to 256) is calculated. Next, a factor value "α" corresponding to each of the image density value "a" is obtained from the graph of FIG. 27B.

Figure 27C:
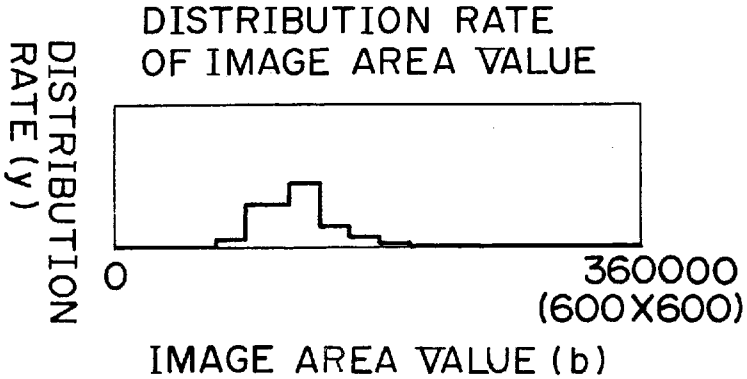
FIG. 27C is a graph showing relationships between an image area and the distribution ratio.
Figure 27D:
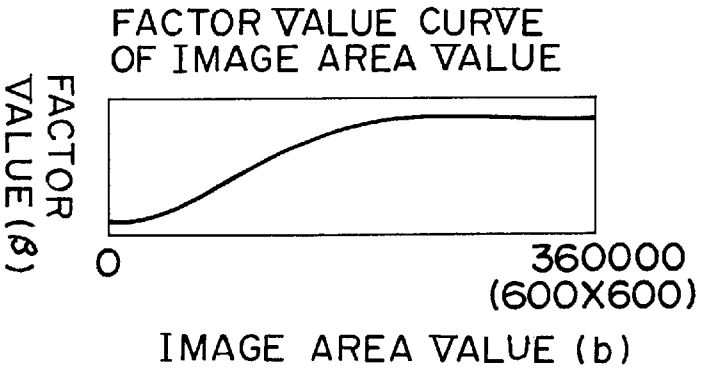
FIG. 27D is a graph showing relationships between an image area and a factor value curve.

A distribution ratio "y" of an image area value "b" for each of the image density value "a" is calculated. For example, FIG. 27C shows the distribution ratio "y" of the image area value "b" in the case where the image density value "a" of FIG. 27A is 130. Furthermore, a factor value "β" corresponding to the distribution ratio "y" of each of the image area values "b" is obtained from the graph of FIG. 27D. For each of the image area values "b", the distribution ratio "y" is multiplied with the factor value "β", and a value "δ" is calculated by integrating the result of the multiplication with respect to the image area value "b".

The image information data value "Y" is obtained by integrating the result of a multiplication of the distribution ratio "x", the factor value "α", and the value "δ" with respect to the image density value "a". The image information data value "Y" is indicated by the following equation (1).

$$Y=\Sigma x\alpha\delta=x_1\alpha_1\delta_1+x_2\alpha_2\delta_2 \ldots +x_{255}\alpha_{255}\delta_{255}+x_{256}\alpha_{256}\delta_{256} \quad (1)$$

In the equation (1), each of the suffixes of 1 to 256 attached to the distribution ratio "x", the factor value "α", and the value "δ" indicates the image density value "a".

As described above, the image information data value "Y" which is calculated from the image density and the image area indicates the property of the image. When the image information data value "Y" is a relatively small value of about 2,000 or less, it indicates that the image consists of characters, a graph, or the like. When the image information data value "Y" is an intermediate value of about 2,001 to 14,000, it indicates that the image is a half-tone image having a possibility that there is a highlight portion. When the image information data value "Y" is a relatively large value of about 14,001 or more, it indicates that the image is an image having a high-density portion of a large area.

After the image information data value "Y" is calculated in step S26-3, the integrated energizing time ATM is read into the controller 135 in step S26-4.

If it is judged in step S26-5 that the current mode is not the mixed paper mode, then the control is advanced to step S26-7. In step S26-7, it is judged whether the recording sheet is normal paper or an OHP sheet. If the recording sheet is normal paper, then the control is advanced to step S26-8.

In step S26-8, the fixing conditions for the normal paper mode are corrected in accordance with the integrated energizing time ATM and the image information data value "Y". In the sixth embodiment, the fixing temperature before correction has an initial value of 160° C., and the fixing speed before correction has an initial value of 150 mm/sec. The nip width is 6.5 mm.

Figure 28:
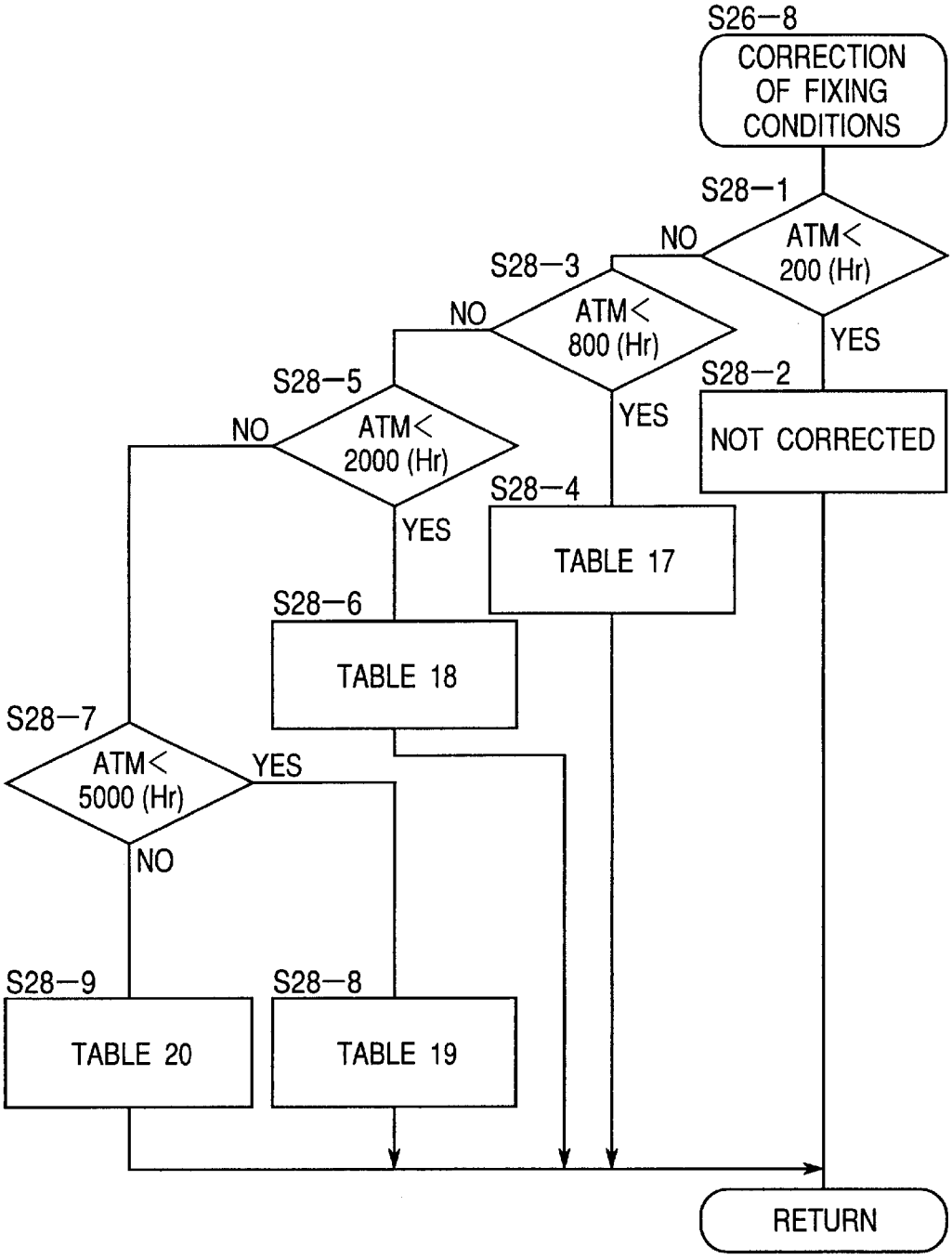
FIG. 28 is a flowchart showing a subroutine of step S26-8 of FIG. 26.

If it is judged in step S28-1 of FIG. 28 that the integrated energizing time ATM is shorter than 200 hours, then it is determined in step S28-2 that the fixing conditions are not corrected. If it is judged in step S28-1 that the integrated energizing time ATM is not shorter than 200 hours, then the control is advanced to step S28-3. If it is judged in step S28-3 that the integrated energizing time ATM is shorter than 800 hours, then the fixing conditions are corrected in step S28-4 on the basis of Table 17.

TABLE 17

Image information data value "Y" and correction of fixing conditions (In the case where the integrated energizing time ATM is not shorter than 200 hours and is shorter than 800 hours)

| Image information data value Y | Correction of fixing conditions |
|---|---|
| ~2000 (image information data value Y is small: character image, graph, or the like) | Fixing temperature is increased by 1.5 |
| 2001~14000 (image information data value Y is intermediate: image which may have a highlight portion) | Fixing speed is decreased by 2% |
| 14001~ (image information data value Y is large: image having a large high-density portion) | Fixing speed is decreased by 2% |

In step S28-4, if the image information data value "Y" is not larger than 2,000, the fixing temperature is increased by 1.5° C. If the image information data value "Y" is not smaller than 2,001 and not larger than 14,000, the fixing speed is decreased by 2%. Also in the case where the image information data value "Y" is not smaller than 14,001, the fixing speed is decreased by 2%.

In both the cases where the fixing temperature is increased, and where the fixing speed is decreased, the quantity of heat supplied from the nip portion 32 to the transfer sheet 30 is increased. However, with respect to the effect on the glossiness of an image, the increase of the fixing temperature exerts a larger effect than that exerted by the decrease of the fixing speed. For example, when the case where the fixing temperature is increased by 1.5° C. is compared with that where the fixing speed is decreased by 2%, the increase of the glossiness of an image in the former case is very larger than that in the latter case.

If it is judged in step S28-3 that the integrated energizing time ATM is not shorter than 800 hours, then the control is advanced to step S28-5. If it is judged in step S28-5 that the integrated energizing time ATM is shorter than 2,000 hours, then the fixing conditions are corrected in step S28-6 on the basis of Table 18 listed below.

TABLE 18

Image information data value "Y" and correction of fixing conditions (In the case where the integrated energizing time ATM is not shorter than 800 hours and is shorter than 2000 hours)

| Image information data value Y | Correction of fixing conditions |
|---|---|
| ~2000 (image information data value Y is small: character image, graph, or the like) | Fixing temperature is increased by 3° C. |
| 2001~14000 (image information data value Y is intermediate: image which may have a highlight portion) | Fixing temperature is increased by 1.5° C. Fixing speed is decreased by 2%. |
| 14001~ (image information data value Y is large: image having a large high-density portion) | Fixing speed is decreased by 4%. |

In step S28-6, if the image information data value "Y" is not larger than 2,000, then the fixing temperature is increased by 3° C. If the image information data value "Y" is not smaller than 2,001 and not larger than 14,000, then the fixing temperature is increased by 1.5° C. and the fixing speed is decreased by 2%. If the image information data value "Y" is not smaller than 14,001, then the fixing speed is decreased by 4%.

If it is judged in step S28-5 that the integrated energizing time ATM is not shorter than 2,000 hours, then the control is advanced to step S28-7. If it is judged in step S28-7 that the integrated energizing time ATM is shorter than 5,000 hours, then the fixing conditions are corrected in step S28-8 on the basis of Table 19 listed below.

TABLE 19

Image information data value "Y" and correction of fixing conditions (In the case where the integrated energizing time ATM is not shorter than 2000 hours and is shorter than 5000 hours)

| Image information data value Y | Correction of fixing conditions |
|---|---|
| ~2000 (image information data value Y is small: character image, graph, or the like) | Fixing temperature is increased by 4.5° C. |
| 2001~14000 (image information data value Y is intermediate: image which may have a highlight portion) | Fixing temperature is increased by 1.5° C. Fixing speed is decreased by 4%. |
| 14001~ (image information data value Y is large: image having a large high-density portion) | Fixing speed is decreased by 6%. |

In step S28-8, if the image information data value "Y" is not larger than 2,000, then the fixing temperature is increased by 4.5° C. If the image information data value "Y" is not smaller than 2,001 and not larger than 14,000, then the fixing temperature is increased by 1.5° C. and the fixing speed is decreased by 4%. If the image information data value Y is not smaller than 14,001, then the fixing speed is decreased by 6%.

If it is judged in step S28-7 that the integrated energizing time ATM is not shorter than 5,000 hours, then the fixing conditions are corrected in step S28-9 on the basis of Table 20 listed below.

TABLE 20

Image information data value "Y" and correction of fixing conditions (In the case where the integrated energizing time ATM is equal to or longer than 5,000 hours)

| Image information data value Y | Correction of fixing conditions |
|---|---|
| ~2000 (image information data value Y is small: character image, graph, or the like) | Fixing temperature is increased by 6.0° C. |

TABLE 20-continued

| Image information data value "Y" and correction of fixing conditions (In the case where the integrated energizing time ATM is equal to or longer than 5,000 hours) | |
|---|---|
| Image information data value Y | Correction of fixing conditions |
| 2001~14000 (image information data value Y is intermediate: image which may have a highlight portion) | Fixing temperature is increased by 3° C. Fixing speed is decreased by 4%. |
| 14001~ (image information data value Y is large: image having a large high-density portion) | Fixing speed is decreased by 8%. |

In step S28-9, if the image information data value "Y" is not larger than 2,000, the fixing temperature is increased by 6.0° C. If the image information data value "Y" is not smaller than 2,001 and not larger than 14,000, then the fixing temperature is increased by 3° C. and the fixing speed is decreased by 4%. If the image information data value "Y" is not smaller than 14,001, then the fixing speed is decreased by 8%.

Figure 26:
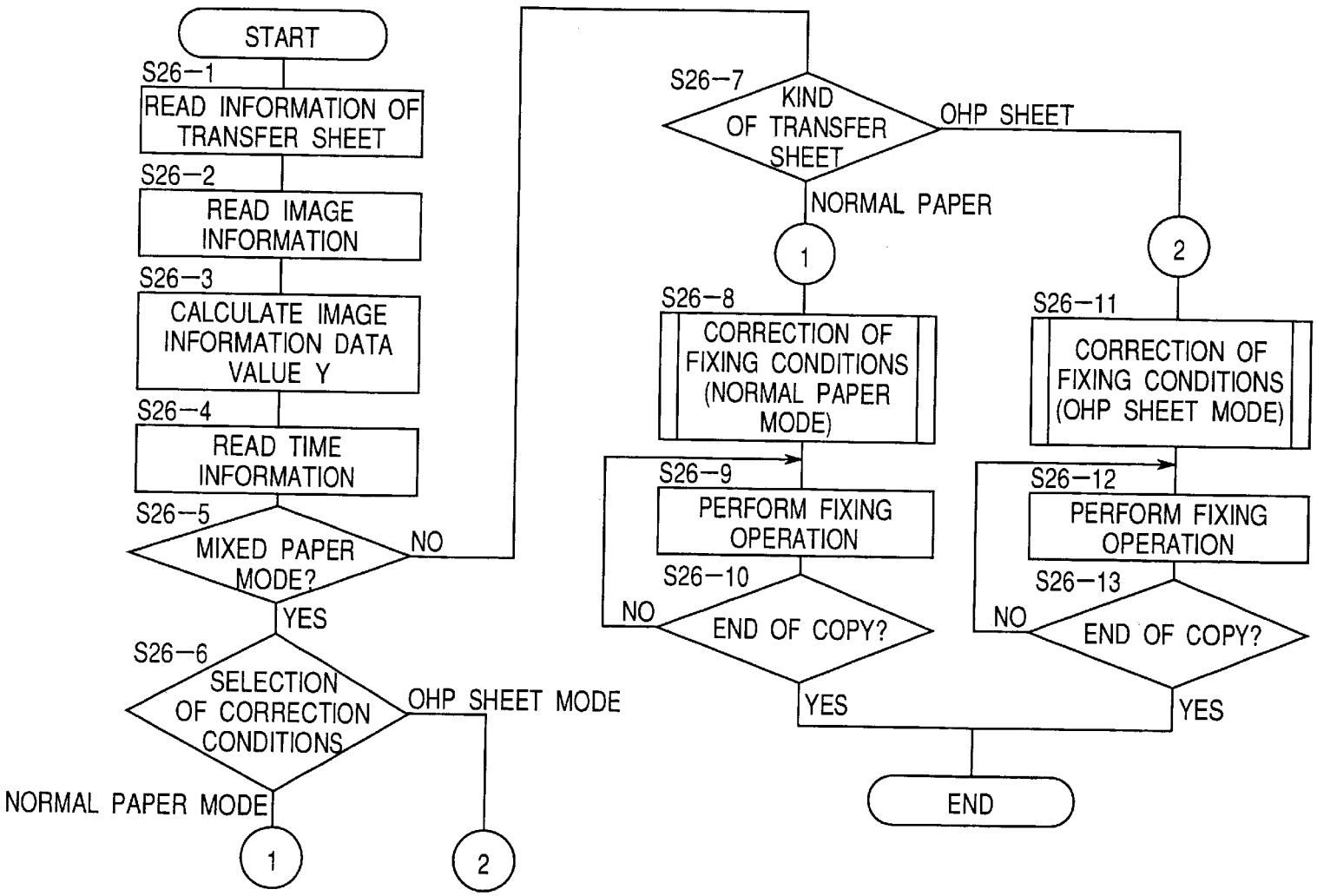
FIG. 26 is a flowchart illustrating the operation of the fixing device of the sixth embodiment.

After the fixing conditions are corrected, the fixing operation is performed in step S26-9 of FIG. 26. If the end of the copying operation is detected in step S26-10, then the fixing operation is ended.

As described above, in the normal paper mode, at least one of the increase of the fixing temperature and the decrease of the fixing speed is performed in accordance with the increase of the integrated energizing time ATM. When the fixing temperature is increased or the fixing speed is decreased, the quantity of heat supplied from the nip portion 32 to the transfer sheet 30 is increased, and hence the reduction of the fixing property which is caused by the reduction of the efficiency of the heat supply due to the thermal degradation of the silicone rubber layers 26 can be prevented from occurring.

As shown in Tables 17 to 20, in the case where the integrated energizing time ATM is in the same range, the increased amount of the fixing temperature and the decreased amount of the fixing speed are set to be larger as the image information data value "Y" is larger. Therefore, for an image such as a character having a small image information data value "Y", the fixing speed is not decreased, and a high productivity is obtained. For an image which has a high-density portion and hence a large image data value "Y", a change of glossiness due to the correction of the fixing conditions can be suppressed.

Since the fixing conditions are corrected in consideration of not only the integrated energizing time ATM but also of the image information as described above, an excessive heat load is prevented from being applied to the silicone rubber layers 26 of the fixing roller 14 and the pressure roller 15, whereby advancement of thermal degradation can be suppressed.

If it is judged in step S26-7 that the recording sheet is an OHP sheet, then the fixing conditions for the OHP sheet mode are corrected in step S26-11 on the basis of the integrated energizing time ATM and the image information data value "Y".

Figure 29:
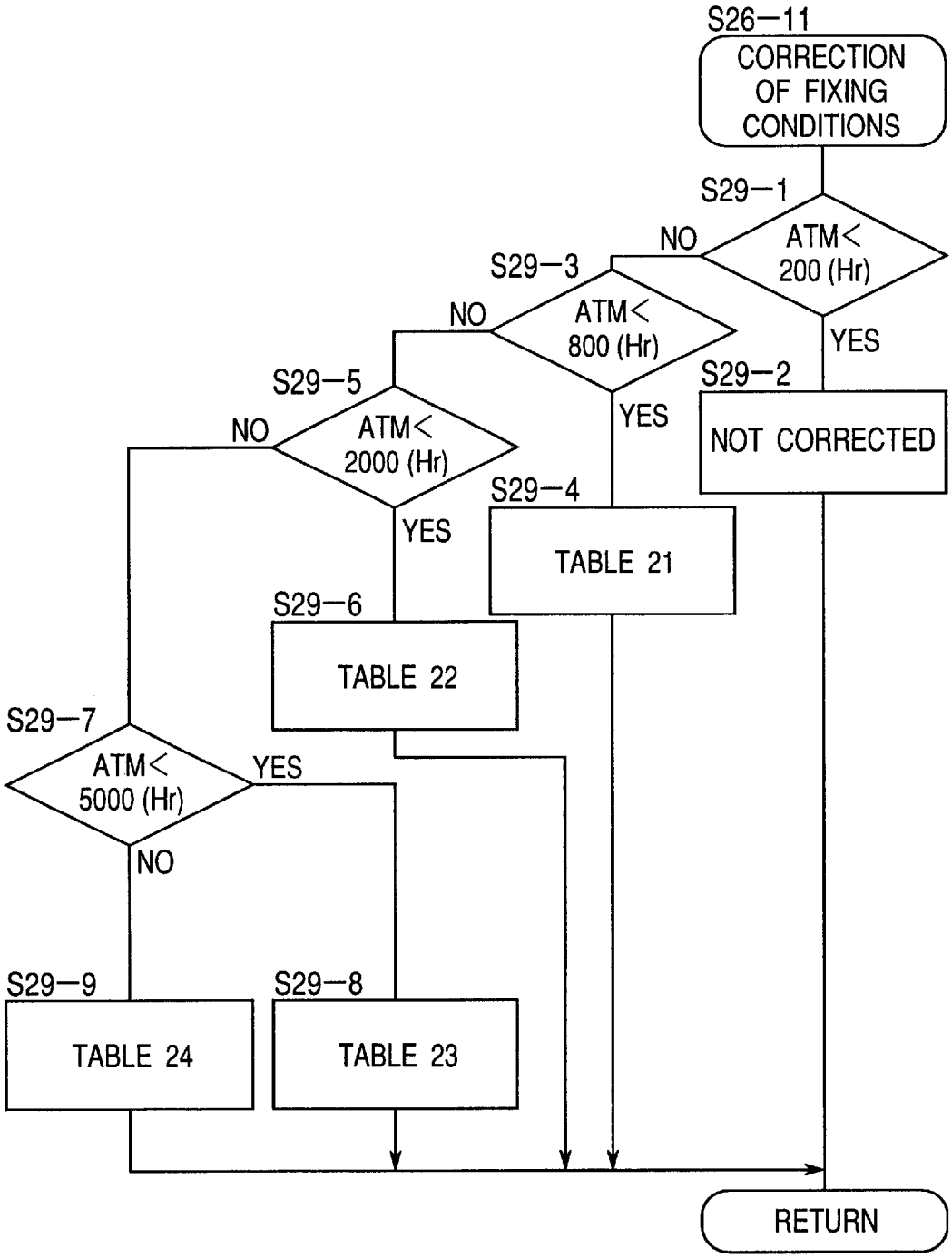
FIG. 29 is a flowchart showing a subroutine of step S26-11 of FIG. 26.

If it is judged in step S29-1 of FIG. 29 that the integrated energizing time ATM is shorter than 200 hours, then it is determined in step S29-2 that the fixing conditions are not corrected. If it is judged in step S29-1 that the integrated energizing time ATM is not shorter than 200 hours, then the control is advanced to step S29-3. If it is judged in step S29-3 that the integrated energizing time ATM is shorter than 800 hours, then the fixing conditions are corrected on the basis of Table 21 listed below.

TABLE 21

| Image information data value "Y" and correction of fixing conditions (In the case where the integrated energizing time ATM is not shorter than 200 hours and is shorter than 800 hours) | |
|---|---|
| Image information data value Y | Correction of fixing conditions |
| ~2000 (image information data value Y is small: character image, graph, or the like) | Not corrected |
| 2001~14000 (image information data value Y is intermediate: image which may have a highlight portion) | Fixing temperature is increased by 2.5° C. |
| 14001~ (image information data value Y is large: image having a large high-density portion) | Not corrected |

In step S29-4, if the image information data value "Y" is not larger than 2,000, then the fixing conditions are not corrected. If the image information data value "Y" is not smaller than 2,001 and not larger than 14,000, then the fixing temperature is increased by 2.5° C. If the image information data value "Y" is not smaller than 14,001, the fixing conditions are not corrected.

If it is judged in step S29-3 that the integrated energizing time ATM is not shorter than 800 hours, then the control is advanced to step S29-5. If it is judged in step S29-5 that the integrated energizing time ATM is shorter than 2,000 hours, then the fixing conditions are corrected on the basis of Table 22 listed below.

TABLE 22

| Image information data value "Y" and correction of fixing conditions (In the case where the integrated energizing time ATM is not shorter than 800 hours and is shorter than 2000 hours) | |
|---|---|
| Image information data value Y | Correction of fixing conditions |
| ~2000 (image information data value Y is small: character image, graph, or the like) | Not corrected |
| 2001~14000 (image information data value Y is intermediate: image which may have a highlight portion) | Fixing temperature is increased by 5.0° C. |
| 14001~ (image information data value Y is large: image having a large high-density portion) | Fixing temperature is increased by 2.5° C. |

In step S29-6, if the image information data value "Y" is not larger than 2,000, the fixing conditions are not corrected. If the image information data value "Y" is not smaller than 2,001 and not larger than 14,000, then the fixing temperature is increased by 5.0° C. If the image information data value "Y" is not smaller than 14,001, then the fixing temperature is increased by 2.5° C.

If it is judged in step S29-5 that the integrated energizing time ATM is not shorter than 2,000 hours, then the control is advanced to step S29-7. If it is judged in step S29-7 that the integrated energizing time ATM is shorter than 5,000 hours, then the fixing conditions are corrected in step S29-8 on the basis of Table 23 listed below.

TABLE 23

| Image information data value "Y" and correction of fixing conditions (In the case where the integrated energizing time ATM is not shorter than 2000 hours and is shorter than 5000 hours) | |
|---|---|
| Image information data value Y | Correction of fixing conditions |
| ~2000 (image information data value Y is small: character image, graph, or the like) | Fixing temperature is increased by 2.5° C. |
| 2001~14000 (image information data value Y is intermediate: image which may have a highlight portion) | Fixing temperature is increased by 7.5° C. |
| 14001~ (image information data value Y is large: image having a large high-density portion) | Fixing temperature is increased by 5.0° C. |

In step S29-8, if the image information data value "Y" is not larger than 2,000, then the fixing temperature is increased by 2.5° C. If the image information data value "Y" is not smaller than 2,001 and not larger than 14,000, then the fixing temperature is increased by 7.5° C. If the image information data value "Y" is not smaller than 14,001, then the fixing temperature is increased by 5.0° C.

If it is judged in step S29-7 that the integrated energizing time ATM is not shorter than 5,000 hours, then the fixing conditions are corrected in step S29-9 on the basis of Table 24 listed below.

TABLE 24

| Image information data value "Y" and correction of fixing conditions (In the case where the integrated energizing time ATM is equal to or longer than 5,000 hours) | |
|---|---|
| Image information data value Y | Correction of fixing conditions |
| ~2000 (image information data value Y is small: character image, graph, or the like) | Fixing temperature is increased by 5.0° C. |
| 2001~14000 (image information data value Y is intermediate: image which may have a highlight portion) | Fixing temperature is increased by 10° C. |
| 14001~ (image information data value Y is large: image having a large high-density portion) | Fixing temperature is increased by 7.5° C. |

In step S29-9, if the image information data value "Y" is not larger than 2,000, then the fixing temperature is increased by 5.0° C. If the image information data value "Y" is not smaller than 2,001 and not larger than 14,000, then the fixing temperature is increased by 10° C. If the image information data value "Y" is not smaller than 14,001, then the fixing temperature is increased by 7.5° C.

After the fixing conditions are corrected, the fixing operation is performed in step S26-12 of FIG. 26. If the end of the copying operation is detected in step S26-13, then the fixing operation is ended.

As described above, in the OHP sheet mode, the increase of the fixing temperature is performed in accordance with the increase of the integrated energizing time ATM, thereby increasing the amount of heat supplied to the transfer sheet 30. Therefore, the reduction of the reproducibility of a transparent color which is caused by the reduction of the efficiency of the heat supply due to the thermal degradation of the silicone rubber layers 26 can be prevented from occurring. As a result, the fixing speed can be set to be higher, so that a high productivity is obtained.

As shown in Tables 21 to 24, in the case where the integrated energizing time ATM is in the same range, the increased amount of the fixing temperature is set to be larger in the sequence of the cases where the image information data value "Y" is intermediate (not smaller than 2,001 and not larger than 14,000), where the image information data value "Y" is large (not smaller than 14,001), and where the image information data value "Y" is small (not larger than 2,000). As described above, the reduction of the reproducibility of a transparent color which is caused by the reduction of the efficiency of the heat supply due to the thermal degradation of the silicone rubber layers 26 is most conspicuous in the case of an image having a possibility that there is a highlight portion. Therefore, when the fixing conditions are corrected as described above with respect to the image information data value "Y", the reduction of the reproducibility of a transparent color can be prevented more surely from occurring.

When the fixing conditions are corrected as described above with respect to the image information data value "Y", an excessive heat load is prevented from being applied to the silicone rubber layers 26 of the fixing roller 14 and the pressure roller 15, whereby advancement of thermal degradation can be suppressed.

If it is judged in step S26-5 of FIG. 26 that the current mode is the mixed paper mode, then the correction conditions are selected in step 26-6. In step 26-6, in the cases where the image information data value "Y" is small (not larger than 2,000) and where the image information data value "Y" is large (not smaller than 14,001), the correction conditions for the normal paper mode are selected, and the control is advanced to step S26-8 to perform correction of the fixing conditions under the same conditions as those in the normal paper mode shown in FIG. 28. By contrast, in step 26-6, in the case where the image information data value "Y" is intermediate (not smaller than 2,001 and not larger than 14,000), the correction conditions for the OHP sheet mode are selected, and the control is advanced to step S26-11 to perform correction of the fixing conditions under the same conditions as those in the OHP sheet mode shown in FIG. 29.

As described above, in the case where the image information data value "Y" is intermediate, the thermal degradation of the silicone rubber layers 26 exerts the greatest effect on the reproducibility of a transparent color in the OHP sheet mode, and, in the case where the image information data value "Y" is large, the thermal degradation of the silicone rubber layers 26 exerts the greatest effect on the change of glossiness in the normal paper mode. Therefor, in the mixed paper mode as described above, the fixing conditions are corrected while, in the case where the image information data value "Y" is intermediate, emphasis is placed on prevention of reduction of the reproducibility of a transparent color, and, in the case where the image information data value Y is large, emphasis is placed on prevention of reduction of the fixing property, whereby both the reproducibility of a transparent color and the fixing property are improved.

In the case where the image information data value "Y" is small, the change of the heat supplying efficiency due to the thermal degradation of the silicone rubber layers 26 does not exert a particularly large effect on one of the fixing property in the normal paper mode, and the reproducibility of a transparent color in the OHP sheet mode. Therefore, in the case where the image information data value "Y" is small, the fixing conditions may be corrected under the same conditions as those in the OHP sheet mode.

In the mixed paper mode, as described above, it is preferable that, in the case where the image information data value "Y" is intermediate, emphasis is placed on the reproducibility of a transparent color in an OHP sheet, and, in the case where the image information data value "Y" is large, emphasis is placed on glossiness in normal paper. In a practical use, generally, reduction of the reproducibility of a transparent color is more problematic than a change of glossiness. Therefore, in the mixed paper mode, the fixing conditions may be always corrected under the same conditions as those in the OHP sheet mode, irrespective of the image information data value "Y".

Seventh Embodiment

Next, a seventh embodiment of the invention will be described.

In the seventh embodiment, in order to prevent the reduction of the fixing property in normal paper and that of reproducibility of a transparent color in an OHP sheet which are caused by thermal degradation of the silicone rubber layers 26 from occurring, the fixing conditions are corrected on the basis of the detected temperature "t" by the temperature sensor 33 in addition to the integrated energizing time and the image information data value "Y".

The mechanical structure of the fixing device of the seventh embodiment is identical with that of the sixth embodiment shown in FIG. 22, and the silicone rubber layers 26 of the fixing roller 14 and the pressure roller 15 have a high heat conductivity which is not smaller than $1.2\times10^{-3}$ (cal/cm·sec·° C.) and not larger than $2.4\times10^{-3}$ (cal/cm·sec·° C.) in the same manner as those of the first embodiment. The fixing temperature before correction is 160° C. and the fixing speed is 150 mm/sec before correction.

Figure 30:
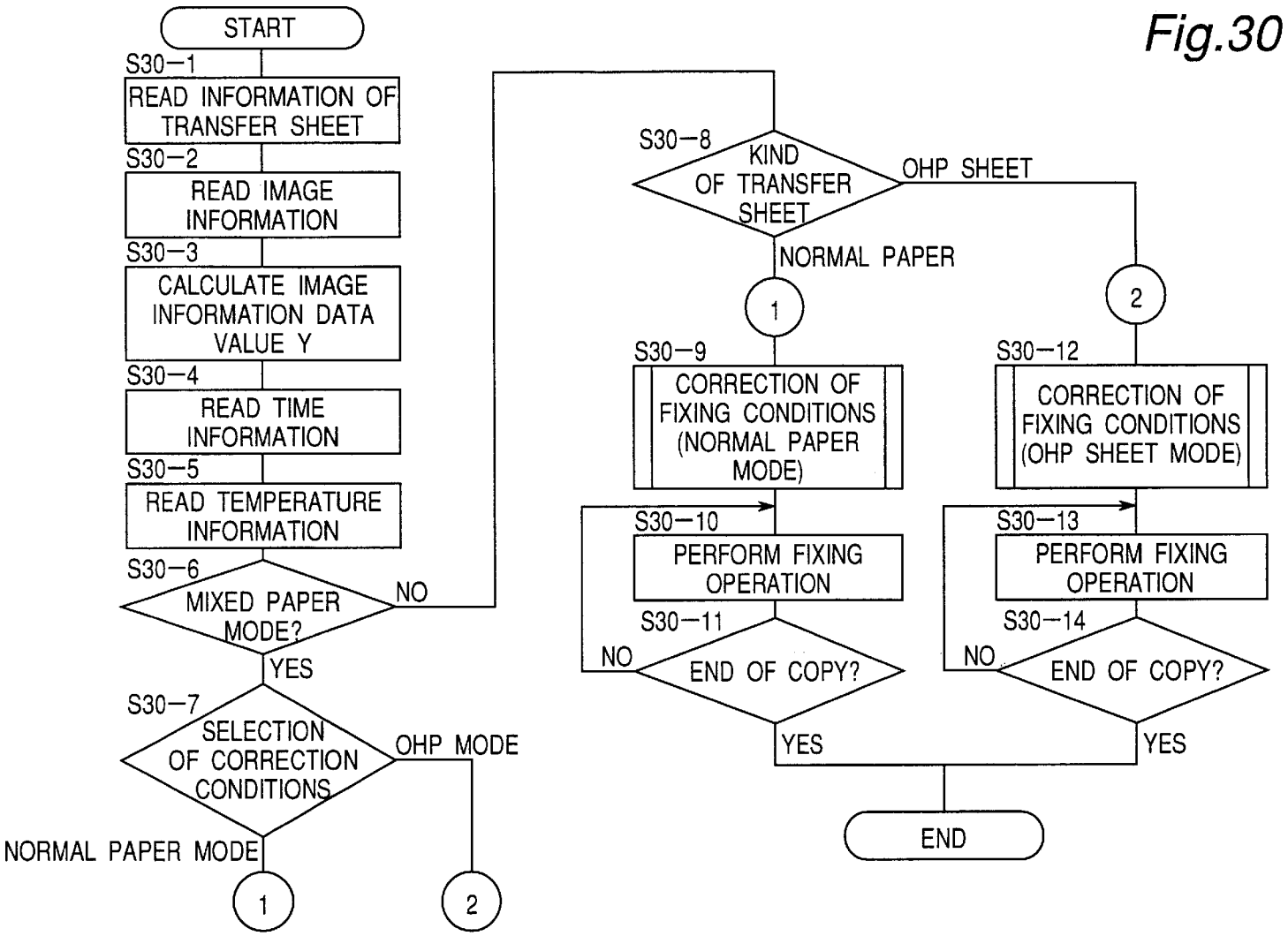
FIG. 30 is a flowchart illustrating the operation of a fixing device of a seventh embodiment.

In steps S30-1 to S30-4 of FIG. 30, in the same manner as the sixth embodiment, the transfer sheet information is read, the image information is read, the image information data value "Y" is calculated, and the time information is read. Thereafter, the detected temperature "t" by the temperature sensor 33 is read into the controller 135 in step S30–5.

If it is judged in step S30–6 that the current mode is not the mixed paper mode, and if it is judged in step S30-8 that the transfer sheet 30 is normal paper, then correction of the fixing conditions for the normal paper mode, and the fixing operation are performed in steps S30-9 to S30-11.

Figure 31:
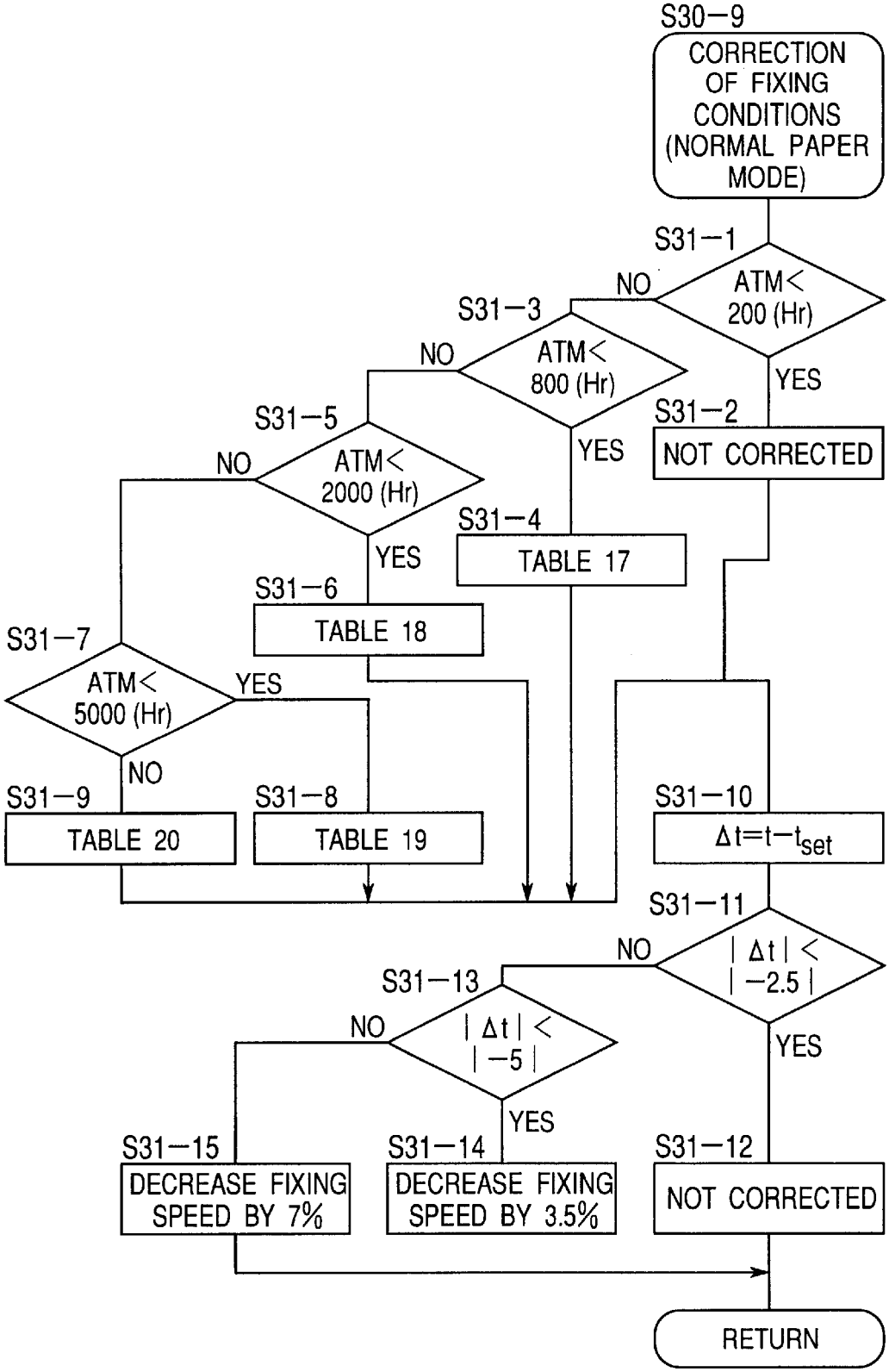
FIG. 31 is a flowchart showing a subroutine of step S30-9 of FIG. 30.

In the correction of the fixing conditions in step S30-9, as shown in steps S31-1 to S31-9 of FIG. 31, the fixing conditions are corrected on the basis of the integrated energizing time ATM and the image information data value "Y" in the same manner as the correction of the fixing conditions for the normal paper mode in the sixth embodiment. In step S31-10, the difference (temperature difference Δt) between the detected temperature "t" and a set value (set temperature $t_{SET}$) of the fixing temperature is calculated. In steps S31-11 to S31-15, the fixing speed is further corrected in accordance with the temperature difference Δt.

If it is judged in step S31-11 that the temperature difference Δt is smaller than 2.5° C. (Δt=0 to −2.5° C.), then it is determined in step S31-12 that the fixing speed is not corrected. If it is judged in step S31-11 that the temperature difference Δt is not smaller than 2.5° C., then the control is advanced to step S31-13. If it is judged in step S31-13 that the temperature difference Δt is smaller than 5° C. (Δt=−2.5 to −5° C.), then the fixing speed is further reduced by 3.5% in step S31-14. If it is judged in step S31-13 that the temperature difference Δt is larger than 5° C., then the fixing speed is further reduced by 7% in step S31-15.

If it is judged in step S30-8 that the transfer sheet 30 is an OHP sheet, then correction of the fixing conditions for the OHP sheet mode, and the fixing operation are performed in steps S30-12 to S30-14.

Figure 32:
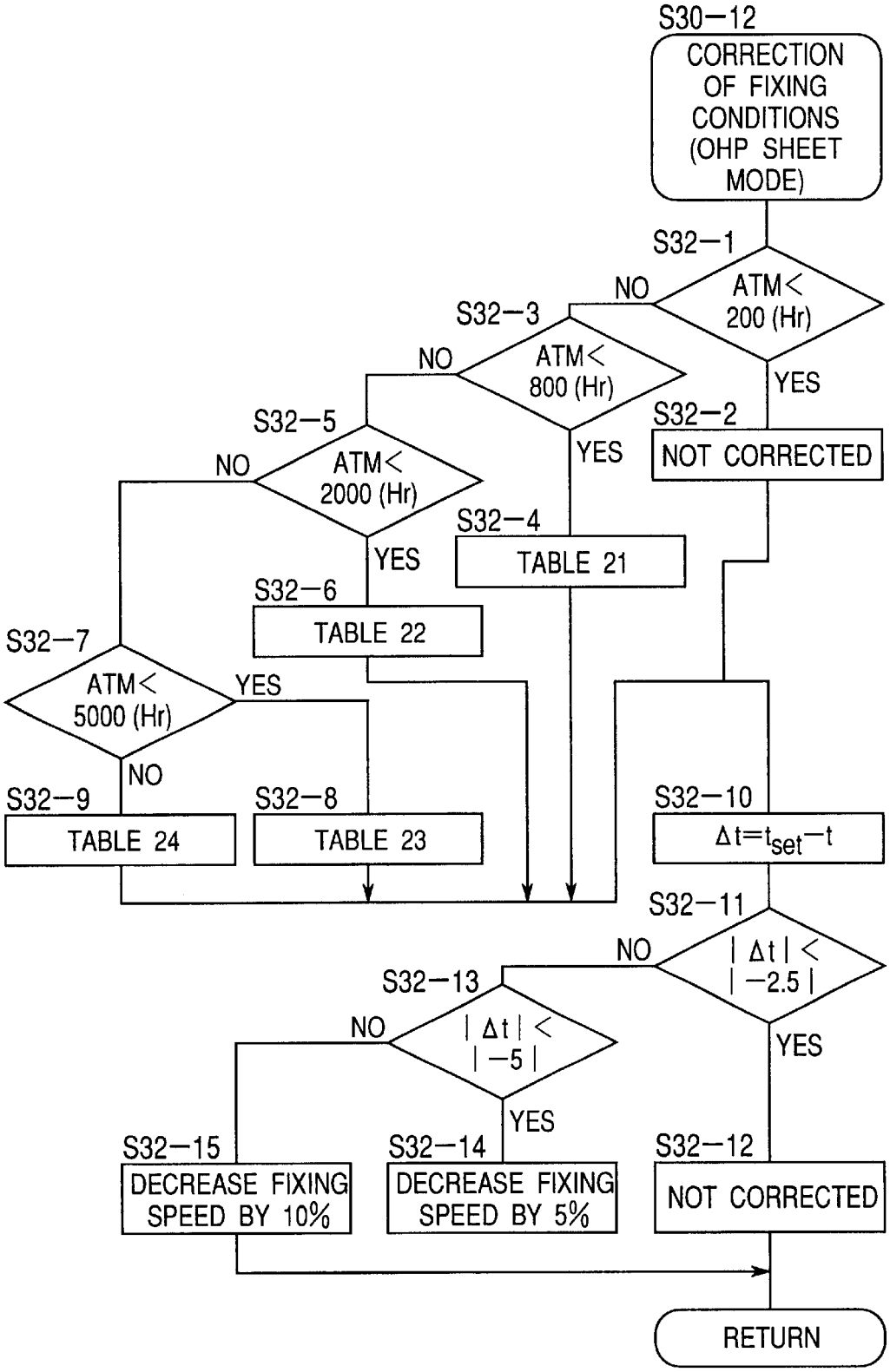
FIG. 32 is a flowchart showing a subroutine of step S30-12 of FIG. 30.

In the correction of the fixing operation in step S30-12, as shown in steps S32-1 to S32-9 of FIG. 32, the fixing conditions are corrected in accordance with the integrated energizing time ATM and the image information data value "Y" in the same manner as the correction of the fixing conditions for the OHP sheet mode in the sixth embodiment.

In step S32-10, the temperature difference Δt is calculated. In steps S32-11 to S32-15, the fixing speed is corrected in accordance with the temperature difference Δt.

If it is judged in step S32-11 that the temperature difference Δt is smaller than 2.5° C. (Δt=0 to −2.5° C.), then it is determined in step S32-12 that the fixing speed is not corrected. If it is judged in step S32-11 that the temperature difference Δt is not smaller than 2.5° C., then the control is advanced to step S32-13. If it is judged in step S32-13 that the temperature difference Δt is smaller than 5° C. (Δt=−2.5 to −5° C.), then the fixing speed is reduced by 5% in step S32-14. If it is judged in step S32-13 that the temperature difference Δt is larger than 5° C., then the fixing speed is reduced by 10% in step S32-15.

If it is judged in step S30-6 that the current mode is the mixed paper mode, then the correction is advanced to step S30-7 in which, in the same manner as the sixth embodiment, in the cases where the image information data value "Y" is small and where the image information data value "Y" is large, correction of the fixing conditions is performed under the same conditions as those in the normal paper mode, and, in the case where the image information data value "Y" is intermediate, correction of the fixing conditions is performed under the same conditions as those in the OHP sheet mode As described above, in the seventh embodiment, the fixing speed is further corrected on the basis of the temperature difference Δt in any one of the normal paper mode, the OHP sheet mode, and the mixed paper mode, and the reduction amount of the fixing speed is set to be larger as the temperature difference Δt is larger. As the temperature difference Δt is larger, the actual surface temperatures of the silicone rubber layers 26 are lower. Therefore, when the fixing speed is decreased in accordance with the temperature difference Δt as described above, the reduction of the fixing property and that of reproducibility of a transparent color which are caused by reduction of hardness of the silicone rubber layers 26 due to the thermal degradation can be prevented more surely from occurring.

In also the seventh embodiment, if the image information data value "Y" is small in the mixed paper mode, the fixing conditions may be corrected under the same conditions as those in the OHP sheet mode. In the mixed paper mode, the fixing conditions may be always corrected under the same conditions as those in the OHP sheet mode, irrespective of the image information data value "Y". Furthermore, the fixing temperature may be increased in accordance with the temperature difference Δt.

Eighth Embodiment

Figure 33:
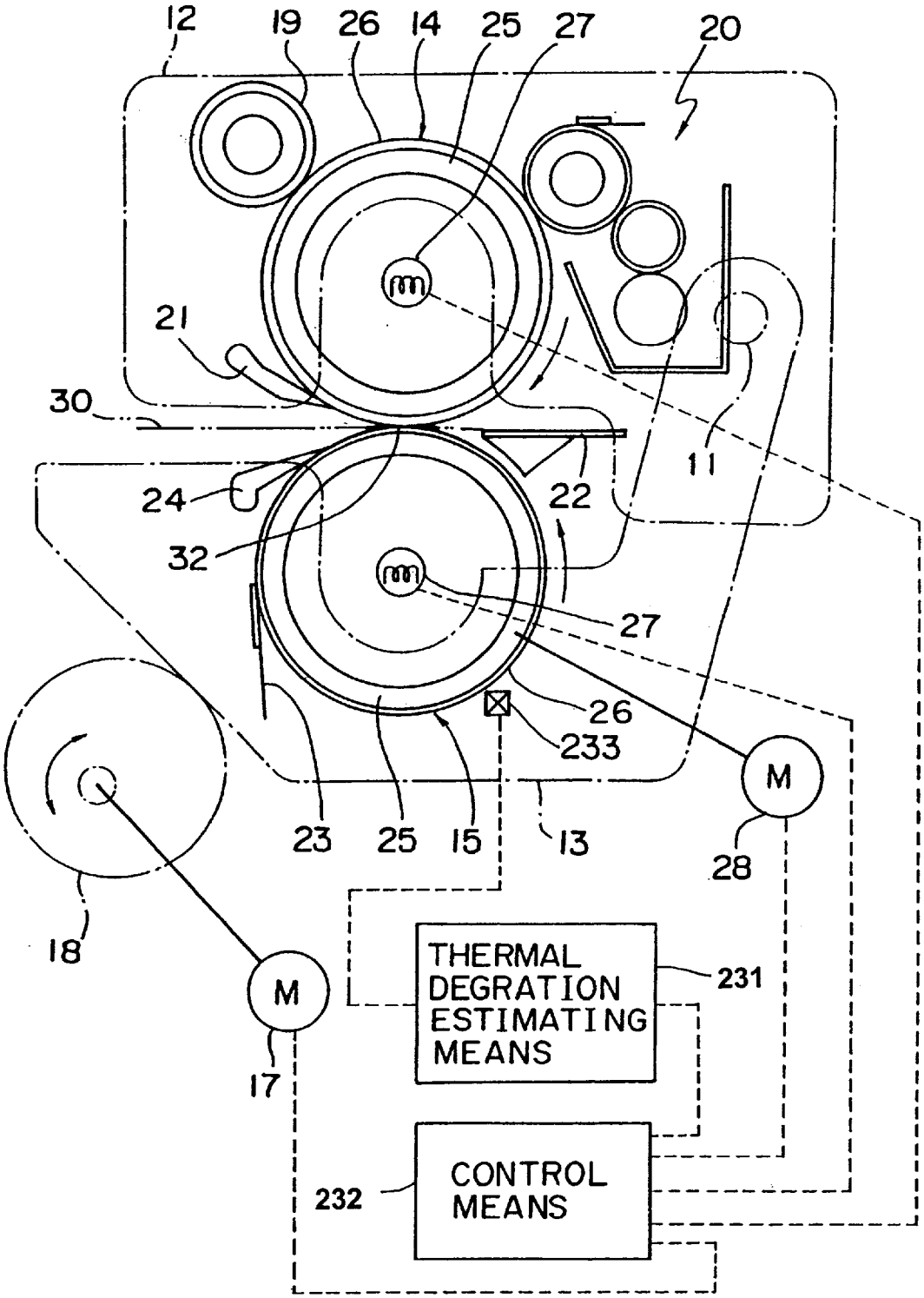
FIG. 33 is a diagram schematically showing a fixing device which is an eighth embodiment of the invention.

FIG. 33 shows a fixing device which is an eighth embodiment of the invention. The eighth embodiment is configured in the same manner as the first embodiment except that thermal degradation estimating means 231 for estimating the degree of thermal degradation of the silicone rubber layers 26, and control means 232 for controlling the motors 17 and 28 and the heaters 27 are provided, and hence like components are denoted by the same reference numerals.

Figure 34:
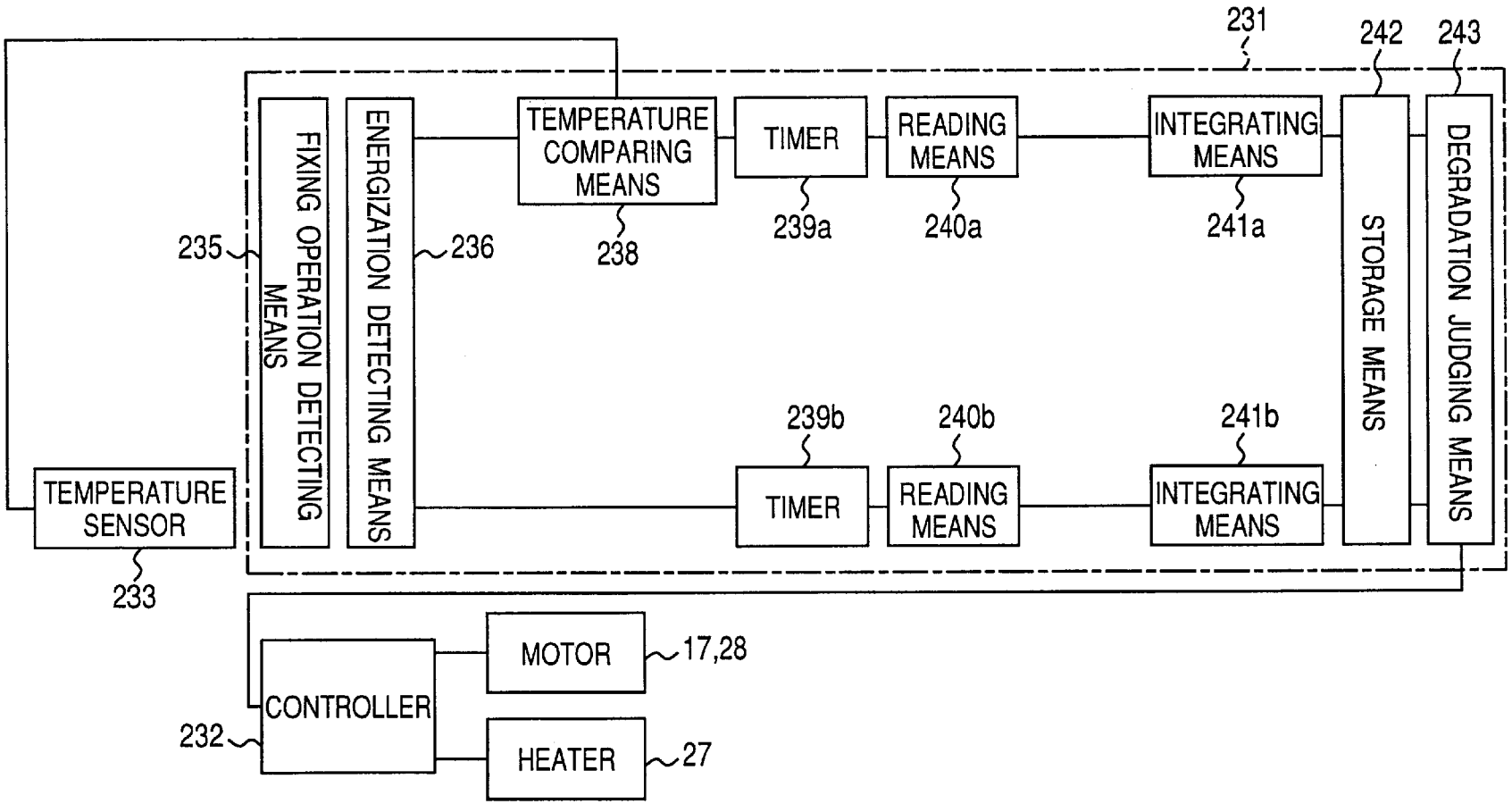
FIG. 34 is a block diagram showing the configuration of thermal degradation estimating means 231 disposed in the fixing device of the eighth embodiment.

As shown in FIG. 34, the thermal degradation estimating means 231 comprises fixing operation detecting means 235 for detecting whether the fixing device is performing the fixing operation or in a waiting state (in a non-fixing operation), and energization detecting means 236 for detecting whether the fixing device is in an energization state where a current is supplied from a power source (not shown) to the heaters 27, or in a nonenergization state where no current is supplied to the heaters 27.

The thermal degradation estimating means 231 further comprises temperature comparing means 238, reading means 240*a* for reading a measured value of a timer 239*a* serving as energizing time measuring means, and energizing time integrating means 241*a* for integrating the read value of the reading means 240*a*. The thermal degradation estimating means 231 further comprises reading means 240*b* for reading a measured value of a timer 239*b* serving as waiting energizing time measuring means, and accumulating means 241*b* (waiting energizing time integrating means) for integrating the read value of the reading means 240*b*. The thermal degradation estimating means 231 further comprises storage means 242 for storing calculation results of the integrating means 241*a* and 241*b*, and degradation judging means 243 for judging the degree of thermal degradation of the silicone rubber layers 26 on the basis of values stored in the storage means 242.

Figure 35:
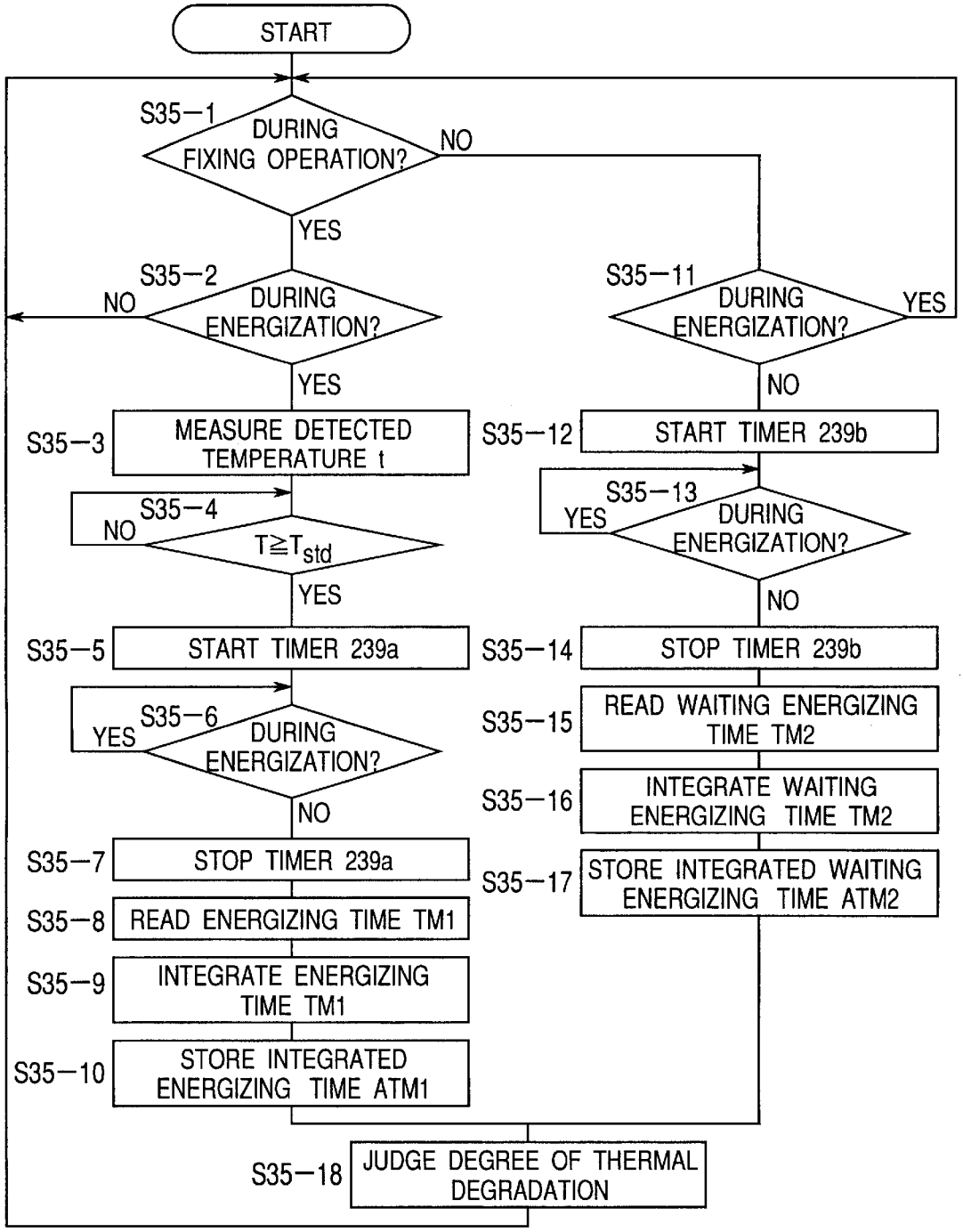
FIG. 35 is a flowchart illustrating the operation of the thermal degradation estimating means 231 of the eighth embodiment.

With reference to the flowchart shown in FIG. 35, the operation of the eighth embodiment will be described. When the power source of the fixing device is turned on, the fixing operation detecting means 235 judges in step S35-1 whether the fixing operation is being performed or not. If it is judged in step S35-1 that the fixing operation is being performed, then the control is advanced to step S35-2.

In step S35-2, the energization detecting means 236 judges whether the heaters 27 are energized or not. If the heaters 27 are energized, then the control is advanced to step S35-3, and, if the heaters are not energized, then the control is returned to step S35-1.

In step S35-3, the temperature (detected temperature "t") of the silicone rubber layer 26 of the pressure roller 15 which is detected by the temperature sensor 233 is supplied to the temperature comparing means 238.

Next, the temperature comparing means 238 compares in step S35-4 the detected temperature "t" with a reference temperature $t_{std}$ which is a preset reference value of the surface temperature (fixing temperature) of the silicone rubber layer 26. If it is judged in step S35-4 that the detected temperature "t" is not lower than the reference temperature "$t_{std}$", then the timer 239*a* is started in step S35-5.

If it is detected in step S35-6 that the heaters 27 are not energized, then the timer 239*a* is stopped in step S35-7. In step S35-8, the reading means 240*a* reads out an energizing time TM1 which is measured by the timer 239*a*. The energizing time integrating means 241*a* calculates in step S35-9 an integrated energizing time ATM1 which is an integrated value of the energizing time TM1. In step S35-10, the integrated energizing time ATM1 is stored into the storage means 242.

By contrast, if the fixing operation detecting means 235 judges in step S35-1 that the fixing device is not performing the fixing operation or is in the waiting state, then the control is advanced to step S35-11. If the energization detecting means 236 detects in step S35-11 that the heaters 27 are being energized, then the timer 239*b* is started in step S35-12. If the heaters are not energized in step S35-11, then the control is returned to step S35-1.

If it is detected in step S35-13 that the heaters 27 are not energized, then the timer 239*b* is stopped in step S35-14. In step S35-15, the reading means 240*b* reads out a waiting energizing time TM2 measured by the timer 239*b*. The integrating means 241*b* calculates in step S35-16 an integrated waiting energizing time ATM2 which is an integrated value of the waiting energizing time TM2. In step S35-17, the integrated waiting energizing time ATM2 is stored into the storage means 242.

In step S35-18, the degradation judging means 243 judges the degree of thermal degradation of the silicone rubber layers 26 of the fixing roller 14 and the pressure roller 15, in accordance with the integrated energizing time ATM1 and the integrated waiting energizing time ATM2 which are stored in the storage means 242.

Specifically, the degradation judging means 243 calculates an estimated degradation time DTM from following equation (2).

$$DTM=ATM1+ATM2\times 0.2 \quad (2)$$

Figure 36:
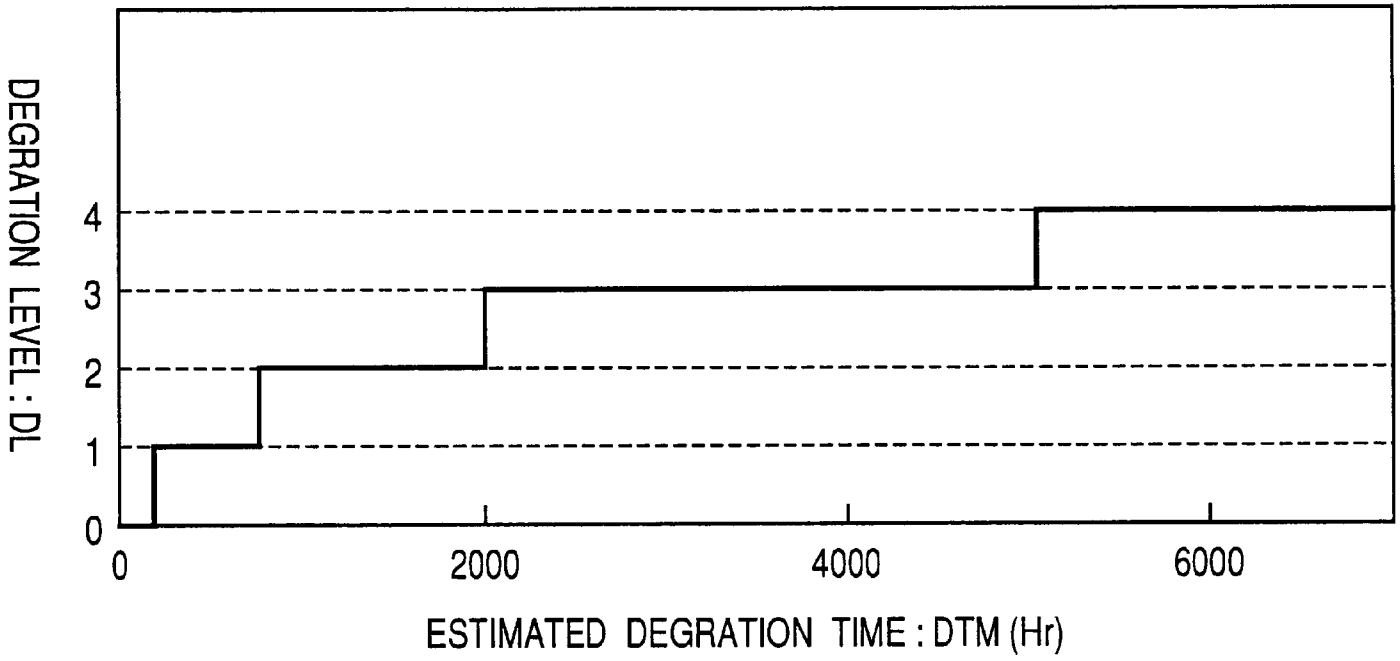
FIG. 36 is a graph showing relationships between an estimated degradation time and a degradation level.

Next, the degradation judging means 243 calculates a degradation level DL indicating the degree of degradation of the silicone rubber layers 26, from the estimated degradation time DTM and on the basis of FIG. 36. In the embodiment, the degradation level DL is an integer of "0" to "4," and indicates that, as the value is larger, the degradation is further advanced.

On the basis of the judgement result of the degradation judging means 243, the control means 232 controls the motors 17 and 28 and the heaters 27. Specifically, as shown in Table 25 listed below, the outputs of the heaters 27 are increased as the value of the degradation level DL is larger, so that the fixing temperature is set to be higher. As the thermal degradation is further advanced, the rotational speed of the motor 28 may be reduced so as to lower the transfer speed of the transfer sheet 30. Alternatively, both the outputs of the heaters 27, and the rotational speed of the motor 28 may be adjusted.

TABLE 25

| Estimated degradation time DTM (Hr) | Degradation level DL | Corrected fixing temperature (° C.) |
|---|---|---|
| 0~200 | 0 | 160 |
| 200~800 | 1 | 161.5 |
| 800~2000 | 2 | 163 |
| 2000~5000 | 3 | 164.5 |
| 5000~7000 | 4 | 166 |

In the eighth embodiment, since the degree of thermal degradation of the silicone rubber layers 26 is estimated as described above on the basis of the integrated energizing time ATM1 which is an integrated value of the energizing time TM1 of the heaters 27 during the fixing operation, the degree of thermal degradation can be estimated by a simple configuration. Further, in the eighth embodiment, since the degree of thermal degradation is estimated in consideration of also the integrated waiting energizing time ATM2 which is an integrated value of the waiting energizing time TM2 of the heaters 27 in the waiting state, the estimation can be performed in a highly accurate manner.

Ninth Embodiment

Figure 37:
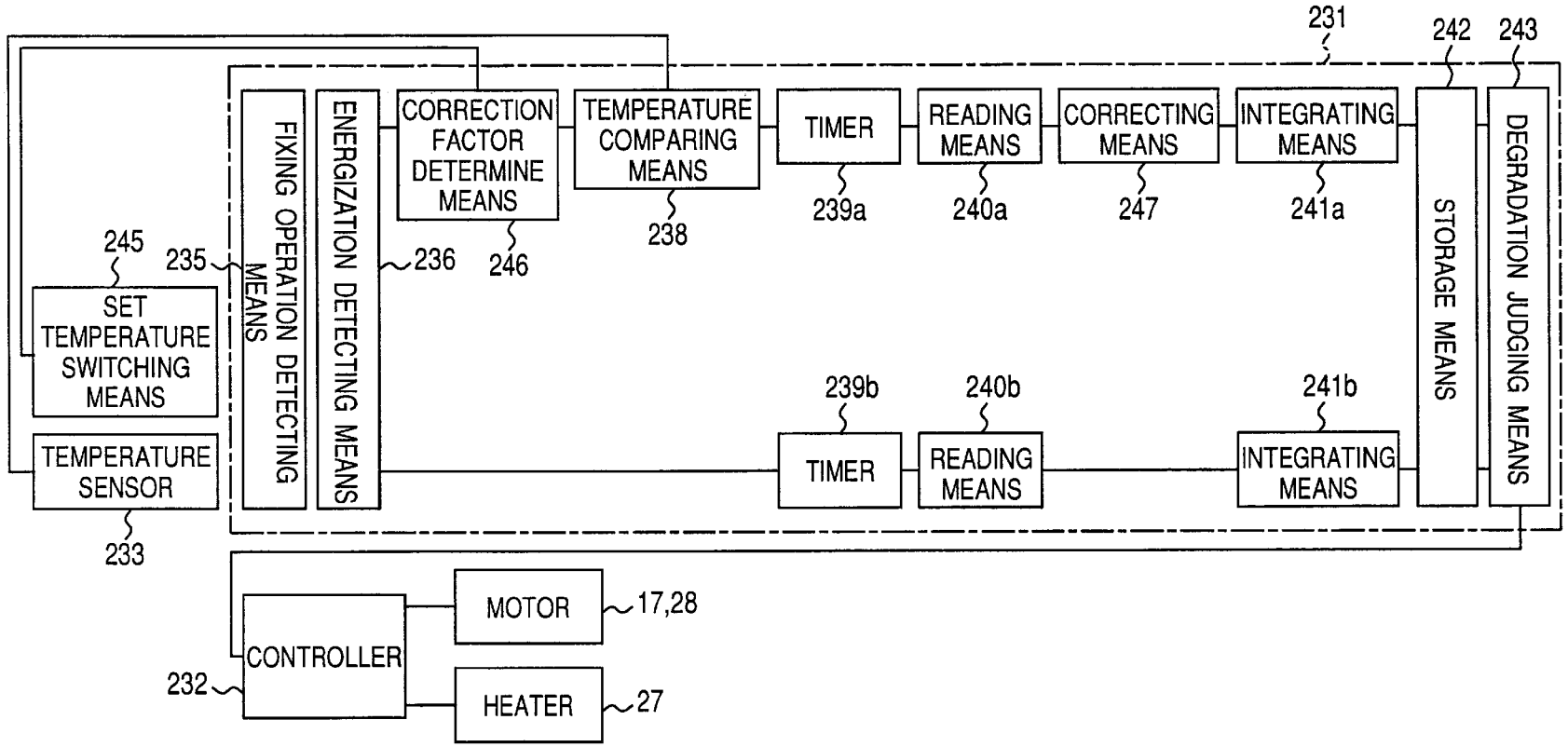
FIG. 37 is a block diagram showing thermal degradation estimating means 231 disposed in a fixing device of the ninth embodiment of the invention.

A fixing device of a ninth embodiment of the invention shown in FIG. 37 comprises set temperature switching means 245 for switchingly setting the set value of the fixing temperature (set temperature $t_{set}$) to one of three kinds of values, $t_{set1}$, $t_{set2}$, and $t_{set3}$. The set temperature switching means 245 may be configured so that the set temperature $t_{set}$ is manually input through an operation panel (not shown), or the set temperature is automatically switched over.

In the ninth embodiment, the thermal degradation estimating means 231 further comprises correction factor determining means 246 and correcting means 247.

The other configuration of the ninth embodiment is identical with that of the eighth embodiment. Hence like components are denoted by the same reference numerals, and the description is omitted.

With reference to the flowchart shown in FIG. 38, the operation of the ninth embodiment will be described. The fixing operation detecting means 235 judges in step S38-1 whether the fixing operation is being performed or not. If it is judged in step S38-1 that the fixing operation is being performed, then the control is advanced to step S38-2.

In step S38-2, the energization detecting means 236 judges whether the heaters 27 are energized or not. If the heaters are energized, then the control is advanced to step S38-3, and, if the heaters are not energized, then the control is returned to step S38-1.

In step S38-3, the detected temperature "t" which is detected by the temperature sensor 233 is supplied to the temperature comparing means 238.

Figure 39:
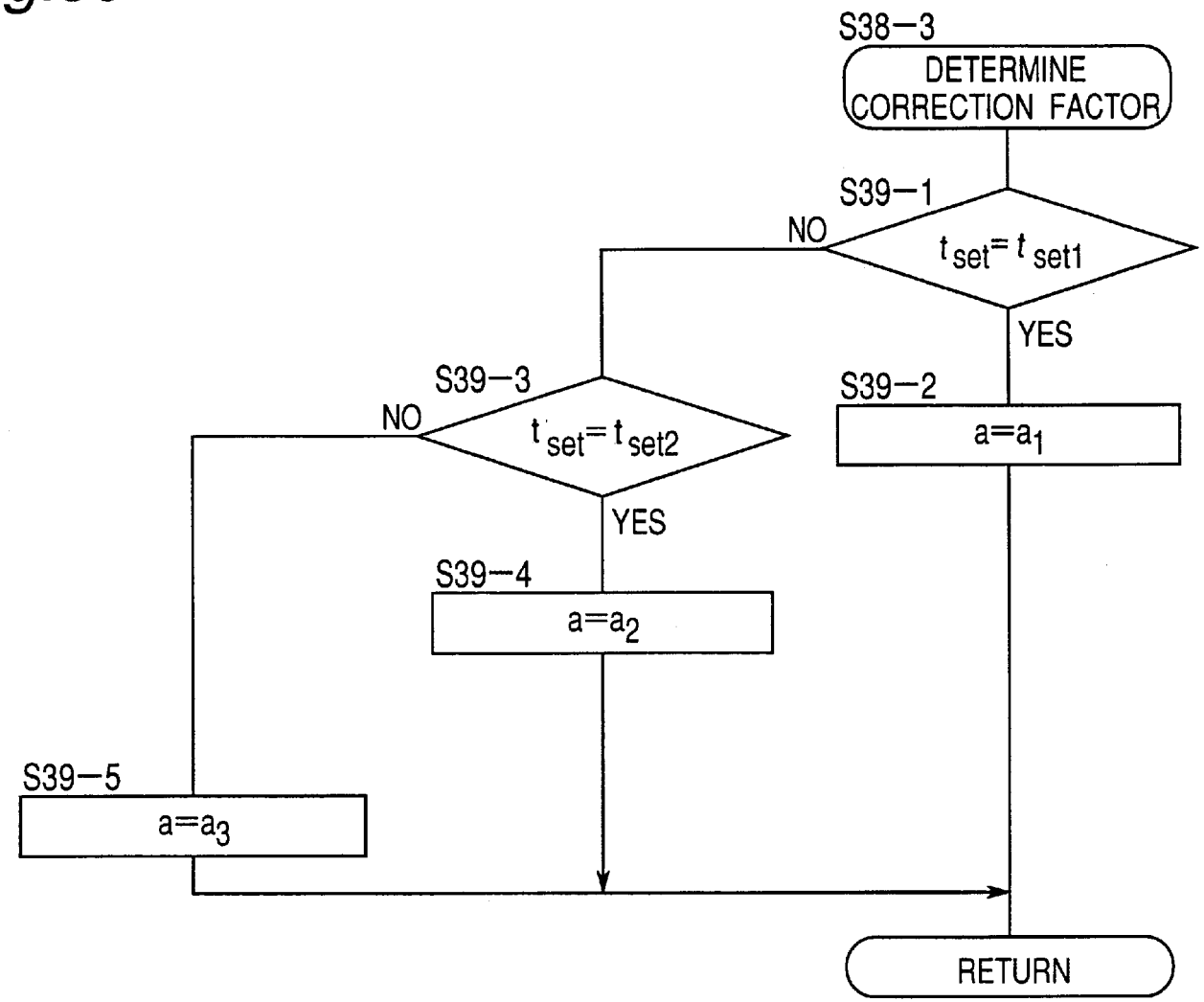
FIG. 39 is a flowchart showing a subroutine of step S38-3 of FIG. 38.

Next, the correction factor determining means 246 implements in step S38-4 the processing shown in FIG. 39 to determine a correction factor "a".

First, in step S39-1, it is judged whether the set temperature $t_{set}$ is equal to $t_{set1}$ or not. If the set temperature is equal to $t_{set1}$, then the correction factor "a" is set to $a_1$. If it is judged in step S39-1 that the set temperature $t_{set}$ is not equal to $t_{set1}$, then the control is advanced to step S39-3. In step S39-3, it is judged whether the set temperature $t_{set}$ is equal to $t_{set2}$ or not. If the set temperature is equal to $t_{set2}$, then the correction factor "a" is set to $a_2$ in step S39-4. If it is judged in step S39-3 that the set temperature $t_{set}$ is not equal to $t_{set2}$, then the set temperature $t_{set}$ is equal to $t_{set3}$, and the correction factor "a" is set to $a_3$ in step S39-5.

Figure 38:
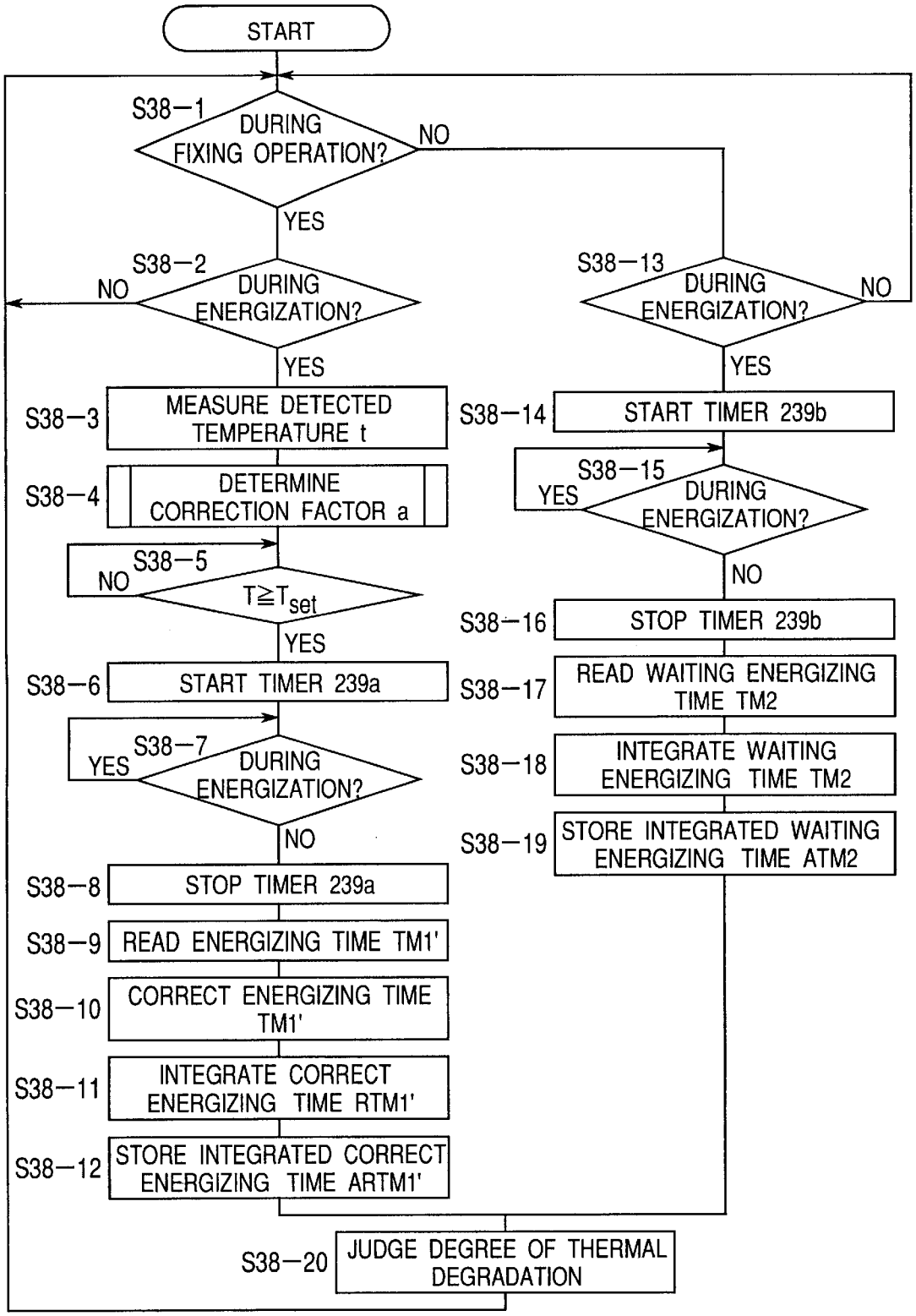
FIG. 38 is a flowchart illustrating the operation of the thermal degradation estimating means 231 of the ninth embodiment.

Next, the temperature comparing means 238 compares in step S38-5 of FIG. 38 the detected temperature "t" with the set temperature $t_{set}$. If the detected temperature t is not lower than the set temperature $t_{set}$, the timer 239*a* is started in step S38-6.

If it is detected in step S38-7 that the heaters 27 are not energized, then the timer 239*a* is stopped in step S38-8. In step S38-9, the reading means 240*a* reads out an energizing time TM1' which is measured by the timer 239*a*.

Next, in step S38-10, the energizing time TM1' read by the reading means 240*a* is multiplied with the correction factor "a" to calculate a corrected energizing time RTM1'. The corrected energizing time RTM1' is shown by following expression (3).

$$RTM1'=a\times TM1' \quad (3)$$

Next, the integrating means 241*a* calculates in step S38-11 an integrated corrected energizing time ARTM1' which is an integrated value of the corrected energizing time RTM1'. In step S38-12, the integrated corrected energizing time ARTM1' is stored into the storage means 242.

By contrast, if the fixing operation detecting means 235 judges in step S38-1 that the fixing device is not performing the fixing operation or is in the waiting state, then the processing of steps 38-13 to 38-19 is performed in the same manner as that of steps 35-11 to 35-17 (see FIG. 35) in the eighth embodiment.

In step S38-20, the degradation judging means 243 judges the degree of thermal degradation of the silicone rubber layers 26 of the fixing roller 14 and the pressure roller 15, on the basis of the integrated corrected energizing time ARTM1' and the integrated waiting energizing time ATM2 which are stored in the storage means 242. Specifically, the degradation judging means 243 calculates an estimated degradation time DTM from following expression (4).

$$DTM=ARTM1'+ATM2\times 0.2 \quad (4)$$

Next, the degradation judging means 243 judges a degradation level DL from the estimated degradation time DTM and on the basis of FIG. 36.

On the basis of Table 25 listed above, the control means 232 corrects the fixing temperature in accordance with the degradation level DL.

In the ninth embodiment, as described above, the degree of thermal degradation of the silicone rubber layers 26 is estimated on the basis of, in place of a simple integration of the energizing time during the fixing operation, the integrated corrected energizing time ARTM1' which is an integrated value of the corrected energizing time RTM1' that has been corrected by using the correction factor a corresponding to the set temperature $t_{set}$. Therefore, the estimation can be performed in a more highly accurate manner.

Tenth Embodiment

Figure 40:
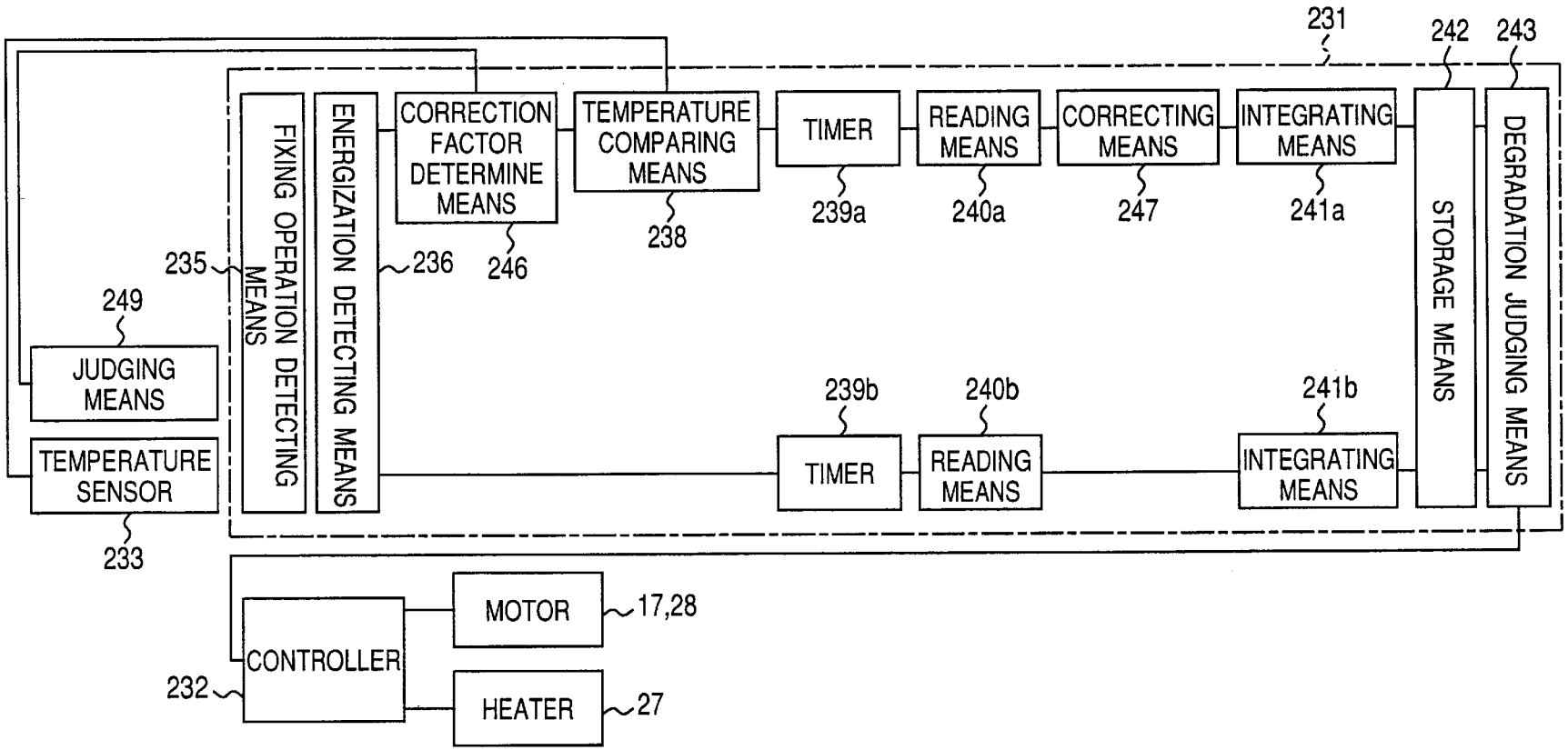
FIG. 40 is a block diagram showing thermal degradation estimating means 231 disposed in a fixing device of the tenth embodiment of the invention.

In a tenth embodiment of the invention shown in FIG. 40, the correction factor determining means 246 is connected to judging means 249 for judging the kind of the transfer sheet 30, and determines the set temperature $t_{set}$ and the correction factor "a" on the basis of an input from the judging means 249. In other words, the correction factor determining means 246 in the tenth embodiment is provided with also the function of the set temperature switching means 245 in the ninth embodiment.

Figure 41:
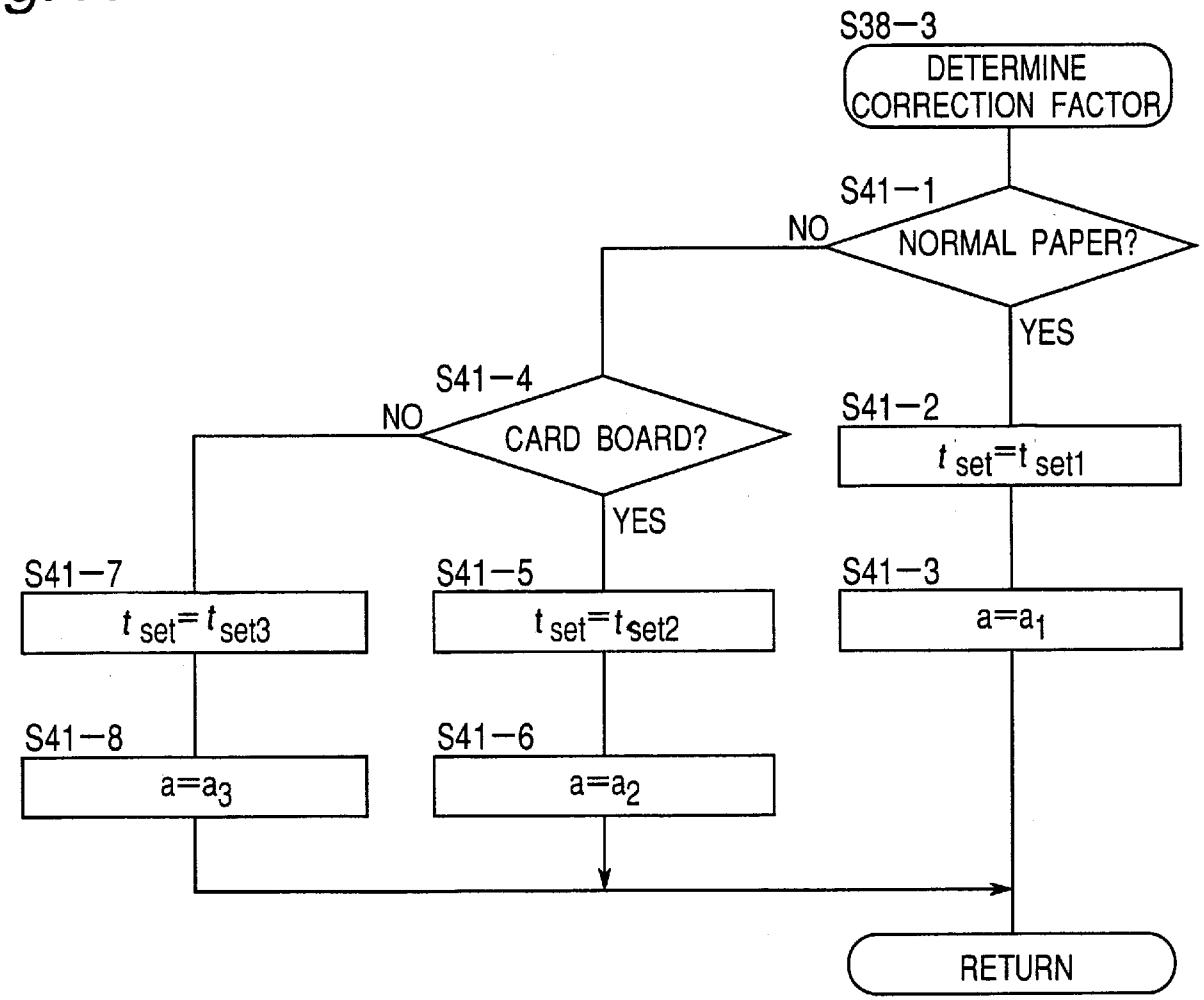
FIG. 41 is a flowchart showing a subroutine of step S38-3 of FIG. 38A in the tenth embodiment.

The operation of the tenth embodiment is different from that of the ninth embodiment in that the determination of the correction factor "a" in step S38-4 of FIG. 38 is performed on the basis of the flowchart shown in FIG. 41.

In step S41-1 of FIG. 41, the correction factor determining means 246 judges whether the transfer sheet 30 is normal paper or not, on the basis of an input signal from the judging means 249. If the transfer sheet 30 is normal paper, then the set temperature $t_{set}$ is set to $t_{set1}$ in step S41-2, and the correction factor "a" is set to $a_1$ in step S41-3. By contrast, if it is judged in step S41-1 that the transfer sheet 30 is not normal paper, then it is judged in step S41-4 whether the transfer sheet 30 is thick paper or not. If it is judged in step S41-4 that the transfer sheet 30 is thick paper, then the set temperature $t_{set}$ is set to $t_{set2}$ in step S41-5, and then the correction factor "a" is set to $a_2$ in step S41-6. If it is judged in step S41-4 that the transfer sheet 30 is not thick paper, then the set temperature $t_{set}$ is set to $t_{set3}$ in step S41-7, and then the correction factor "a" is set to $a_3$ in step S41-8.

The other configuration and function of the tenth embodiment are identical with those of the ninth embodiment, and the description is omitted.

In the tenth embodiment, as described above, the degree of thermal degradation of the silicone rubber layers 26 is estimated on the basis of, in place of a simple integration of the energizing time during the fixing operation, the integrated corrected energizing time ARTM1' which is an integrated value of the corrected energizing time RTM1' that has been corrected by using the correction factor "a" corresponding to the kind of the transfer sheet 30. Therefore, the estimation can be performed in a more highly accurate manner.

Eleventh Embodiment

Figure 42:
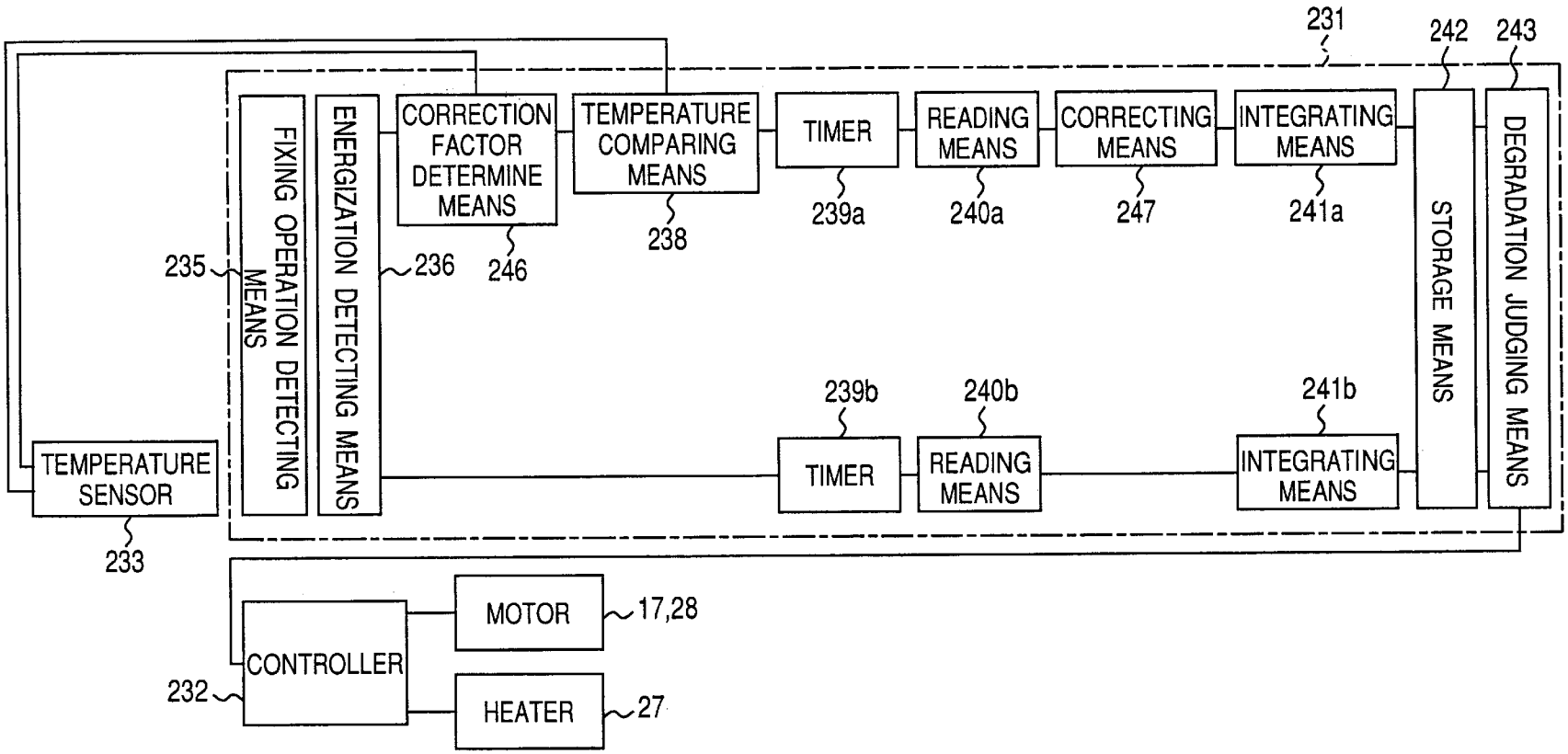
FIG. 42 is a block diagram showing thermal degradation estimating means 231 disposed in a fixing device of the eleventh embodiment of the invention.

In an eleventh embodiment of the invention shown in FIG. 42, the temperature sensor 233 are connected to the temperature comparing means 238 and the correction factor determining means 246.

Figure 43:
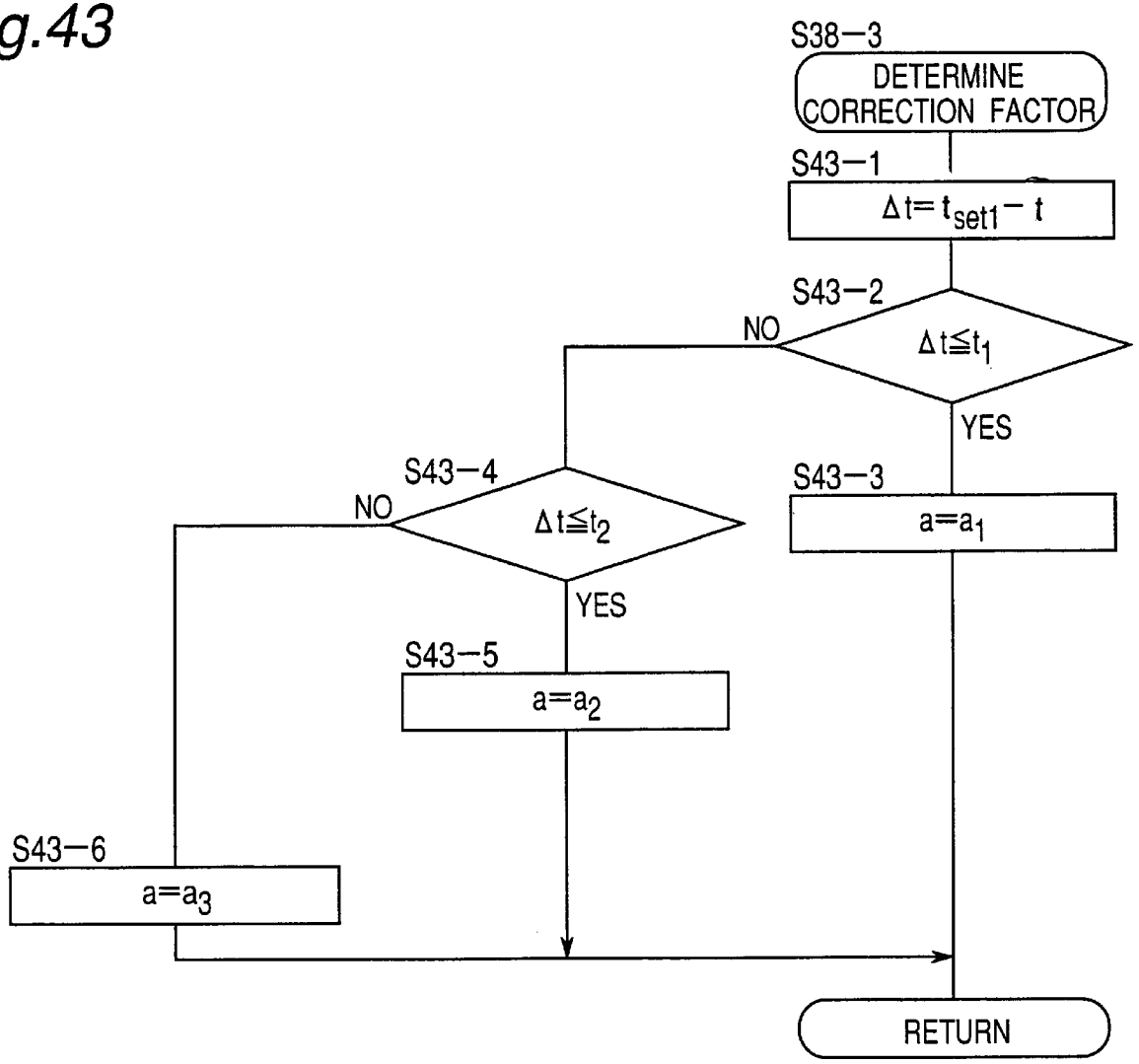
FIG. 43 is a flowchart showing a subroutine of step S38-3 of FIG. 38A in the eleventh embodiment.

The operation of the eleventh embodiment is different from that of the ninth embodiment in that the determination of the correction factor "a" in step S38-4 of FIG. 38 is performed on the basis of the flowchart shown in FIG. 43.

In step S43-1 of FIG. 43, the correction factor determining means 246 calculates the difference (temperature difference Δt) between the detected temperature t and the predetermined set temperature $t_{set}$ on the basis of following equation (5).

$$\Delta t = t_{set} - t \tag{5}$$

Next, it is judged in step S43-2 whether the temperature difference Δt is equal to or smaller than a first predetermined value $t_1$ or not. If it is judged in step S43-2 that the temperature difference Δt is equal to or smaller than the first predetermined value $t_1$, then the correction factor "a" is set to $a_1$ in step S43-3. If it is judged in step S43-2 that the temperature difference Δt is not equal to nor smaller than the first predetermined value $t_1$, then it is judged in step S43-4 whether the temperature difference Δt is equal to or smaller than a second predetermined value $t_2$ or not. If it is judged in step S43-4 that the temperature difference Δt is equal to or smaller than the second predetermined value $t_2$, then the correction factor "a" is set to $a_2$ in step S43-5. If the temperature difference Δt is not equal to nor smaller than the predetermined value $t_2$, then the correction factor "a" is set to $a_3$ in step S43-6.

The other configuration and function of the eleventh embodiment are identical with those of the ninth embodiment, and the description is omitted.

In the eleventh embodiment, as described above, the degree of thermal degradation of the silicone rubber layers 26 is estimated on the basis of, in place of a simple integration of the energizing time during the fixing operation, the integrated corrected energizing time ARTM1' which is an integrated value of the corrected energizing time RTM1' that has been corrected by using the correction factor "a" corresponding to the temperature difference Δt between the set temperature $t_{set}$ and the detected temperature "t". Therefore, the estimation can be performed in a more highly accurate manner.

Twelfth Embodiment

Figure 44:
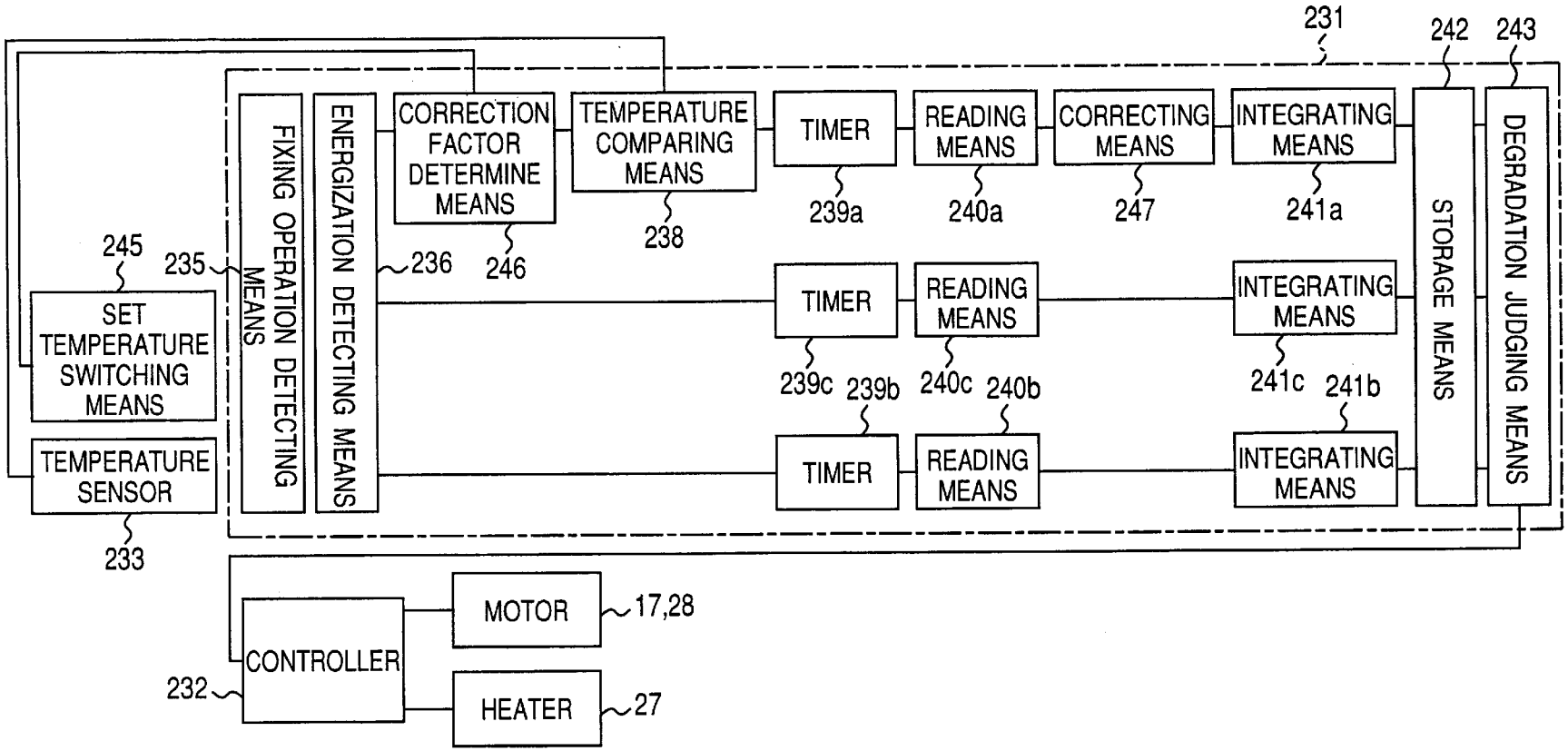
FIG. 44 is a block diagram showing thermal degradation estimating means 231 disposed in a fixing device of the twelfth embodiment of the invention.
Figure 46:
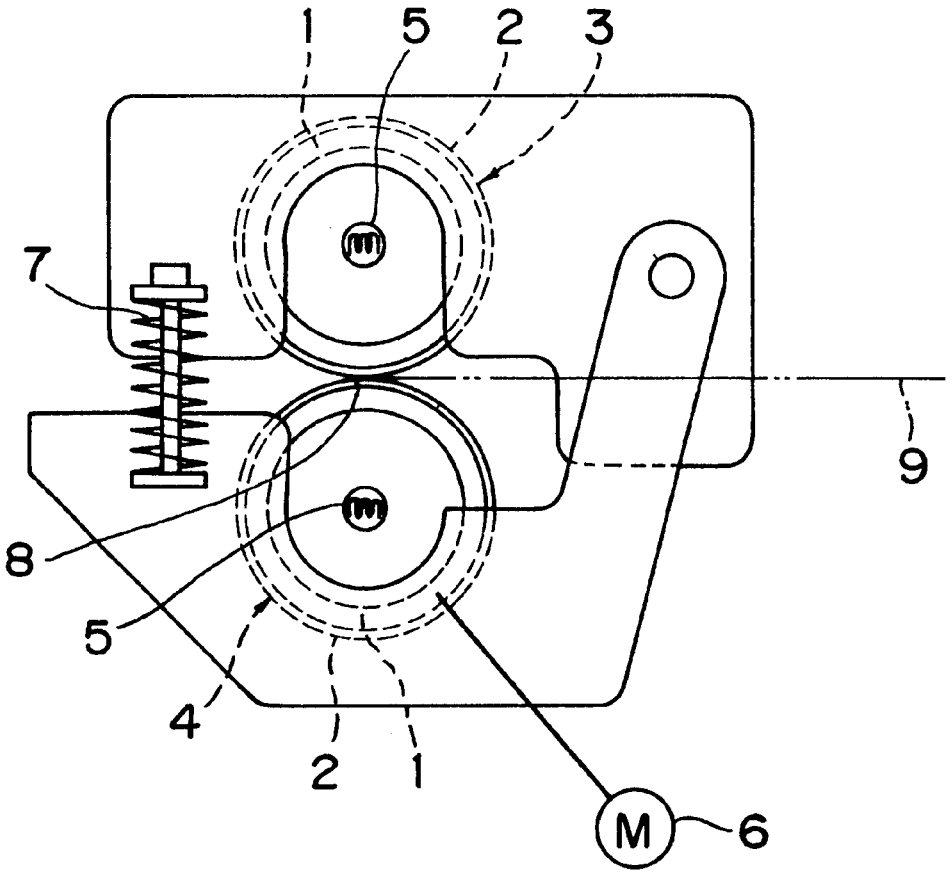
Fig.46 PRIOR ART
FIG. 46 is a diagram showing a conventional fixing device.

In a twelfth embodiment of the invention shown in FIG. 44, in the same manner as the ninth embodiment, the thermal degradation estimating means 231 comprises the correction factor determining means 246, the temperature comparing means 238, the timer 239*a*, the reading means 240*a*, the correcting means 247, and the integrating means 241*a* which are used for calculating the integrated corrected energizing time ARTM1'. The thermal degradation estimating means 231 further comprises a timer 239*b*, the reading means 240*b*, and the integrating means 241*b* which are used for calculating the integrated waiting energizing time ATM2. The thermal degradation estimating means 231 further comprises, a timer 239*c*, reading means 240*c*, and integrating means 241*c* which are provided for calculating the energizing time TM1" and an integrated energizing time ATM1" that is an integrated value of the energizing time TM1", irrespective of the detected temperature "t".

With reference to the flowchart shown in FIG. 45, the operation of the twelfth embodiment will be described. If the fixing operation detecting means 235 judges in step S45-1 that the fixing operation is being performed, then the control is advanced to step S45-2. Then, the energization detecting means 236 judges whether the heaters 27 are energized or not. If the heaters 27 are energized, then the control is advanced to step S45-3, and, if the heaters are not energized, then the control is returned to step S45-1.

In step S45-3, the timer 239*c* is started, and, in step S45-4, the detected temperature "t" is supplied from the temperature sensor 233 to the temperature comparing means 238.

Next, the correction factor determining means 246 determines in step S45-5 the correction factor "a" in the same method as that of the ninth embodiment (see FIG. 38). Alternatively, the correction factor "a" may be determined in the same method as that of the tenth embodiment shown in FIG. 41 or that of the eleventh embodiment shown in FIG. 43.

If the temperature comparing means 238 judges in step S45-6 that the detected temperature t is not lower than the set temperature $t_{set}$ set by the set temperature switching means 245, then the timer 239*a* is started in step S45-7.

If it is detected in step S45-8 that the heaters 27 are not energized, then the timers 239*a* and 239*c* are stopped in steps S45-9 and S45-10.

In step S45-11, the reading means 240*a* reads out the energizing time TM1' which is measured by the timer 239*a*, and, in step S45-12, the reading means 240*c* reads out the energizing time TM1" which is measured by the timer 239*c*.

In step S45-13, the correcting means 247 corrects the energizing time TM1' by expression (3) listed above to calculate the corrected energizing time RTM1'.

In step S45-14, the accumulating means 241*c* calculates the integrated energizing time ATM1" which is an integrated value of the energizing time TM1". As seen from steps S45-2, S45-3, S45-7, S45-8, and S45-9, the integrated energizing time ATM1" is obtained by simply integrating the energizing time during the fixing operation irrespective of the detected temperature t and the set temperature $t_{set}$. In step S45-15, the integrating means 241*a* calculates the integrated corrected energizing time ARTM1' which is an integrated value of the corrected energizing time RTM1'.

In step S45-16, the integrated energizing time ATM1" is stored into the storage means 242, and, in step S45-17, the integrated corrected energizing time ARTM1' is stored into the storage means 242.

By contrast, if the fixing operation detecting means 235 judges in step S45-1 that the fixing device is not performing the fixing operation, then the processing of steps S45-18 to S45-24 is performed in the same manner as that in the eighth embodiment so that the integrated waiting energizing time ATM2 is calculated and the calculated time is stored into the storage means 242.

In step S45-25, the degradation judging means 243 judges the degree of thermal degradation of the silicone rubber layers 26 of the fixing roller 14 and the pressure roller 15, on the basis of the integrated energizing time ATM1", the integrated corrected energizing time ARTM1', and the integrated waiting energizing time ATM2 which are stored in the storage means 242. Specifically, the degradation judging means 243 first calculates the estimated degradation time DTM from following expression (6).

$$DTM=(ATM1''-ATM2)\times 0.5+ARTM1'+ATM2\times 0.2 \quad (6)$$

Next, the degradation judging means 243 judges the degradation level DL from the estimated degradation time DTM and on the basis of FIG. 36. The control means 232 corrects the fixing temperature on the basis of Table 25 listed above and in accordance with the degradation level DL. In the twelfth embodiment, since the degree of thermal degradation is estimated on the basis of the three kinds of integrated energizing times as described above, the estimation can be performed in a highly accurate manner.

Although the present invention has been fully described by way of the examples with reference to the accompanying drawings, it is to be noted here that various changes and modifications will be apparent to those who skilled in the art. Therefore, unless such changes and modifications otherwise depart from the spirit and scope of the present invention, they should be construed as being therein.

What is claimed is:

1. A fixing device comprising:

first and second fixing members each of which has an elastic member and which are abutted against each other so that said elastic members contact with each other;

a heater which heats at least one of said first and second fixing members; and a controller which corrects fixing conditions in accordance with an integrated energizing time that is an integrated value of an energizing time of said heater, wherein a sheet carrying an image of a developer is passed between said first and second fixing members, whereby the developer is heated and fused under a pressure exerted by said first and second fixing members, to be fixed onto the sheet.

2. A fixing device as in claim 1, wherein said fixing device further comprises a device which maintains constant a length of a contact portion between said first and second fixing members in a direction along which the sheet is passed.

3. A fixing device as in claim 1, wherein the fixing conditions include a fixing speed.

4. A fixing device as in claim 3, wherein said controller decreases the fixing speed in accordance with the integrated energizing time.

5. A fixing device as in claim 4, wherein said controller further decreases the fixing speed in a stepwise manner as the integrated energizing time is longer.

6. A fixing device as in claim 1, wherein the fixing conditions include a fixing temperature.

7. A fixing device as in claim 6, wherein said controller increases the fixing temperature in accordance with the integrated energizing time.

8. A fixing device as in claim 7, wherein said controller further increases the fixing temperature in a stepwise manner as the integrated energizing time is longer.

9. A fixing device as in claim 8, wherein said fixing device further comprises means for switchingly setting the fixing temperature to one of plural set values, and said controller increases the fixing temperature at a shorter interval with respect to the integrated energizing time as the fixing temperature set by said setting means is higher.

10. A fixing device as in claim 8, wherein said fixing device further comprises means for switchingly setting the fixing temperature to one of plural set values, and said controller increases the fixing temperature at a larger step width as the fixing temperature set by said setting means is higher.

11. A fixing device as in claim 1, wherein said fixing device further comprises a detector which detects a surface temperature of said elastic member of at least one of said first and second fixing members, and said controller corrects at least one of a fixing speed and a fixing temperature in accordance with the surface temperature of said elastic member which is detected by said detector.

12. A fixing device as in claim 1, wherein said fixing device further comprises a device which adjusts an abutting force between said first and second fixing members, and the fixing conditions include the abutting force between said first and second fixing members.

13. A fixing device as in claim 12, wherein said abutting force adjusting device includes an urging member which urges at least one of said first and second fixing members in a direction along which the abutting force is increased, and said controller adjusts an urging force of said urging member, thereby correcting the abutting force between said first and second fixing members.

14. A fixing device as in claim 12, wherein said fixing device further comprises a device which maintains constant a length of a contact portion between said first and second fixing members in a direction along which the sheet is passed.

15. A fixing device as in claim 12, wherein said controller decreases the abutting force in accordance with the integrated energizing time.

16. A fixing device as in claim 1, wherein each of said first and second fixing members has a roller shape.

17. A fixing device comprising:

first and second fixing members each of which has an elastic member and which are abutted against each other so that said elastic members contact with each other;

a heater which heats at least one of said first and second fixing members; and a controller which corrects fixing conditions in accordance with an integrated energizing time that is an integrated value of an energizing time of said heater, and information of an image to be fixed, wherein a sheet carrying an image of a developer is passed between said first and second fixing members, whereby the developer is heated and fused under a pressure exerted by said first and second fixing members, to be fixed onto the sheet.

18. A fixing device as in claim 17, wherein the fixing conditions include at least one of a fixing speed and a fixing temperature.

19. A fixing device as in claim 17, wherein said fixing device further comprises a device which maintains constant a length of a contact portion between said first and second fixing members in a direction along which the sheet is passed.

20. A fixing device as in claim 17, wherein the image information includes a density and an area of the image to be fixed.

21. A fixing device as in claim 20, wherein said controller corrects the fixing conditions so that, in the case where the sheet on which the image is to be fixed is normal paper, a quantity of heat supplied to the sheet is increased in a stepwise manner as the integrated energizing time is longer, and, the quantity of heat supplied to the sheet is increased as an area of a high-density portion of the image to be fixed is larger.

22. A fixing device as in claim 20, wherein said controller corrects the fixing conditions so that, in the case where a sheet on which the image is to be fixed is an OHP sheet, a quantity of heat supplied to the sheet is increased in a stepwise manner as the integrated energizing time is longer, and, the quantity of heat supplied to the sheet is increased as an area of a half-tone portion of the image to be fixed is larger.

23. A fixing device as in claim 20, wherein, in the case where a sheet on which the image is to be fixed is normal paper, said controller corrects the fixing conditions so that, a quantity of heat supplied to the sheet is increased in a stepwise manner as the integrated energizing time is longer, and, the quantity of heat supplied to the sheet is increased as an area of a high-density portion of the image to be fixed is larger, wherein, in the case where the sheet on which the image is to be fixed is an OHP sheet, said controller corrects the fixing conditions so that, the quantity of heat supplied to the sheet is increased in a stepwise manner as the integrated energizing time is longer, and, the quantity of heat supplied to the sheet is increased as an area of a half-tone portion of the image to be fixed is larger, and wherein, in the case where the sheets on which the image is to be fixed include both normal paper and an OHP sheet, said controller corrects the fixing conditions under same conditions as the conditions of normal paper when the area of a high-density portion of the image to be fixed is large, and corrects the fixing conditions under same conditions as the conditions of an OHP sheet when the area of a half-tone portion of the image to be fixed is large.

24. A fixing device as in claim 20, wherein, in the case where a sheet on which the image is to be fixed is normal paper, said controller corrects the fixing conditions so that a quantity of heat supplied to the sheet is increased in a stepwise manner as the integrated energizing time is longer, and, the quantity of heat supplied to the sheet is increased as an area of a high-density portion of the image to be fixed is larger, wherein, in the case where the sheet on which the image is to be fixed is an OHP sheet, said controller corrects the fixing conditions so that the quantity of heat supplied to the sheet is increased in a stepwise manner as the integrated energizing time is longer, and, the quantity of heat supplied to the sheet is increased as an area of a half-tone portion of the image to be fixed is larger, and, wherein, in the case where the sheets on which the image is to be fixed include both normal paper and an OHP sheet, said controller corrects the fixing conditions under same conditions as the conditions of the OHP sheet.

25. A fixing device as in claim 17, wherein said controller corrects the fixing conditions in accordance with a surface temperature of said elastic member of at least one of said first and second fixing members in addition to the integrated energizing time and the information of the image to be fixed.

26. A fixing device as in claim 17, wherein each of said first and second fixing members has a roller shape.

27. A fixing device comprising:

first and second fixing members each of which has an elastic member and which are abutted against each other so that said elastic members contact with each other;

a heater which heats at least one of said first and second fixing members; and estimating means for estimating a degree of thermal degradation of said elastic members on the basis of an integrated energizing time that is an integrated value of an energizing time of said heater, wherein a sheet carrying an image of a developer is passed between said first and second fixing members, whereby the developer is heated and fused under a pressure exerted by said first and second fixing members, to be fixed onto the sheet.

28. A fixing device as in claim 27, wherein said fixing device further comprises a controller which controls fixing conditions in accordance with the degree of the thermal degradation of said elastic members estimated by said estimating means.

29. A fixing device as in claim 27, wherein said estimating means includes time measuring means for measuring the energizing time of said heater, and integrating means for integrating the energizing time measured by said time measuring means, to obtain the integrated value, and wherein said time measuring means starts time measurement when a surface temperature of said elastic member of at least one of said first and second fixing members becomes not lower than a predetermined reference temperature.

30. A fixing device as in claim 27, wherein said fixing device further comprises means for switchingly setting a fixing temperature to one of plural set values, wherein said estimating means includes time measuring means for measuring the energizing time of said heater, and integrating means for multiplying the energizing time measured by said measuring means with a correction factor corresponding to the fixing temperature set by setting means and integrating the products, to obtain the integrated value, and wherein said time measuring means starts time measurement when a surface temperature of said elastic member of at least one of said first and second fixing members becomes not lower than the fixing temperature set by said setting means.

31. A fixing device as in claim 27, wherein said estimating means includes time measuring means for measuring the energizing time of said heater, and integrating means for multiplying the energizing time measured by said time measuring means with a correction factor corresponding to a difference between a surface temperature of said elastic member of at least one of said first and second fixing members and a predetermined reference temperature and integrating the products, to obtain the integrated value, and wherein said time measuring means starts time measurement when a surface temperature of said elastic member of at least one of said first and second fixing members becomes not lower than the predetermined reference temperature.

32. A fixing device as in claim 27, wherein said estimating means includes first and second time measuring means for measuring the energizing time of said heater, and integrating means for integrating first and second energizing times which are measured by said first and second time measuring means, to obtain first and second integrated values, wherein the integrated energizing time includes the first and second integrated values, wherein said first time measuring means starts time measurement when energization to said heater is started, and wherein said second time measuring means starts time measurement when a surface temperature of said elastic member of at least one of said first and second fixing members becomes not lower than a predetermined reference temperature.

33. A fixing device as in claim 32, wherein said integrating means multiplies the first energizing time with a predetermined correction factor and integrates the products, to obtain the first integrated value.

34. A fixing device as in claim 27, wherein the integrated energizing time is an integrated value of the energizing time of said heater during a fixing operation, and wherein said estimating means estimates the degree of thermal degradation of said elastic members on the basis of an integrated value of the energizing time of said heater in a waiting state in which the fixing operation is not performed, in addition to the integrated energizing time.

35. A fixing device as in claim 27, wherein each of said first and second fixing members has a roller shape.

36. A fixing device as in claim 27, wherein said fixing device further comprises a device which maintains constant a length of a contact portion between said first and second fixing members in a direction along which the sheet is passed.

* * * * *